US008109805B2

(12) United States Patent
Hirai

(10) Patent No.: US 8,109,805 B2
(45) Date of Patent: Feb. 7, 2012

(54) TOY VEHICLE, AND WHEEL DEVICE AND CARRIAGE FRAME FOR THE TOY VEHICLE

(75) Inventor: Hirotsugu Hirai, Osaka (JP)

(73) Assignee: Eishindo Co., Ltd., Osaka (JP)

( * ) Notice: Subject to any disclaimer, the term of this patent is extended or adjusted under 35 U.S.C. 154(b) by 328 days.

(21) Appl. No.: 12/439,557

(22) PCT Filed: Sep. 4, 2007

(86) PCT No.: PCT/JP2007/067230

§ 371 (c)(1),
(2), (4) Date: Mar. 2, 2009

(87) PCT Pub. No.: WO2008/029808

PCT Pub. Date: Mar. 13, 2008

(65) Prior Publication Data

US 2010/0009597 A1 Jan. 14, 2010

(30) Foreign Application Priority Data

Sep. 4, 2006 (JP) ..... 2006-239516
Jun. 27, 2007 (JP) ..... 2007-169826

(51) Int. Cl.
*A63H 18/12* (2006.01)

(52) U.S. Cl. ..... 446/444; 446/447; 446/465; 446/467; 446/470; 105/1.5; 105/29.2; 105/238.2; 238/10 E

(58) Field of Classification Search ..... 446/433, 446/444–447, 465, 467, 470; 105/1.5, 29.2, 105/238.2; 238/10 E; 295/37
See application file for complete search history.

(56) References Cited

U.S. PATENT DOCUMENTS 1,774,128 A * 8/1930 Caruso ..... 105/49
2,838,009 A * 6/1958 Bonanno ..... 105/77
3,010,254 A * 11/1961 Brown ..... 213/75 TC
3,120,080 A * 2/1964 Hahn ..... 446/447

(Continued)

FOREIGN PATENT DOCUMENTS

EP 200 837 11/1986

(Continued)

OTHER PUBLICATIONS

International Search Report dated Nov. 6, 2007.

(Continued)

*Primary Examiner* — Gene Kim
*Assistant Examiner* — Scott Young
(74) *Attorney, Agent, or Firm* — Buchanan Ingersoll & Rooney PC

(57) ABSTRACT

A wheel device for a toy vehicle, in which one of a pair of wheels rolling on a pair of metal rails attracts with a magnet to reduce resistance caused by magnetic force and suppress load on a motor. The wheel device 1 includes a first axle 2, and a first wheel 10 and a second wheel 20 provided on opposite sides of the first axle 2. The first wheel 10 includes a first wheel main body 11 rolling on one of the rails 261 and a first flange 12 guided by the one rail. The second wheel 20 includes a second wheel main body 21 rolling on the other of the rails 261 and a second flange 22 guided by the other rail. The second wheel main body 21 is formed of a magnet.

11 Claims, 54 Drawing Sheets

U.S. PATENT DOCUMENTS

| | | | | |
|---|---|---|---|---|
| 4,568,305 | A * | 2/1986 | De Anda et al. | 446/429 |
| 2001/0007806 | A1 * | 7/2001 | Hogan | 446/444 |

FOREIGN PATENT DOCUMENTS

| | | | |
|---|---|---|---|
| JP | 52-90093 | | 7/1977 |
| JP | 60698 / 1982 | | 4/1982 |
| JP | 60-500361 | A | 3/1985 |
| JP | 62-59101 | A | 3/1987 |
| JP | 5-78291 | U | 10/1993 |
| JP | 2002-028379 | A | 1/2002 |
| JP | 2003-79966 | A | 3/2003 |
| JP | 2003-190657 | A | 7/2003 |
| JP | 2005-143704 | A | 6/2005 |
| JP | 2006-43384 | A | 2/2006 |

OTHER PUBLICATIONS

Notification of Transmittal of Translation of the International Preliminary Report on Patentability (Form PCT/IB/338), International Preliminary Report on Patentability (Form PCT/IB/373), Written Opinion of the International Search Authority (Form PCT/ISA/237) mailed in corresponding International Patent Application No. PCT/JP2007/067230, Mar. 26, 2009, The International Bureau of WIPO, Geneva, CH.

* cited by examiner ( a )

( b )

( c )

( b ) ( a )

(a)

(b)

( a )

( b )

( c )

(a)

(b)

(a)

(b)

(a)

(b)

(a) (b)

(b)

(a)

(a) (b)

(a)

(b)

(a)

(b)

(a)

(b)

(a) (b)

(a)

(b)

TOY VEHICLE, AND WHEEL DEVICE AND CARRIAGE FRAME FOR THE TOY VEHICLE

TECHNICAL FIELD

The present invention relates to a wheel device for a toy vehicle traveling on a pair of metal rails while attracting with magnets and a toy vehicle including the wheel device.

BACKGROUND ART

A conventional wheel device for a toy vehicle traveling on a pair of metal rails while attracting with magnets has left and right wheels attracting the rails with magnetic forces (e.g., Patent Document 1). A conventional wheel device for a toy vehicle traveling with a motor provided inside the toy vehicle being rotated by power fed from the pair of rails is structured so that metal wheels provided on opposite sides of an axle come in contact with the pair of rails thereby to receive power feeding (e.g., Patent Document 2).

Patent Document 1: Japanese Patent Application National Publication No. 60-500361

Patent Document 2: Japanese Patent Application Laid-Open No. 52-90093

DISCLOSURE OF THE INVENTION

Problems to be Solved by the Invention

When a conventional toy vehicle is traveling a curve, an inner wheel tries to rotate slowly while an outer wheel tries to rotate fast. However, both the wheels are fixed to an axle and therefore rotate at substantially the same speed. As a result, the inner wheel or the outer wheel may slip on the rail. In the case of the above-described conventional wheel device having both the wheels rotating while attracting with the magnets, both the wheels rotate similarly during straight traveling and therefore do not receive very large resistance of magnetic forces during rotation. During curve traveling, however, one of the wheels slips on the rail as described above and therefore the resistance of the magnetic forces is large, which equates to the state under braking. As a result, the toy vehicle is decelerated, a load on the motor increases, and consumption of electricity increases.

The invention of the present application has been accomplished with the above problems in view and it is an object of the invention to provide a wheel device for a toy vehicle which receives, even during curve traveling, as small resistance of magnetic forces as that received during straight traveling to suppress a load applied on a motor by causing one of a pair of wheels rotating on a pair of metal rails to attract with a magnet, and a toy vehicle using the wheel device.

Means for Solving the Problem

To achieve the above object, in a wheel device for a toy vehicle according to a first aspect of the invention of the present application, (a) the wheel device is adapted to be placed on a pair of rails and includes a first axle and first and second wheels provided on opposite sides of the first axle, (b) the first wheel includes a first wheel main body rolling on one of the rails and a first flange guided by the one rail and the first wheel main body and the first flange are made of a synthetic resin, and (c) the second wheel includes a second wheel main body rolling on the other of the rails and a second flange guided by the other rail and at least the second wheel main body is formed of a member attracting with a magnetic force.

To achieve the above object, in a wheel device for a toy vehicle according to a second aspect of the invention of the present application, the second wheel main body is formed of a magnet.

To achieve the above object, in a wheel device for a toy vehicle according to a third aspect of the invention of the present application, the second wheel main body is configured by a magnet and a rolling shaft having the magnet therein and formed in the shape of a round shaft.

To achieve the above object, in a wheel device for a toy vehicle according to a fourth aspect of the invention of the present application, the rolling shaft is made of ferromagnetic material.

To achieve the above object, in a wheel device for a toy vehicle according to a fifth aspect of the invention of the present application, the first wheel main body, the first flange, the first axle, and the second flange are made of a synthetic resin.

To achieve the above object, in a wheel device for a toy vehicle according to a sixth aspect of the invention of the present application, the first axle is formed with a gear.

To achieve the above object, in a toy vehicle according to a seventh aspect of the invention of the present application, (a) a toy vehicle main body includes a chassis and carriage frames mounted to a front and a rear of the chassis, (b) each of the carriage frames is provided with a pair of wheel devices for a toy vehicle according to any one of the first to sixth aspect of the invention, and (c) the pair of wheel devices is rotatably mounted to the carriage frame so that the second wheel main bodies formed of the members attracting with the magnetic forces come in contact with different rails.

To achieve the above object, in a wheel device for a toy vehicle according to a eighth aspect of the invention of the present application, (a) the device is adapted to be placed on a pair of rails and includes a second axle and third and fourth wheels provided on opposite sides of the second axle, (b) the third wheel includes a third wheel main body rolling on one of the rails and a third flange guided by the one rail and the third wheel main body and the third flange are made of a synthetic resin, (c) the fourth wheel includes a fourth wheel main body rolling on the other of the rails and a fourth flange guided by the other rail, and (d) the fourth wheel main body includes the second axle and formed of a member attracting with a magnetic force.

To achieve the above object, in a wheel device for a toy vehicle according to a ninth aspect of the invention of the present application, the fourth wheel main body is formed of a magnet.

To achieve the above object, in a wheel device for a toy vehicle according to a tenth aspect of the invention of the present application, the fourth wheel main body is formed of a magnet and a rolling shaft having the magnet therein and made of ferromagnetic material in the shape of a round shaft.

To achieve the above object, in a wheel device for a toy vehicle according to a eleventh aspect of the invention of the present application, the third wheel main body, the third flange, and the fourth flange are made of a synthetic resin.

To achieve the above object, in a wheel device for a toy vehicle according to a twelfth aspect of the invention of the present application, the second axle is provided with a conductive ring electrically conductive with the second axle between the third wheel and the fourth wheel.

To achieve the above object, in a toy vehicle according to a thirteenth aspect of the invention of the present application, (a) a toy vehicle main body includes a chassis and carriage frames mounted to a front and a rear of the chassis, (b) each of the carriage frames is provided with a pair of wheel devices for a toy vehicle according to any one of eighth to twelfth aspect of the invention, and (c) the pair of wheel devices is rotatably mounted on the carriage frame so that the fourth wheel main bodies formed of the members attracting with the magnetic forces come in contact with different rails.

To achieve the above object, in a toy vehicle according to a fourteenth aspect of the invention of the present application, (a) a toy vehicle main body includes a chassis and carriage frames mounted to a front and a rear of the chassis, (b) the carriage frame mounted to one of the front and rear portions is provided with a pair of wheel devices for a toy vehicle according to the sixth aspect of the invention, (c) the carriage frame mounted to the other of the front and rear portions is provided with a pair of wheel devices for a toy vehicle according to the twelfth aspect of the invention, (d) the chassis is provided with a drive motor and a gear train for transmitting rotation of the drive motor to the gears of the pair of wheel devices for a toy vehicle according to the sixth aspect of the invention, and (e) the chassis is provided with a first conductive contact coming in sliding contact with one of the conductive rings of the pair of wheel devices for a toy vehicle according to the twelfth aspect of the invention and a second conductive contact coming in sliding contact with the other conductive ring, the first conductive contact being electrically connected to one of a positive terminal and a negative terminal of the drive motor and the second conductive contact being electrically connected to the other of the positive terminal and the negative terminal of the drive motor.

To achieve the above object, in a toy vehicle according to a fifteenth aspect of the invention of the present application, the second wheel main bodies of the pair of wheel devices for a toy vehicle according to the sixth aspect of the invention formed of the members attracting with the magnetic forces and the fourth wheel main bodies of the pair of wheel devices for a toy vehicle according to the twelfth aspect of the invention formed of the members attracting with the magnetic forces are arranged so as to alternately come in contact with the different rails.

To achieve the above object, in a toy vehicle according to a sixteenth aspect of the invention of the present application, (a) a toy vehicle main body includes a chassis and carriage frames mounted to a front and a rear of the chassis, (b) the carriage frame mounted to the front or rear portion is provided with a pair of wheel devices for a toy vehicle according to the twelfth aspect of the invention, (c) the chassis is provided with an electric component, and (d) the chassis is provided with a first conductive contact coming in sliding contact with one of the conductive rings of the pair of wheel devices for a toy vehicle according to the twelfth aspect of the invention and a second conductive contact coming in sliding contact with the other conductive ring, the first conductive contact being electrically connected to one of a positive terminal and a negative terminal of the electric component and the second conductive contact being electrically connected to the other of the positive terminal and the negative terminal of the electric component.

To achieve the above object, in a toy vehicle according to a seventeenth aspect of the invention of the present application, (a) a toy vehicle main body includes a chassis and carriage frames mounted to a front and a rear of the chassis, (b) the carriage frames mounted to the front and rear portions are provided with wheel devices for a toy vehicle according to the twelfth aspect of the invention, (c) the chassis is provided with an electric component, and (d) the chassis is provided with a third conductive contact coming in sliding contact with the conductive ring of the wheel device for a toy vehicle according to the twelfth aspect of the invention at the front portion and a fourth conductive contact coming in sliding contact with the conductive ring of the wheel device for a toy vehicle according to the twelfth aspect of the invention at the rear portion, the third conductive contact being electrically connected to one of a positive terminal and a negative terminal of the electric component and the fourth conductive contact being electrically connected to the other of the positive terminal and the negative terminal of the electric component.

To achieve the above object, in a wheel device for a toy vehicle according to a eighteenth aspect of the invention of the present application, (a) the device is adapted to be placed on a pair of rails and includes an axle and a pair of wheels provided on opposite sides of the axle and (b) each of the wheels includes a wheel main body having a mounting shaft and a flange, and a magnet ring mounted on the mounting shaft, the magnet ring rolling on the rail and the flange being guided by the rail.

To achieve the above object, in a wheel device for a toy vehicle according to a nineteenth aspect of the invention of the present application, the axle is made of a synthetic resin and the wheel main body is made of ferromagnetic material.

To achieve the above object, in a wheel device for a toy vehicle according to a twentieth aspect of the invention of the present application, the axle is provided with a gear.

To achieve the above object, in a wheel device for a toy vehicle according to a twenty-first aspect of the invention of the present application, of the wheel main body is formed with a support recessed portion in which the axle is rotatably supported.

To achieve the above object, in a wheel device for a toy vehicle according to a twenty-second aspect of the invention of the present application, (a) the device is adapted to be placed on a pair of rails and includes a second axle and third and fourth wheels provided on opposite sides of the second axle, (b) the third wheel includes a third wheel main body having a mounting shaft and a third flange, and a magnet ring mounted to the mounting shaft, the magnet ring rolling on one of the rails and the third flange being guided by the one rail, (c) the fourth wheel includes a fourth wheel main body rolling on the other rail and a fourth flange guided by the other rail, (d) the second axle, the third wheel main body, and the fourth wheel are made of ferromagnetic material, (e) the third wheel main body is directly mounted on one side of the second axle to be electrically conductive with the second axle, and (f) the fourth wheel is mounted on the other side of the second axle with an auxiliary member made of a synthetic resin interposed therebetween not to be electrically conductive with the second axle.

To achieve the above object, in a wheel device for a toy vehicle according to a twenty-third aspect of the invention of the present application, the wheel main body is formed with a support recessed portion in which the axle is rotatably supported.

To achieve the above object, in a toy vehicle according to a twenty-fourth aspect of the invention of the present application, (a) a toy vehicle main body includes a chassis and carriage frames mounted to a front and a rear of the chassis, (b) the carriage frame mounted to one of the front and rear portions is provided with a pair of wheel devices for a toy vehicle according to the twentieth aspect of the invention, (c) the carriage frame mounted to the other of the front and rear portions is provided with a pair of wheel devices for a toy vehicle according to the twenty second aspect of the invention, (d) the chassis is provided with a drive motor and a gear train for transmitting rotation of the drive motor to the gears of the pair of wheel devices for a toy vehicle according to the twentieth aspect of the invention, and (e) the chassis is provided with a first conductive contact coming in sliding contact with one of the second axles of the pair of wheel devices for a toy vehicle according to the twenty second aspect of the invention and a second conductive contact coming in sliding contact with the other second axle, the first conductive contact being electrically connected to one of a positive terminal and a negative terminal of the drive motor and the second conductive contact being electrically connected to the other of the positive terminal and the negative terminal of the drive motor.

To achieve the above object, in a toy vehicle according to a twenty-fifth aspect of the invention of the present application, (a) a toy vehicle main body includes a chassis and carriage frames mounted to a front and a rear of the chassis, (b) the carriage frame mounted to the front or rear portion is provided with a pair of wheel devices for a toy vehicle according to the twenty-second aspect of the invention, (c) the chassis is provided with an electric component, and (d) the chassis is provided with a third conductive contact coming in sliding contact with one of the second axles of the pair of wheel devices for a toy vehicle according to the twenty-second aspect of the invention and a fourth conductive contact coming in sliding contact with the other second axle, the third conductive contact being electrically connected to one of a positive terminal and a negative terminal of the electric component and the fourth conductive contact being electrically connected to the other of the positive terminal and the negative terminal of the electric component.

To achieve the above object, in a toy vehicle according to a twenty-sixth aspect of the invention of the present application, (a) a toy vehicle main body includes a chassis and carriage frames mounted to a front and a rear of the chassis, (b) the carriage frames mounted to the front and rear portions are respectively provided with wheel devices for a toy vehicle according to the twenty-second aspect of the invention, (c) the chassis is provided with an electric component, and (d) the chassis is provided with a third conductive contact coming in sliding contact with the second axle of the wheel device for a toy vehicle according to the twenty-second aspect of the invention mounted to the front carriage frame and a fourth conductive contact coming in sliding contact with the second axle of the wheel device for a toy vehicle according to the twenty-second aspect of the invention mounted to the rear carriage frame, the third conductive contact being electrically connected to one of a positive terminal and a negative terminal of the electric component and the fourth conductive contact being electrically connected to the other of the positive terminal and the negative terminal of the electric component.

To achieve the above object, in a carriage frame for a toy vehicle according to a twenty-seventh aspect of the invention of the present application, (a) the carriage frame includes a main frame and a pair of bearing plates mounted to the main frame so that the plates face each other, (b) the bearing plate is made of ferromagnetic material and provided with a pair of support protruding portions and a protruding chip, and (c) the support recessed portions of the wheel device for a toy vehicle according to the twenty-first aspect of the invention are rotatably supported on the opposed support protruding portions of the pair of bearing plates.

To achieve the above object, in a carriage frame for a toy vehicle according to a twenty-eighth aspect of the invention of the present application, (a) the carriage frame includes a main frame and a pair of bearing plates mounted to the main frame so that the plates face each other, (b) the bearing plate is made of ferromagnetic material and provided with a pair of support protruding portions and a protruding chip, and (c) the support recessed portions of the wheel device for a toy vehicle according to the twenty-third aspect of the invention are rotatably supported on the opposed support protruding portions of the pair of bearing plates.

To achieve the above object, in a toy vehicle according to a twenty-ninth aspect of the invention of the present application, (a) a toy vehicle main body includes a chassis and the carriage frame for a toy vehicle according to the twenty-seventh aspect of the invention mounted to a front portion or a rear portion of the chassis, (b) the chassis is provided with a drive motor and a gear train for transmitting rotation of the drive motor to the gears of the pair of wheel devices for a toy vehicle according to the twenty-second aspect of the invention, and (c) the chassis is provided with a first conductive contact coming in contact with one of the protruding chips of the carriage frame for a toy vehicle according to the twenty-seventh aspect of the invention and a second conductive contact coming in contact with the other protruding chip of the carriage frame for a toy vehicle according to the twenty-seventh aspect of the invention, the first conductive contact being electrically connected to one of a positive terminal and a negative terminal of the drive motor and the second conductive contact being electrically connected to the other of the positive terminal and the negative terminal of the drive motor.

To achieve the above object, in a toy vehicle according to thirtieth aspect of the invention of the present application, (a) a toy vehicle main body includes a chassis and the carriage frame for a toy vehicle according to the twenty-seventh aspect of the invention mounted to a front portion or a rear portion of the chassis, (b) the chassis is provided with an electric component, and (c) the chassis is provided with a third conductive contact coming in contact with one of the protruding chips of the carriage frame for a toy vehicle according to the twenty-seventh aspect of the invention and a fourth conductive contact coming in contact with the other protruding chip of the carriage frame for a toy vehicle according to the twenty-seventh aspect of the invention, the third conductive contact being electrically connected to one of a positive terminal and a negative terminal of the electric component and the fourth conductive contact being electrically connected to the other of the positive terminal and the negative terminal of the electric component.

To achieve the above object, in a carriage frame for a toy vehicle according to a thirty-first aspect of the invention of the present application, (a) the carriage frame includes a main frame and a pair of bearing plates mounted to the main frame so that the plates face each other, (b) each of the bearing plates is made of ferromagnetic material and provided with a pair of support protruding portions and a protruding chip, (c) the wheel device is rotatably supported on the opposed support protruding portions of the pair of bearing plates, (d) the wheel device is adapted to be placed on a pair of rails and includes an axle and a pair of wheels provided on opposite sides of the axle, (e) the wheels includes a wheel main body rolling on the rail and a flange guided by the rail, (f) the axle is made of a synthetic resin and the wheels are made of ferromagnetic material, and (g) the wheel main body is formed with a support recessed portion to be rotatably supported on the support protruding portion of the bearing plate.

To achieve the above object, in a toy vehicle according to the thirty-second aspect of the invention of the present application, (a) a toy vehicle main body includes a chassis and the carriage frame for a toy vehicle according to the thirty-first aspect of the invention mounted to a front portion or a rear portion of the chassis, (b) the chassis is provided with an electric component, and (c) the chassis is provided with a third conductive contact coming in contact with one of the protruding chips of the carriage frame for a toy vehicle according to the thirty-first aspect of the invention and a fourth conductive contact coming in contact with the other protruding chip of the carriage frame for a toy vehicle according to the thirty-first aspect of the invention, the third conductive contact being electrically connected to one of a positive terminal and a negative terminal of the electric component and the fourth conductive contact being electrically connected to the other of the positive terminal and the negative terminal of the electric component.

Effects of the Invention

In the wheel device according to the present invention, one of the pair of wheels rolling on the pair of metal rails attracts with a magnetic force. As a result, the device receives, even during curve traveling, as small resistance of the magnetic force as that received during straight traveling and a load applied on a motor can be suppressed.

In the toy vehicle according to the present invention, the wheel main bodies of the wheel devices having the above effect and formed of the members attracting with the magnetic forces alternately come in contact with different rails. As a result, the toy vehicle can travel while keeping good balance thereof.

BEST MODES FOR CARRYING OUT THE INVENTION

An embodiment of a wheel device for a toy vehicle and a toy vehicle mounted with the wheel device according to the invention of the present application will be described based on FIGS. 1 to 9. FIGS. 1(*a*) to 1(*c*) are general views of the embodiments of a drive wheel device for a toy vehicle according to the present invention, wherein FIG. 1(*a*) is a front view, FIG. 1(*b*) is a sectional view, and FIG. 1(*c*) is another front sectional view. FIGS. 2(*a*) and 2(*b*) are exploded perspective views of the drive wheel devices for a toy vehicle according to the present invention mounted into a carriage, wherein FIG. 2(*a*) is a perspective view from below and FIG. 2(*b*) is a perspective view from above. FIG. 3 is an exploded perspective view of the drive wheel devices and follower wheel devices for a toy vehicle according to the present invention mounted into a toy vehicle. FIGS. 4(*a*) and 4(*b*) are sectional views of the wheel devices for a toy vehicle according to the present invention mounted into a toy vehicle, wherein FIG. 4(*a*) is a sectional view of an essential part when the drive wheel devices are mounted and FIG. 4(*b*) is a sectional view of an essential part when the follower wheel devices are mounted. FIGS. 5(*a*) and 5(*b*) are assembly drawings of FIG. 4, wherein FIG. 5(*a*) is a perspective view from above and FIG. 5(*b*) is a perspective view from below. FIG. 6 is an exploded perspective view of other follower wheel devices for a toy vehicle according to the present invention mounted into a toy vehicle. FIGS. 7(*a*) and 7(*b*) are assembly drawings of FIG. 6, wherein FIG. 7(*a*) is a perspective view from above and FIG. 7(*b*) is a perspective view from below. FIG. 8 is an exploded perspective view of other follower wheel devices for a toy vehicle according to the present invention mounted into a toy vehicle. FIGS. 9(*a*) and 9(*b*) are assembly drawings of FIG. 8, wherein FIG. 9(*a*) is a perspective view from above and FIG. 9(*b*) is a perspective view from below.

As shown in FIGS. 1(*a*) to 1(*c*), the wheel device 1, 1A for a toy vehicle is adapted to be placed on a pair of rails 261 and formed of a first axle 2, and a first wheel 10 and a second wheel 20 provided on opposite sides of the first axle 2. The first wheel 10 includes a first wheel main body 11 rolling on one of the rails 261 and a first flange 12 guided by the one rail and the first wheel main body 11 and the first flange 12 are made of a synthetic resin. The second wheel 20 includes a second wheel main body 21 rolling on the other of the rails 261 and a second flange 22 guided by the other rail 261 and at least the second wheel main body 21 is formed of a magnet.

The wheel device 1, 1A for a toy vehicle may be formed by integrally molding the first wheel main body 11, the first flange 12, the first axle 2, and the second flange 22 of a synthetic resin. The first axle 2 of the wheel device 1, 1A for a toy vehicle may be formed with a gear 8.

As shown in FIG. 3, a toy vehicle main body 102 of the toy vehicle 101 has a chassis 103 and carriage frames 71, 71 mounted to a front and a rear of the chassis 103. The carriage frame 71 is provided with a pair of wheel devices 1, 1A for a toy vehicle. The pair of wheel devices 1, 1A is rotatably mounted to the carriage frame 71 so that the second wheel main bodies 21 formed of the magnets are in contact with different rails 261.

As shown in FIGS. 3 to 4(*b*), a wheel device 31 for a toy vehicle is adapted to be placed on the pair of rails 261 and formed of a second axle 32, and a third wheel 40 and a fourth wheel 50 provided on opposite sides of the second axle 32. The third wheel 40 includes a third wheel main body 41 rolling on one of the rails 261 and a third flange 42 guided by the one rail 261 and the third wheel main body 41 and the third flange are made of a synthetic resin.

The fourth wheel 50 includes a fourth wheel main body 51 rolling on the other of the rails 261 and a fourth flange 52 guided by the other rail 261. The fourth wheel main body 51 is formed of a magnet, the fourth flange 52 is made of a synthetic resin, and the fourth wheel main body 51 is attached to the fourth flange 52. The second axle 32 is formed of the same member as the fourth wheel main body 51. In the wheel device 31 for a toy vehicle, the second axle 32 may be provided with a conductive ring 60 interposed between the third flange 42 and the fourth flange 52.

As shown in FIG. 3, the toy vehicle main body 102 of the toy vehicle 101 has the chassis 103 and the carriage frames 71, 71 mounted to the front and rear of the chassis 103. Each of the carriage frames 71, 71 is provided with a pair of wheel devices 31 for a toy vehicle. The pair of wheel devices 31, 31 are rotatably mounted to the carriage frame 71 so that the fourth wheel main bodies 51 formed of the magnets come in contact with different rails 261.

As shown in FIG. 3, the toy vehicle main body 102 of the toy vehicle 101 has the chassis 103 and the carriage frames 71, 71 mounted to the front and rear of the chassis 103. The carriage frame 71 mounted to one of the front and rear portions is provided with a pair of wheel devices 1 for a toy vehicle. The carriage frame 71 mounted to the other of the front and rear portions is provided with a pair of wheel devices 31 for a toy vehicle. The chassis 103 is provided with a drive motor 116 and a gear train 120 for transmitting rotation of the drive motor 116 to the gears 8, 8 of the pair of wheel devices 1, 1 for a toy vehicle. The chassis 103 is provided with a first conductive contact 141 which is in sliding contact with one of the conductive rings 60 of the pair of wheel devices 31, 31 for a toy vehicle and a second conductive contact 145 which is in sliding contact with the other conductive ring 60. The first conductive contact 141 is electrically connected to one of a positive terminal and a negative terminal of the drive motor 116 and the second conductive contact 145 is electrically connected to the other of the positive terminal and the negative terminal of the drive motor 116.

As shown in FIG. 16, in the toy vehicle 101, the second wheel main bodies 21 of the pair of wheel devices 1 for a toy vehicle and formed of the magnets and the magnet fourth wheel main bodies 51 of the pair of wheel devices 31 for a toy vehicle and formed of the magnets are arranged to alternately come in contact with different rails 261.

The drive wheel device, the follower wheel device, and the toy vehicle mounted with them will be described further in detail. As shown in FIGS. 1(*a*) to 2, the drive wheel device 1 includes the first axle 2, the first wheel 10, and the second wheel 20. The first axle 2 is made of a synthetic resin and formed into a cylindrical shape. One side face 3 of the first axle 2 is formed with a first round shaft recessed portion 5 coaxial with the first axle 2. The other side face 6 of the first axle 2 is formed with a second round shaft recessed portion 7 coaxial with the first axle 2 and having a larger diameter than the first round shaft recessed portion 5. A peripheral face of the first axle 2 is integrally molded with the gear 8. Cog tips of the gear 8 are curved to form spherical surfaces.

The first wheel 10 includes the first wheel main body 11, the first flange 12, and a fitting shaft 13 and is integrally molded of a synthetic resin. An outer side face 15 of the first flange 12 slopes so that a wall thickness reduces from a center toward an outer peripheral edge. The outer side face 15 of the first flange 12 is provided with the first wheel main body 11 substantially coaxial with the first flange 12. An inner side face 16 of the first flange 12 is provided with the fitting shaft 13 substantially coaxial with the first flange 12. The first wheel 10 is fitted and fixed into the first round shaft recessed portion 5 of the first axle 2.

The second wheel 20 includes the second wheel main body 21, the second flange 22, and a boss portion 23. The second wheel main body 21 is in the shape of a round shaft having substantially the same outer diameter as the first wheel main body 11 and is formed of the magnet, e.g., a neodymium magnet. An outer side face 25 of the second flange 22 slopes so that a wall thickness reduces from a center toward an outer peripheral edge. An inner side face 26 of the second flange 22 is provided with the boss portion 23 substantially coaxial with the second flange 22 and having substantially the same outer diameter as the first axle 2. The second flange 22 and the boss portion 23 are integrally molded of a synthetic resin.

The second flange 22 and the boss portion 23 are formed, substantially at centers thereof, with a through hole 27 having substantially the same inner diameter as the second round shaft recessed portion 7 of the first axle 2. The second wheel main body 21 passes through the through hole 27 and is fixed with its opposite sides protruding from the second flange 22 and the boss portion 23. The second wheel 20 is fixed with a protruding portion 29 of the second wheel main body 21 protruding from the boss portion 23 side being fitted in the second round shaft recessed portion 7 of the first axle 2. The gear 8 is in a substantially middle position between the first flange 12 and the second flange 22.

As described above, the drive wheel device 1 is made of a synthetic resin excluding the second wheel main body 21 that is formed of the magnet. Therefore, as shown in FIG. 1(*c*), the drive wheel device 1A may be formed by integrally molding the first wheel 10, the first axle 2, the boss portion 23, and the second flange 22 with a synthetic resin and arranging the second wheel main body 21 so that it protrudes from the second flange 22.

As shown in FIGS. 3 and 4(*b*), the follower wheel device 31 includes the second axle 32, the third wheel 40, the fourth wheel 50, and the conductive rings 60. The second axle 32 is in the shape of a round shaft having substantially the same outer diameter as the first wheel main body 11 and is formed of the magnet, for example, a neodymium magnet. The third wheel 40 includes the third wheel main body 41, the third flange 42, and a boss portion 43 and is integrally molded of a synthetic resin. An outer side face 45 of the third flange 42 slopes so that a wall thickness reduces from a center toward an outer peripheral edge. The outer side face 45 of the third flange 42 is provided with the third wheel main body 41 substantially coaxial with the third flange 42. An inner side face 46 of the third flange 42 is provided with the boss portion 43 substantially coaxial with the third flange 42. The boss portion 43 is formed substantially at a center thereof with a fitting hole 47 in which one end of the second axle 32 is to be fitted. The second axle 32 is formed of the neodymium magnet, has substantially the same outer diameter as the third wheel main body 41, and is substantially coaxial with the third wheel main body 41.

The fourth wheel 50 includes the fourth flange 52 and a boss portion 53 and is integrally molded of a synthetic resin. An outer side face 55 of the fourth flange 52 slopes so that a wall thickness reduces from a center toward an outer peripheral edge. An inner side face 56 of the fourth flange 52 is provided with the boss portion 53 substantially coaxial with the fourth flange 52. The fourth flange 52 and the boss portion 53 are formed, substantially at centers thereof, with a through hole 57 having substantially the same inner diameter as the fitting hole 47 of the third wheel 40. The second axle 32 passes through the through hole 57 and is fixed with its opposite sides protruding from the fourth flange 52 and the boss portion 53. A protruding portion 39 of the second axle 32 protruding from the fourth flange 52 side forms the fourth wheel main body 51 of the fourth wheel 50. In other words, the fourth wheel main body 51 forms the second axle 32.

The second axle 32 (fourth wheel main body 51) is mounted with the conductive ring 60, which is interposed between the third flange 42 and the fourth flange 52. The conductive ring 60 may be made of any kind of material if it is conductive material. In the embodiment, the conductive ring 60 is made of phosphor bronze. Although the conductive ring 60 is fixedly mounted to the second axle 32 (fourth wheel main body 51), it may be rotatably mounted. Although the fourth wheel main body 51 and the second axle 32 are made of the same material in the embodiment, the fourth wheel main body 51 may be made of a first conductive material with a magnetic property, the second axle 32 may be made of second conductive material having a different outer diameter from the fourth wheel main body 51, and the fourth wheel main body 51 and the second axle 32 may be provided to be adjacent to each other.

As shown in FIG. 6, a follower wheel device 65 includes an axle 66 and a pair of wheels 67 and is integrally molded of a synthetic resin. Each of the wheels 67 includes a wheel main body 68 and a flange 69. The above-described drive wheel devices 1 and the follower wheel devices 31, 65 are rotatably mounted to the carriage frames 71 of the toy vehicle 101 as shown in FIGS. 3, 6. The drive wheel devices 1 and the follower wheel devices 31, 65 are mounted into the carriage frames 71 thereby to form carriages 70.

As shown in FIGS. 2(*a*) and 2(*b*), the carriage frame 71 includes a substantially rectangular main frame 72, a middle member 73 for partitioning an inside of the main frame 72, and substantially U-shaped bearing members 75, and so forth, and is integrally molded of a synthetic resin. The main frame 72 includes a pair of longitudinal members 76, 76 in a longitudinal direction and a pair of lateral members 77, 77 in a lateral direction and provided at opposite ends of the longitudinal members 76, 76. An outer face 78 of the lateral member 77 is formed of a convex curved face in the shape of an arc having a center substantially at a center of the main frame 72.

The middle member 73 is installed to connect substantially central portions of the pair of longitudinal members 76, 76 and in positions lower than the lateral members 77, 77. As described above, the middle member 73 forms housing portions 81, 82 for housing the wheel devices 1, 31, 65 in the main frame 72. Each of the housing portions 81, 82 is provided with the pair of substantially U-shaped bearing members 75, 75. The bearing members 75 are provided to be adjacent to an inner face 79 of the lateral member 77 and an inner side face 74 of the middle member 73. The bearing members 75, 75 bear the first axle 2 and the boss portion 23 of the drive wheel device 1, the boss portions 43, 53 of the follower wheel device 31, and the axle 66 of the follower wheel device 65 so as to be rotatable.

Each of the inner faces 79, 79 of the lateral members 77, 77 of the main frame 72 is formed of guide grooves 85, 85 on opposite sides of the pair of bearing members 75, 75. In the guide grooves 85, 85, 85, 85, a shaft retaining member 90 is detachably mounted as shown in FIG. 3. The shaft retaining member 90 is formed in a substantially H shape, formed with guide protrusions 91, 91, 91, 91 to be guided by the guide grooves 85, 85, 85, 85, and formed, at its lower portion, with shaft retaining protrusions 92, 92, 92, 92. As shown in FIG. 4(*a*), the shaft retaining protrusions 92 retain the third wheel main body 41 and the fourth wheel main body 51 of the follower wheel device 31 and the wheel main bodies 68, 68 of the follower wheel device 65 from above to position the follower wheel devices 31, 65 and to prevent them from coming off the carriage frames 71.

As shown in FIG. 3, the toy vehicle main body 102 of the powered toy vehicle 101 includes the chassis 103 and a vehicle body 105 mounted to the chassis 103. Formed at each of a front portion and a rear portion of a lower face 106 of the chassis 103 is a pair of substantially L-shaped locking members 110, 110 which are facing each other and to which the carriage frame 71 can be mounted. Each of the locking members 110 is formed of a sliding contact face 111 coming in sliding contact with the outer face 78 of the lateral member 77 of the carriage frame 71 and an engaging protruding portion 113 to be engaged with a lower face 77*a* of the lateral member 77. The sliding contact face 111 is formed of a concave curved face in the shape of an arc having substantially the same curvature as the outer face 78 of the lateral member 77.

As shown in FIG. 3, a pair of drive wheel devices 1, 1 is rotatably mounted onto the bearing members 75 and the like of the carriage frame 71 so that the second wheel main bodies 21 are in opposite positions (coming in contact with different rails) thereby to form the carriage 70A on the side of the drive. As shown in FIGS. 5(*a*) and 5(*b*), if the carriage 70A on the side of the drive is positioned and rotated between the locking members 110, 110 of the chassis 103, the outer faces 78 of the lateral members 77 of the carriage frame 71 come in sliding contact with the sliding contact faces 111, 111 of the pair of locking members 110, 110, the lower faces 77*a* of the lateral members 77 are engaged with the engaging protruding portions 113, 113 of the pair of locking members 110, 110, and the carriage 70A is mounted onto the chassis 103 so as to be rotatable.

As shown in FIG. 3, a pair of follower wheel devices 31, 31 is rotatably mounted to the bearing members 75 and the like of the carriage frame 71 so that the fourth wheel main bodies 51 are in opposite positions (coming in contact with different rails) and the above-described shaft retaining member 90 is mounted to the carriage frame 71 thereby to form the follower-side carriage 70B. As shown in FIGS. 5(*a*) and 5(*b*), the follower-side carriage 70B is mounted as well similarly to the carriage 70A.

The chassis 103 is mounted with the drive motor 116 and the gear train 120 for transmitting rotation of the drive motor 116 to the gears 8, 8 of the pair of drive wheel devices 1, 1. The gear train 120 consists of a drive gear 121 mounted to a drive shaft of the drive motor 116, a crown gear 122 engaged with the drive gear 121, a small gear 123 integral with the crown gear 122, a large gear 125 engaged with the small gear 123, a small gear 126 integral with the large gear 125, a large gear 127 engaged with the small gear 126, a small gear 128 integral with the large gear 127, a large gear 129 engaged with the small gear 128, a small gear integral with the large gear 129, and a final gear 130 integral with the small gear. Cog tips of the final gear 130 are curved into spherical surfaces.

The chassis 103 is mounted with a gear box 131 in which the crown gear 122, the small gear 123, the large gear 125, the small gear 126, the large gear 127, the small gear 128, the large gear 129, the small gear integral with the large gear 129, and the final gear 130 are rotatably mounted. The final gear 130 is adapted to be placed above the pair of gears 8, 8 of the carriage 70A mounted onto the chassis 103. The chassis 103 is formed with an opening 133 for allowing the final gear 130 to protrude from the lower face of the chassis 103, and the final gear 130 protruding from the opening 133 is engaged with the gears 8, 8 of the drive wheel devices 1, 1 mounted onto the carriage 70A.

The chassis 103 is provided with the conductive contacts 141, 145 positioned above the follower wheel devices 31, 31 of the carriage 70B. Each of the conductive contacts 141, 145 is a conductive metal sheet and formed with opposite of which being formed with guide chips 142, 142 and a spring receiving protruding chip 143 is formed to protrude from an upper portion of each of the conductive contacts 141, 145. In the embodiment, the conductive contacts 141, 145 are made of phosphor bronze. The conductive contacts 141, 145 are mounted onto cylindrical guide members 151 formed on an upper portion of the chassis 103 not to be rotatable and to be movable in a vertical direction. In other words, each of the guide members 151 is formed, at opposite sides thereof, with guide grooves 152, 152 for guiding the guide chips 142, 142 of each of the conductive contacts 141, 145.

A lower portion of a spring 155 is mounted to the spring receiving protruding chip 143 of each of the conductive contacts 141, 145. The spring 155 is made of conductive metal and an upper end of the spring 155 is retained by a spring retaining chip 156. The spring retaining chip 156 is formed of a conductive metal sheet, with opposite sides of the spring retaining chip 167 being formed with guide protrusions 157, 157, and is disposed in the guide member 151 while the guide protrusions 157, 157 are guided by the guide grooves 152, 152 of the guide member 151.

As shown in FIG. 4(*b*), protrusions 159 for retaining the spring retaining chips 156 are formed to protrude inside the vehicle body 105 when the vehicle body 105 is mounted to the chassis 103. The chassis 103 is formed with openings 158 for allowing the conductive contacts 141, 145 to protrude from the lower face of the chassis 103. Lower ends of the conductive contacts 141, 145 biased downward with resilience of the springs 155 and protruding from the openings 158 come in sliding contact with the conductive rings 60, 60 of the follower wheel devices 31, 31 mounted to the carriage 70B. One of the spring retaining chips 156, 156 is electrically connected to the positive terminal of the drive motor 116 through an electric cord and the other of the spring retaining chips 156, 156 is electrically connected to the negative terminal of the drive motor 116.

As shown in FIGS. 6 and 7, a toy vehicle main body 162 of a toy passenger vehicle 161 includes a chassis 163 and a vehicle body 165 mounted to the chassis 163. Formed at each of a front portion and a rear portion of a lower face 166 of the chassis 163 is a pair of substantially L-shaped locking members 110, 110 which are facing each other and to which the carriage frames 71 can be mounted.

As shown in FIG. 6, the follower wheel devices 31, 65 are rotatably mounted to the bearing members 75 . . . of the carriage frame 71 and the above-described shaft retaining member 90 is mounted to the carriage frame 71 thereby to form the follower-side carriage 70C. As shown in FIG. 7, if the follower-side carriage 70C is positioned and rotated between the locking members 110, 110 of the chassis 103, the outer faces 78 of the lateral members 77 of the carriage frame 71 come in sliding contact with the sliding contact faces 111, 111 of the pair of locking members 110, 110, the lower faces 77*a* of the lateral members 77 are engaged with the engaging protruding portions 113, 113 of the pair of locking members 110, 110, and the carriage 70C is rotatably mounted onto the chassis 103. The follower wheel devices 31, 31 of the pair of carriages 70C, 70C are rotatably mounted to the bearing members 75, and the like, of the carriage frames 71 so that the fourth wheel main bodies 51 are in opposite positions (coming in contact with different rails)

The chassis 163 is provided with the conductive contacts 141, 145 positioned above the follower wheel devices 31 of the carriages 70C. The conductive contacts 141, 145 are mounted to cylindrical guide members 151 formed on an upper portion of the chassis 163 not to be rotatable and to be movable in a vertical direction. A spring receiving protruding chip 143 of each of the conductive contacts 141, 145 is mounted with a lower portion of a spring 155. An upper end of the spring 155 is retained by a spring retaining chip 156.

As shown in FIG. 4(*b*), there are formed so as to protrude inside the vehicle body 165, protrusions 167 for retaining the spring retaining chips 156 when the vehicle body 165 is mounted to the chassis 163. The chassis 163 is formed with openings 168 for allowing the conductive contacts 141, 145 to protrude from the lower face of the chassis 163. Lower ends of the conductive contacts 141, 145 biased downward with resilience of the springs 155 and protruding from the openings 168 come in sliding contact with the conductive rings 60, 60 of the follower wheel devices 31, 31 mounted to the carriages 70C. Between one and the other of the spring retaining chips 156, an electric component, for instance, a light emitting device such as an LED, and a sound generating device, is connected electrically.

As shown in FIGS. 8 and 9, a toy passenger vehicle 171 has basically the same structure as the toy passenger vehicle 161, but the conductive contacts 141, 145 coming in sliding contact with the conductive rings 30 of the follower wheel devices 31 are not provided, because there is no electric component, in the a toy vehicle main body 172, actuated by power fed from the rails.

Next, a rail track device according to the present invention will be described based on FIGS. 10 to 16. FIG. 10 is a perspective view of an embodiment of the rail track device according to the present invention. FIG. 11 is an exploded perspective view of FIG. 10. FIGS. 12(*a*) to 12(*d*) are explanatory views of the rail track device, wherein FIG. 12(*a*) is a plan view, FIG. 12(*b*) is a sectional view, FIG. 12(*c*) is a side view, and FIG. 12(*d*) is a bottom view. FIGS. 13(*a*) to 13(*c*) are explanatory views of the rail track device in which a state where a bottom plate is detached from the rail track device is viewed from below. FIGS. 14(*a*) and 14(*b*) are explanatory view illustrating a relationship between a rail track belt and metal rails. FIGS. 15(*a*) to 15(*e*) are explanatory views showing a method of coupling the rail track devices. FIG. 16 is a plan view showing a relationship between the metal rails and the wheel devices.

As shown in FIGS. 10 and 11, the rail track device 201 includes a rail track belt 202 made of a synthetic resin and a pair of metal rails 261, 261 to be inserted into a pair of grooves 215, 216 formed in the rail track belt 202. Each of the metal rails 261 is formed with an insertion recessed portion 272 at one end and an insertion protruding portion 281 at the other end. The rail track belt 202 is formed, at one sides of ends thereof, with mounting portions 230, 231 to which magnets 250 having conductivity are mounted. The magnets 250 mounted to the mounting portions 230, 231 are provided in such positions as to be inside the insertion recessed portions 272 of the metal rails 261 and to be in contact with the metal rails 261. The rail track belt 202 is coupled to the other rail track belt 202 in such a way that, when an insertion protruding portion 281 of the metal rail 261 of the other rail track belt 202 is inserted into the insertion recessed portion 272 of the metal rail 261, the magnet 250 attracts the insertion protruding portion 281 of the other metal rail 261 thereby to connect the metal rail 261 to the other metal rail 261.

As shown in FIGS. 11, 14(*a*), and 14(*b*), a method of manufacturing the rail track device 201 includes a first step of inserting the pair of metal rails 261 into the pair of grooves 215, 216 in the rail track belt 202 made of a synthetic resin, a second step of folding locking lugs 275, 278, 279, and 282 of the metal rails 261 to fix the metal rails 261 to the rail track belt 202, a third step of mounting the magnets 250 to the mounting portions 230, 231 formed at the one sides of the ends of the rail track belt 202, and a fourth step of mounting the bottom plate 245 to a bottom portion of the rail track belt 202.

The rail track device 201 includes the rail track belt 202 made of a synthetic resin and the pair of metal rails 261, 261. The rail track belt 202 includes an upper face plate 203, a right slope plate 205 provided to be adjacent to a right side of the upper face plate 203, a left slope plate 206 provided to be adjacent to a left side of the upper face plate 203, a right side plate 207 provided to be adjacent to a lower end of the right slope plate 205, a left side plate 208 provided to be adjacent to a lower end of the left slope plate 206, a front face plate 210 provided to be adjacent to a front end of the upper face plate 203, and a rear face plate 211 provided to be adjacent to a rear end of the upper face plate 203. The rail track belt 202 is formed to be hollow and in a trapezoidal shape when viewed from the front.

The upper face plate 203 of the rail track belt 202 is formed with protrusions 213 each in the shape of a cross tie. The upper face plate 203 is formed with the pair of grooves 215, 216 into which the pair of metal rails 261, 261 are inserted. Each of the grooves 215, 216 is formed being surrounded by side faces 218, 218 and a bottom face 219 into a substantially angular U shape. As shown in FIG. 14(*b*), the bottom faces 219 are formed, at predetermined portions thereof, with insertion holes 221, 222, 223, 224. The right groove 215 is formed with the insertion holes 221, 222, 223, 224 in this order from the front face plate 210 side and the left groove 216 is formed with the insertion holes 221, 222, 223, 224 in this order from the rear face plate 211 side.

As shown in FIG. 14(*b*), a back face 226 of the upper face plate 203 is formed with a pair of substantially rectangular magnet housing frames 230, 231. The right magnet housing frame 230 is formed along the right side plate 207 and the front face plate 210 and the left magnet housing frame 231 is formed along the left side plate 208 and the rear face plate 211. The magnet housing frame 230 is formed with insertion grooves 232, 233 into which the metal rail 261 is to be inserted. The magnet housing frame 231 is formed with insertion grooves 235, 236 into which the metal rail 261 is to be inserted. The magnet 250 is pushed mounted into each of the magnet housing frames 230, 231. The magnets 250 are formed of a material having conductivity such as neodymium magnets. As shown in FIG. 13(*c*), formed at predetermined positions of the back face 226 of the upper face plate 203 are bosses 240 each formed with an internal thread portion 241 and bosses 243 each formed with a positioning hole 242.

As shown in FIG. 11, the rail track belt 202 has the bottom plate 245 mounted to a hollow chamber surrounded with the front face plate 210, the rear face plate 211, the right side plate 207, and the left side plate 208. The bottom plate 245 is formed with fitting pins 246 to be fitted in the positioning holes 242 of the upper face plate 203 and through holes 247 facing the internal thread portions 241 of the upper face plate 203. The bottom plate 245 is mounted to the rail track belt 202 by fitting the fitting pins 246 in the positioning holes 242 of the upper face plate 203 and screwing screws 248 into the internal thread portions 241. The magnets 250 mounted to the magnet housing frames 230, 231 are prevented by the bottom plate 245 from coming off the magnet housing frames 230, 231.

Each of the metal rails 261 is formed to have substantially the same length as the rail track belt 202, has contact faces 262 to come in contact with the bottom face 219 of the groove 215 or 216, and is formed with a front insertion chip 263 to be inserted into the insertion hole 221 and the insertion grooves 232, 233 of the groove 215 or 216, a first middle insertion chip 265 to be inserted through the insertion hole 222 of the groove 215 or 216, a second middle insertion chip 266 to be inserted through the insertion hole 223 of the groove 215 or 216, and a rear insertion chip 267 to be inserted through the insertion hole 224 of the groove 215 or 216.

The front insertion chip 263 is formed with a contact chip 271 to come in contact with the bottom plate 245 and the insertion recessed portion 272. The magnets 250 mounted to the magnet housing frames 230, 231 are housed in the insertion recessed portions 272 and in contact with the insertion chips 263. The first middle insertion chip 265 is formed with a contact chip 273 to come in contact with the bottom plate 245 and the locking lug 275 to be folded and locked to the back face 226 of the upper face plate 203. The second middle insertion chip 266 is formed with a contact chip 276 to come in contact with the bottom plate 245 and the locking lugs 278, 279 to be folded and locked to the back face 226 of the upper face plate 203. The rear insertion chip 267 is formed with a contact chip 280 to come in contact with the bottom plate 245, the insertion protruding portion 281 capable of being inserted into the insertion recessed portion 272 of the front insertion chip 263, and the locking lug 282 to be folded and locked to the back face 226 of the upper face plate 203.

The pair of metal rails 261 is pushed into the grooves 215, 216 of the rail track belt 202, the rails 261 in opposite orientations to each other. The contact faces 262 come in contact with the bottom face 219, the front insertion chips 263 are inserted into the insertion holes 221 and the insertion grooves 232, 233 of the grooves 215, 216, the first middle insertion chips 265 are inserted through the insertion holes 222 of the grooves 215, 216, the second middle insertion chips 266 are inserted through the insertion holes 223 of the grooves 215, 216, and the rear insertion chips 267 are inserted through the insertion holes 224 of the grooves 215, 216. The locking lugs 275 of the first middle insertion chips 265 are folded and locked to the back face 226 of the upper face plate 203, the locking lugs 278, 279 of the second middle insertion chips 266 are folded and locked to the back face 226 of the upper face plate 203, and the locking lugs 282 of the rear insertion chips 267 are folded and locked to the back face 226 of the upper face plate 203 thereby to mount the pair of metal rails 261, 261 to the rail track belt 202.

Next, when the magnets 250, 250 are housed in the substantially rectangular magnet housing frames 230, 231, the magnet 250 housed in the right magnet housing frame 230 comes in contact with the metal rail 261 in the insertion recessed portion 272 of the right metal rail 261 and the magnet 250 housed in the left magnet housing frame 231 comes in contact with the metal rail 261 in the insertion recessed portion 272 of the left metal rail 261. The fitting pins 246 of the bottom plate 245 are fitted in the positioning holes 242 of the upper face plate 203 and the screws 248 are screwed into the internal thread portions 241 through the through holes 247 thereby to mount the bottom plate 245 to the rail track belt 202. With the bottom plate 245, the magnets 250 mounted to the magnet housing frames 230, 231 are fixed.

The insertion protruding portion 281 of the metal rail 261 mounted to the left groove 216 protrudes from the front face plate 210 and the insertion protruding portion 281 of the metal rail 261 mounted to the right groove 215 protrudes from the rear face plate 211. In the metal rail 261 mounted to the right groove 215, an insertion hole 290 is formed on the front face plate 210 side by the insertion recessed portion 272, and the bottom face 219 and the side faces 218, 218 of the groove 215. In the metal rail 261 mounted to the left groove 216, an insertion hole 290 is formed on the rear face plate 211 side by the insertion recessed portion 272, and the bottom face 219 and the side faces 218, 218 of the groove 216.

As shown in FIGS. 15(*a*) to 15(*e*), if the front face plate 210 of the rail track belt 202 of the rail track device 201 is brought in contact with the rear face plate 211 of the rail track belt 202 of the other rail track device, the insertion protruding portions 281 are inserted into the insertion holes 290 and come in contact with the magnets 250. With attracting forces of the magnets 250, the rail track devices 201 are coupled to each other. In this way, the rail track devices 201 may be coupled in a straight line or ring shape. Because the magnets 250 have conductivity, it is possible to pass an electric current throughout the metal rails 261 of the rail track devices 201 coupled in the straight line or ring shape.

It is possible to place the drive wheel devices 1, 1 and the follower wheel devices 31, 31 of the powered toy vehicle 101 on the metal rails 261, 261 of the rail track device 201. As shown in FIG. 16, the second wheel main bodies 21, 21 and the fourth wheel main bodies 51, 51 formed of the magnets alternately come in contact with the metal rails 261, 261. A positive electrode of a power source is connected to one (261A) of the metal rails 261 and a negative electrode of the power source is connected to the other (261B) of the metal rails 261.

The electric current flows from one (51A) of the fourth wheel main bodies 51 which contacts with the metal rail 261A to the metal rail 261B via the conductive ring 60, the first conductive contact 141, the spring 155, one of the spring retaining chips 156, the positive terminal of the drive motor 116, the negative terminal of the drive motor 116, the other spring retaining chip 156, the spring 155, the second conductive contact 145, the conductive ring 60, and the other (51B) of the fourth wheel main bodies 51. With this electric current, the drive motor 116 rotates, the rotation is transmitted to the gears 8, 8 via the gear train 120, and the drive wheel devices 1, 1 rotate on the metal rails 261, 261. As a result, the powered toy vehicle 101 can travel on the rail track device 201.

When the powered toy vehicle 101 is traveling on a curve, inner wheels try to rotate slowly and outer wheels try to rotate fast. Because the wheels not attracting with the magnets slip on the rails, there is less resistance of magnetic force and less load is applied on the drive motor 116 as compared with the conventional toy vehicle in which both the wheels rotate while being attracted to the magnets.

The toy passenger vehicle 161 is coupled to the powered toy vehicle 101 and the follower wheel devices 31, 31, 65, 65 of the toy passenger vehicle 161 can be placed on the metal rails 261, 261 of the rail track device 201. The positive electrode of the power source is connected to one (261A) of the metal rails 261 and the negative electrode of the power source is connected to the other (261B) of the metal rails 261.

An electric current flows from one (51C) of the fourth wheel main bodies 51 in contact with the metal rail 261A to the metal rail 261B via the conductive ring 60, the first conductive contact 141, the spring 155, one of the spring retaining chips 156, the electric components such as the light emitting device, the other spring retaining chip 156, the spring 155, the second conductive contact 145, the conductive ring 60, and the other (51D) of the fourth wheel main bodies 51. With this electric current, the electric components in the toy vehicle main body 162 are actuated.

The powered toy vehicle 101 and the toy passenger vehicles 161, 171 are extremely small and travel on the metal rails 261, 261 at an interval of about 3 mm. Although the powered toy vehicle 101 and the toy passenger vehicles 161, 171 are extremely lightweight, the second wheel main bodies 21 of the drive wheel devices 1 and the fourth wheel main bodies 51 of the follower wheel devices 31 in contact with the metal rails 261 are formed of the magnets. Therefore, the second wheel main bodies 21 and the fourth wheel main bodies 51 attract the metal rails 261 with the magnetic forces, rotation of the drive wheel devices 1 and the follower wheel devices 31 is reliably transmitted to the metal rails 261 without slips, and the vehicles travel even on an upward slope. Moreover, because the second wheel main bodies 21 of the drive wheel devices 1 and the fourth wheel main bodies 51 of the follower wheel devices 31 are attracting the metal rails 261 with the magnetic forces, the vehicles do not come off and fall from the metal rails 261.

If the insertion protruding portion 281 of the metal rail 261 of the other rail track belt 202 is inserted into the insertion recessed portion 272 of the rail track belt 202 of the rail track device 201, the insertion protruding portion 281 of the other metal rail 261 is attracted to the magnet 250 and the metal rails 261 can be connected to the other metal rails 261 with the magnets 250 interposed therebetween. In this way, it is possible to couple the other rail track belt 202. If the rail track belts 202 are pulled apart with forces greater than the magnetic forces of the magnets 250, connection between the metal rails 261 and coupling between the rail track belts 202 of the rail track devices 201 can be cancelled easily. As seen from the above, the rail track devices 201 are functional and have simplified structures, because connection of the metal rails 261 and coupling of the rail track belts 202 by the magnets 250 can be carried out simultaneously and canceling of the connection and coupling can also be carried out simultaneously. Therefore, the rail track device 201 can be reduced in size and weight in such a way that the interval between the metal rails 261, 261 is as short as about 3 mm. Moreover, because the rail track devices 201 can be reduced in size and weight, the connection and coupling can be satisfactorily carried out with the magnetic forces of the magnets 250. The method of manufacturing the rail track device 201 is extremely easy, because the metal rails 261, 261 can be fixed to the rail track belt 202 by only inserting the pair of metal rails 261, 261 into the pair of grooves 215, 216 in the rail track belt 202 and folding the locking lugs 275, 278, 279, and 282 of the metal rails 261, 261.

Other embodiments of the wheel devices for a toy vehicle according to the present invention and the toy vehicles mounted with the wheel devices will now be described based on FIGS. 17(*a*) to 33(*c*). FIGS. 17(*a*) and 17(*b*) are general views of another embodiment of the drive wheel device for a toy vehicle according to the present invention, wherein FIG. 17(*a*) is a front view and FIG. 17(*b*) is a sectional view. FIGS. 18(*a*) to 20(*b*) are general views of the other embodiments of the follower wheel device for a toy vehicle according to the present invention, wherein FIGS. 18(*a*), 19(*a*), 20(*a*) are front views and FIGS. 18(*b*), 19(*b*), 20(*b*) are sectional views. FIGS. 21(*a*) and 21(*b*) are exploded perspective views of the drive wheel devices for a toy vehicle according to the present invention mounted into a carriage, wherein FIG. 21(*a*) is a perspective view from above and FIG. 21(*b*) is a perspective view from below. FIGS. 22(*a*) to 24(*b*) are exploded perspective views of the follower wheel devices for a toy vehicle according to the present invention mounted into carriages, wherein FIGS. 22(*a*), 23(*a*), 24(*a*) are perspective views from above and FIGS. 22(*b*), 23(*b*), 24(*b*) are perspective views from below. FIG. 25 is an exploded perspective view of the drive wheel devices and the follower wheel devices for a toy vehicle according to the present invention mounted into a toy vehicle. FIGS. 26(*a*) and 26(*b*) are sectional views of the wheel devices for a toy vehicle according to the present invention mounted into a toy vehicle, wherein FIG. 26(*a*) is a sectional view of an essential part when the drive wheel devices are mounted and FIG. 26(*b*) is a sectional view of an essential part when the follower wheel devices are mounted. FIGS. 27(*a*) and 27(*b*) are assembly drawings of FIG. 25, wherein FIG. 27(*a*) is a perspective view from above and FIG. 27(*b*) is a perspective view from below. FIG. 28 is an exploded perspective view of other follower wheel devices for a toy vehicle according to the present invention mounted into a toy vehicle. FIGS. 29(*a*) and 29(*b*) are assembly drawings of FIG. 28, wherein FIG. 29(*a*) is a perspective view from above and FIG. 29(*b*) is a perspective view from below. FIG. 30 is an exploded perspective view of other follower wheel devices for a toy vehicle according to the present invention mounted into a toy vehicle. FIGS. 31(*a*) and 31(*b*) are assembly drawings of FIG. 30, wherein FIG. 31(*a*) is a perspective view from above and FIG. 31(*b*) is a perspective view from below. FIGS. 32(*a*) and 32(*b*) are perspective views of a coupler. FIGS. 33(*a*) to 33(*c*) are explanatory views of the toy vehicles coupled by the couplers.

As shown in FIGS. 17(*a*), 17(*b*), 19(*a*), 19(*b*), the wheel device 301, 301A for a toy vehicle is adapted to be placed on a pair of rails 561, 561 and includes a first axle 302, and a first wheel 310 and a second wheel 320, 320A provided on opposite sides of the first axle 302. The first wheel 310 includes a first wheel main body 311 rolling on one of the rails 561, and a first flange 312 guided by the one rail 561 and the first wheel main body 311 and the first flange 312 are made of a synthetic resin. The second wheel 320, 320A includes a second wheel main body 321 rolling on the other rail 561 and a second flange 322 guided by the other rail 561 and at least the second wheel main body 321 is formed of a member attracting with a magnetic force.

The second wheel main body 321 may be formed of a magnet as shown in FIGS. 41(*a*) and 41(*b*). Preferably, the second wheel main body 321 includes a magnet 328 and a rolling shaft 330 mounted with the magnet 328 therein and formed in the shape of a round shaft. This is because directly forming a bearing portion is difficult on the magnet 328 but is easy on the rolling shaft 330 covering the magnet 328. Moreover, the rolling shaft 330 is preferably made of ferromagnetic material. Although the rolling shaft 330 attracts the rail 561 with the magnet 328 mounted therein, the attracting force increases if the rolling shaft 330 is made of ferromagnetic material.

The first wheel main body 311, the first flange 312, the first axle 302, and the second flange 322 of the wheel device 301, 301A of the toy vehicle may be made of a synthetic resin. The wheel device 301 of the toy vehicle may be formed with a gear 308.

As shown in FIGS. 25 and 30, a toy vehicle main body 402, of a toy vehicle 401, 471 has a chassis 403, 473 and carriage frames 371, 371 mounted to front and rear portions of the chassis 403, 473. The carriage frame 371 is provided with a pair of wheel devices 301, 301A for a toy vehicle. The pair of wheel devices 301, 301A is rotatably mounted onto the carriage frame(s) 371, 371 so that the second wheel main bodies 321 formed of the members attracting with the magnetic forces come in contact with different rails 561.

As shown in FIGS. 18(*a*) and 18(*b*), a wheel device 331 for a toy vehicle is adapted to be placed on a pair of rails 561 and includes a second axle 332, and a third wheel 340 and a fourth wheel 350 provided on opposite sides of the second axle 332. The third wheel 340 includes a third wheel main body 341 rolling on one of the rails 561 and a third flange 342 guided by the one rail 561 and the third wheel main body 341 and the third flange 342 are made of a synthetic resin. The fourth wheel 350 includes a fourth wheel main body 351 rolling on the other rail 561 and a fourth flange 352 guided by the other rail 561. The fourth wheel main body 351 includes the second axle 332 and is formed of a member attracting with a magnetic force.

The fourth wheel main body 351 may be formed of a magnet as shown in FIGS. 42(*a*) and 41(*b*). Preferably, the fourth wheel main body 351 includes a magnet 328A and a rolling shaft 330A having the magnet 328A mounted therein and made of ferromagnetic material in the shape of a round shaft. This is because directly forming a bearing portion is difficult on the magnet 328A but is easy on the rolling shaft 330A covering the magnet 328A. Moreover, the attracting force increases if the rolling shaft 330A is made of the ferromagnetic material.

The third wheel main body 341, the third flange 342, the fourth flange 352 of the wheel device 331 of the toy vehicle may be made of a synthetic resin. The wheel device 331 of the toy vehicle is installed by a conductive ring 360 electrically conductive with the second axle 332 between the third wheel 340 and the fourth wheel 350.

As shown in FIG. 28, a toy vehicle main body 462 of a toy vehicle 461 has a chassis 463 and carriage frames 371 mounted to front and rear portions of the chassis 463. The carriage frames 371 are provided with a pair of wheel devices 331 of the toy vehicle. The pair of wheel devices 331 is rotatably mounted onto the carriage frames 371 so that the fourth wheel main bodies 351 formed of the members attracting with the magnetic forces come in contact with different rails 561.

As shown in FIG. 25, a toy vehicle main body 402 of a toy vehicle 401 has a chassis 403 and carriage frames 371, 371 mounted to front and rear portions of the chassis 403. The carriage frame 371 mounted to one of the front and rear portions is provided with the pair of wheel devices 301 of the toy vehicle. The carriage frame 371 mounted to the other of the front and rear portions is provided with the pair of wheel devices 331 of the toy vehicle. The chassis 403 is mounted with a drive motor 416 and a gear train 420 for transmitting rotation of the drive motor 416 to the gears 308 of the pair of wheel devices 301 of the toy vehicle. The chassis 403 is mounted with a first conductive contact 441 coming in sliding contact with one of the conductive rings 360 of the pair of wheel devices 331 for a toy vehicle and a second conductive contact 445 coming in sliding contact with the other conductive ring 360. The first conductive contact 441 is electrically connected to one of a positive terminal and a negative terminal of the drive motor 416 and the second conductive contact 445 is electrically connected to the other of the positive terminal and the negative terminal of the drive motor 416.

The second wheel main bodies 321 of the pair of wheel devices 301 of the toy vehicle and formed of the members attracting with the magnetic forces and the fourth wheel main bodies 351 of the pair of wheel devices 331 of the toy vehicle and formed of the members attracting with the magnetic forces are arranged to alternately come in contact with different rails 561.

As shown in FIG. 25, the toy vehicle main body 402 of the toy vehicle 401 has the chassis 403 and the carriage frames 371 mounted to the front and rear portions of the chassis 403. The carriage frame 371 mounted to the front or rear portion is provided with the pair of wheel devices 331 of the toy vehicle. The chassis 403 is mounted with an electric component 416. The chassis 403 is provided with the first conductive contact 441 coming in sliding contact with one of the conductive rings 360 of the pair of wheel devices 331 for a toy vehicle and the second conductive contact 445 coming in sliding contact with the other conductive ring 360. The first conductive contact 441 is electrically connected to one of a positive terminal and a negative terminal of the electric component 416 and the second conductive contact 445 is electrically connected to the other of the positive terminal and the negative terminal of the electric component 416.

As shown in FIG. 28, the toy vehicle main body 462 of the toy vehicle 461 has the chassis 463 and the carriage frames 371, 371 mounted to the front and rear portions of the chassis 463. The carriage frames 371 mounted to the front and rear portions are provided with the wheel devices 331 of the toy vehicle. The chassis 463 is provided with an electric component 446. The chassis 463 is provided with a third conductive contact 441 coming in sliding contact with the conductive ring 360 of the front wheel device 331 for a toy vehicle and a fourth conductive contact 445 coming in sliding contact with the conductive ring 360 of the rear wheel device 331 of the toy vehicle. The third conductive contact 441 is electrically connected to one of a positive terminal and a negative terminal of the electric component 446 and the fourth conductive contact 445 is electrically connected to the other of the positive terminal and the negative terminal of the electric component 446.

The drive wheel devices, the follower wheel devices, and the toy vehicles mounted with them will be described in further detail. As shown in FIGS. 17(*a*), 17(*b*), 21(*a*), 21(*b*), the drive wheel device 301 includes the first axle 302, the first wheel 310, and the second wheel 320. The first axle 302 is made of a synthetic resin and formed into a cylindrical shape. One side face 303 of the first axle 302 is formed with a first round shaft recessed portion 305 coaxial with the first axle 302. The other side face 306 of the first axle 302 is formed with a second round shaft recessed portion 307 coaxial with the first axle 302 and having a larger diameter than the first round shaft recessed portion 305. A peripheral face of the first axle 302 is integrally formed with the gear 308. Cog tips of the gear 308 are curved to form spherical surfaces.

The first wheel 310 includes the first wheel main body 311, the first flange 312, and a fitting shaft 313 and is integrally molded of a synthetic resin. An outer side face 315 of the first flange 312 slopes so that a wall thickness reduces from a center toward an outer peripheral edge. The outer side face 315 of the first flange 312 is provided with the first wheel main body 311 substantially coaxial with the first flange 312. An inner side face 316 of the first flange 312 is provided with the fitting shaft 313 substantially coaxial with the first flange 312. A tip end face 318 of the first wheel main body 311 is formed with a substantially conical support recessed portion 314 substantially coaxial with the first wheel main body 311. In the fitting shaft 313, the first wheel 310 is fitted and fixed into the first round shaft recessed portion 305 of the first axle 302.

The second wheel 320 includes the second wheel main body 321, the second flange 322, and a boss portion 323. The second wheel main body 321 includes the magnet 328 and the rolling shaft 330 mounted with the magnet 328 therein and formed in the shape of the round shaft. The rolling shaft 330 is preferably made of a ferromagnetic material such as iron and formed in the shape of the round shaft having substantially the same outer diameter as the first wheel main body 311. The rolling shaft 330 is formed therein with a housing recessed portion 333 coaxial with the rolling shaft 330. Substantially at a center of one end face 335 of the rolling shaft 330 in an axial direction, a support hole 334 is formed. The other end face 336 of the rolling shaft 330 in the axial direction is formed with an opening 337 communicating with the housing recessed portion 333. In the housing recessed portion 333 of the rolling shaft 330, the magnet 328 in the shape of a round shaft is housed through the opening 337. The magnet 328 is formed of a neodymium magnet, for example. An outer side face 325 of the second flange 322 slopes so that a wall thickness reduces from a center toward an outer peripheral edge. An inner side face 326 of the second flange 322 is provided with the boss portion 323 substantially coaxial with the second flange 322 and having substantially the same outer diameter as the first axle 302. The second flange 322 and the boss portion 323 are integrally molded of a synthetic resin.

The second flange 322 and the boss portion 323 are formed, substantially at centers thereof, with a through hole 327 having substantially the same inner diameter as the second round shaft recessed portion 307 of the first axle 302. The second wheel main body 321 has substantially the same outer diameter as the first wheel main body 311, passes through the through hole 327, and is fixed with its opposite sides protruding from the second flange 322 and the boss portion 323. The other end face 336 side of the rolling shaft 330 of the second wheel 320 protrudes from the boss portion 323 side and one end face 335 side of the rolling shaft 330 protrudes from the second flange 322 side. The second wheel 320 is fixed with a protruding portion 329 of the rolling shaft 330 (second wheel main body 321) protruding from the boss portion 323 side being fitted in the second round shaft recessed portion 307 of the first axle 302. The gear 308 is in a substantially middle position between the first flange 312 and the second flange 322. As described above, the drive wheel device 301 is made of a synthetic resin excluding the second wheel main body 321 that is formed of the member attracting with the magnetic force. Alternatively, as shown in FIG. 41, the second wheel main body 321 may be formed of a magnet in the shape of a round shaft and a tip end face 324*a* may be formed with a substantially conical support recessed portion 324 substantially coaxial with the second wheel main body 321.

As shown in FIGS. 19(*a*), 19(*b*), 24(*a*), and 24(*b*), the wheel device (follower wheel device) 301A has a structure where the first axle 302, the first wheel 310, the second flange 322, and the boss portion 323 are integrally molded of a synthetic resin, and the second wheel main body 321 is fitted into a round shaft recessed portion 307A formed in a side face of the second flange 322. The second flange 322 and the second wheel main body 321 form the second wheel 320A. As described above, the first wheel 310 has the first wheel main body 311 and the first flange 312, and a tip end face 318 of the first wheel main body 311 is formed with a support recessed portion 314. The second wheel 320A has the second wheel main body 321 and the second flange 322, the magnet 328 is provided in the second wheel main body 321, and a support hole 334 is formed in one end face 335 of a rolling shaft 330 formed in the shape of a round shaft. Although the second wheel main bodies 321 of the drive wheel device 301 and the wheel device (follower wheel device) 301A are made of ferromagnetic material such as iron, it is essential only that they be the members attracting the metal rails 261 with the magnetic forces. Therefore, the rolling shaft 330 may be made of a synthetic resin material.

As shown in FIGS. 18(*a*), 18(*b*), 22(*a*), and 22(*b*), the follower wheel device 331 includes the second axle 332, the third wheel 340, the fourth wheel 350, and the conductive ring 360. The second axle 332 is in the shape of a round shaft having substantially the same outer diameter as the first wheel main body 311 and includes the magnet 328A and a rolling shaft 330A mounted with the magnet 328A therein and formed in the shape of a round shaft. The rolling shaft 330A is made of ferromagnetic material such as iron and formed in the shape of the round shaft having substantially the same outer diameter as the first wheel main body 311. The rolling shaft 330A is formed therein with a housing recessed portion 333A coaxial with the rolling shaft 330A. Substantially at a center of one end face 335A of the rolling shaft 330A in an axial direction, a support hole 334A is formed. The other end face 336A of the rolling shaft 330A in the axial direction is formed with an opening 337A communicating with the housing recessed portion 333A. In the housing recessed portion 333A of the rolling shaft 330A, the magnet 328A in the shape of the round shaft is housed through the opening 337A. The magnet 328A is formed of a neodymium magnet, for example.

The third wheel 340 includes the third wheel main body 341, the third flange 342, and a boss portion 343 and is integrally molded of a synthetic resin. An outer side face 345 of the third flange 342 slopes so that a wall thickness reduces from a center toward an outer peripheral edge. The outer side face 345 of the third flange 342 is attached to the third wheel main body 341 substantially coaxial with the third flange 342. An inner side face 346 of the third flange 342 is provided with the boss portion 343 substantially coaxial with the third flange 342. The boss portion 343 is formed, substantially at a center thereof, with a fitting hole 347 in which the other end face 336A side of the second axle 332 is fitted. A tip end face 348 of the third wheel main body 341 is formed with a substantially conical support recessed portion 344 substantially coaxial with the third wheel main body 341. The second axle 332 has substantially the same outer diameter as the third wheel main body 341 and is substantially coaxial with the third wheel main body 341.

The fourth wheel 350 includes the fourth flange 352 and a boss portion 353, and the fourth flange 352 and the boss portion 353 are integrally molded of a synthetic resin. An outer side face 355 of the fourth flange 352 slopes so that a wall thickness reduces from a center toward an outer peripheral edge. An inner side face 356 of the fourth flange 352 is provided with the boss portion 353 substantially coaxial with the fourth flange 352. The fourth flange 352 and the boss portion 353 are formed, substantially at centers thereof, with a through hole 357 having substantially the same inner diameter as the fitting hole 347 of the third wheel 340. The second axle 332 passes through the through hole 357 and is fixed with its opposite sides protruding from the fourth flange 352 and the boss portion 353. The one end face 335A of the second axle 332 protrudes from the fourth flange 352 side and a protruding portion 329 of the second axle 332 forms the fourth wheel main body 351 of the fourth wheel 350. In other words, the fourth wheel main body 351 constitutes the second axle 332. The fourth wheel main body 351, the fourth flange 352, and the boss portion 353 form the fourth wheel 350.

Between the third wheel 340 (boss portion 343) and the fourth wheel 350 (boss portion 353) of the second axle 332 (fourth wheel main body 351), the conductive ring 360 conductive with the second axle 332 (fourth wheel main body 351) is mounted. The conductive ring 360 may be made of any kind of material, if it is made of a conductive material. In the embodiment, the conductive ring 360 is made of phosphor bronze. Although the conductive ring 360 is fixedly mounted to the second axle 332 (fourth wheel main body 351), it may be mounted rotatably. Although the fourth wheel main body 351 and the second axle 332 are made of the same material in the embodiment, the fourth wheel main body 351 may be made of a first conductive material with a magnetic property, the second axle 332 may be made of second conductive material to have a different outer diameter from the fourth wheel main body 351, and the fourth wheel main body 351 and the second axle 332 may be provided to be adjacent to each other. Alternatively, as shown in FIG. 42, the second axle 332 (fourth wheel main body 351) may be formed of a magnet in the shape of a round shaft and a tip end face 354*a* may be formed with a substantially conical support recessed portion 354 substantially coaxial with the fourth wheel main body 351.

As shown in FIGS. 20(*a*), 20(*b*), 23(*a*), and 23(*b*), a follower wheel device 365 includes an axle 366 and a pair of wheels 367 and is integrally molded of a synthetic resin. Each of the wheels 367 includes a wheel main body 368 and a flange 369. A tip end face of the wheel main body 368 is formed, substantially at a center thereof, with a substantially conical support recessed portion 364. The above-described drive wheel devices 301 and the follower wheel devices 301A, 331, 365 are rotatably mounted to the carriage frames 371 for a toy vehicle as shown in FIGS. 21(*a*) to 24(*b*). The drive wheel devices 301 and the follower wheel devices 301A, 331, 365 are mounted into the carriage frames 371 thereby to form carriages.

As shown in FIGS. 21(*a*) and 21(*b*), the carriage frame 371 is configured by a substantially rectangular main frame 372, a middle member 373 for partitioning an inside of the main frame 372, support protruding portions 384, support shafts 385, and locking lugs 393, and the like, and is integrally molded of a synthetic resin. The main frame 372 is configured by a pair of longitudinal members 376, 376 in a longitudinal direction and a pair of lateral members 377, 377 in a lateral direction and provided at opposite ends of the longitudinal members 376, 376. An outer face 378 of the lateral member 377 is formed of a convex curved face in the shape of an arc having a center substantially at a center of the main frame 372. The outer face 378 of one of the lateral members 377 is formed, substantially at a center thereof, with a coupling hole 378A.

The middle member 373 is provided to connect substantially central portions of the pair of longitudinal members 376, 376 and is mounted to lower faces 376A, 376A of the longitudinal members 376, 376 to be in positions lower than the lateral members 377, 377. The middle member 373 forms housing portions 381, 382 for housing the wheel devices 301, 301A, 331, 365 in the main frame 372. The housing portions 381, 382 are provided with the support protruding portions 384 and the support shafts 385 facing each other. Each of the support protruding portions 384 is formed in a substantially conical shape and is fitted in the above-described support recessed portion 314 of the first wheel main body 311, support recessed portion 344 of the third wheel main body 341, or support recessed portion 364 of the wheel main body 368 so as to be rotatable. Each of the support shafts 385 is rotatably fitted in the above-described support hole 334 of the rolling shaft 330 or the support hole 334A of the rolling shaft 330A. The wheel devices 301, 301A, 331, 365 have their support recessed portions 314, 344, 364, rotatably supported by the support protruding portions 384 and their support holes 334, 334A rotatably supported by the support shafts 385. Because the support protruding portions 384 are formed to be larger than the support shafts 385 and cannot be inserted into the support holes 334, which facilitates positioning of the wheel devices 301, 301A, 331, 365 and prevents mounting to the carriage frames 371 in a wrong way. In the housing portion 381, the support protruding portion 384 is formed at a support chip 386 formed on the lower face 376A of one of the longitudinal members 376. Similarly, in the housing portion 381, the support shaft 385 is formed at a support chip 387 formed on the lower face 376A of the other longitudinal member 376. In the housing portion 382, the support protruding portion 384 is formed at a support chip 386 formed on the lower face 376A of the other longitudinal member 376. Similarly, in the housing portion 382, the support shaft 385 is formed at a support chip 387 formed on the lower face 376A of the one longitudinal member 376. Upper faces 377B, 377B of the lateral members 377, 377 are formed, substantially at centers thereof, with locking lugs 393, 393. Upper faces 376B, 376B of the longitudinal members 376, 376 are formed, substantially at centers thereof, with guide protrusions 395, 395.

As shown in FIG. 25, the toy vehicle main body 402 for the powered toy vehicle 401 includes the chassis 403 and a vehicle body 405 mounted to the chassis 403. Formed at each of a front portion and a rear portion of the chassis 403 is a pair of curved locking grooves 410, 410 which are facing each other and to which the carriage frame 371 can be mounted. The carriage frame 371 is mounted with the pair of drive wheel devices 301, 301 which are rotatable so that the second wheel main bodies 321 are in opposite positions (coming in contact with different rails) as described above. The carriage frame 371 and the pair of drive wheel devices 301, 301 constitute the drive-side carriage 370A.

As shown in FIG. 25, the drive-side carriage 370A is mounted to the chassis 403 by locking the locking lugs 393, 393 of the carriage frame 371 to the locking grooves 410, 410. When the carriage frame 371 is mounted to the chassis 403, the guide protrusions 395, 395 protrude into guide grooves 408, 408 formed in the chassis 403 and the guide protrusions 395, 395 can rotate within areas in which they are guided by the guide grooves 408, 408.

As shown in FIG. 25, the pair of follower wheel devices 331, 331 is rotatably mounted to the carriage frame 371 so that the fourth wheel main bodies 351 are in opposite positions (coming in contact with different rails). The carriage frame 371 and the pair of follower wheel devices 331, 331 constitute the follower-side carriage 370B. The follower-side carriage 370B is mounted similarly to the carriage 370A.

The chassis 403 is provided with the drive motor 416 and the gear train 420 for transmitting rotation of the drive motor 416 to the gears 308, 308 of the pair of drive wheel devices 301, 301. The gear train 420 consists of a drive gear 421 mounted to a drive shaft of the drive motor 416, a crown gear 422 engaged with the drive gear 421, a small gear integral with the crown gear 422, a large gear 425 engaged with the small gear integral with the crown gear 422, a small gear 426 integral with the large gear 425, a large gear 427 engaged with the small gear 426, a small gear integral with the large gear 427, a large gear 429 engaged with the small gear integral with the large gear 427, a small gear 428 integral with the large gear 429, and a final gear 430 integral with the small gear 428. Cog tips of the final gear 430 are curved into spherical surfaces.

The chassis 403 is mounted with a gear box 431 in which the crown gear 422, the small gear integral with the crown gear 422, the large gear 425, the small gear 426, the large gear 427, the small gear integral with the large gear 427, the large gear 429, the small gear 428, and the final gear 430 are rotatably mounted. The final gear 430 is adapted to be placed above the pair of gears 308, 308 of the carriage 370A mounted to the chassis 403. The chassis 403 is formed with an opening 433 for allowing the final gear 430 to protrude from the lower face of the chassis 403 and the final gear 430 protruding from the opening 433 is engaged with the gears 308, 308 of the drive wheel devices 301, 301 mounted to the carriage 370A.

The chassis 403 is provided with the conductive contacts 441, 445 positioned above the follower wheel devices 331, 331 of the carriage 370B. The conductive contacts 441, 445 are spring members made of conductive metal. The conductive contacts 441, 445 are mounted in cylindrical guide members 451, 451 formed on an upper portion of the chassis 403. Upper ends of the conductive contacts 441, 445 come in contact with contact terminals 455, 456. The contact terminals 455, 456 are formed of conductive metal sheets.

As shown in FIG. 26(*b*), formed to protrude inside the vehicle body 405 are protrusions 459, 459 to be inserted into through holes 457, 458 formed in the contact terminals 455, 456 to fix the contact terminals 455, 456 when the vehicle body 405 is mounted to the chassis 403. The chassis 403 is formed with openings 454 for allowing the conductive contacts 441, 445 to protrude from the lower face of the chassis 403. Lower ends of the conductive contacts 441, 445 protrude from the openings 454 and come in sliding contact with the conductive rings 360, 360 of the follower wheel devices 331, 331 mounted to the carriage 370B. One of the contact terminals 455, 456 is electrically connected to the positive terminal of the drive motor 416 and the other of the contact terminals 455, 456 is electrically connected to the negative terminal of the drive motor 416.

As shown in FIGS. 28, 29(*a*), and 29(*b*), the toy vehicle main body 462 of the toy passenger vehicle 461 includes the chassis 463 and a vehicle body 465 mounted to the chassis 463. Formed at each of a front portion and a rear portion of the chassis 463 is a pair of curved locking members 410, 410 which are facing each other and to which the carriage frame 371 can be mounted.

As shown in FIG. 28, the follower wheel devices 331, 365 are rotatably mounted to the carriage frame 371 to form the follower-side carriage 370C. The follower-side carriage 370C is mounted to the chassis 403 by locking the locking lugs 393, 393 of the carriage frame 371 in the locking grooves 410, 410. When the carriage frame 371 is mounted to the chassis 463, guide protrusions 395, 395 protrude into guide grooves 408, 408 formed in the chassis 463 and the guide protrusions 395, 395 are rotatable within areas in which they are guided by the guide grooves 408, 408. The follower wheel device 331 of one of the pair of carriages 370C, 370C and the follower wheel device 331 of the other are rotatably mounted to the carriage frames 371 so that the fourth wheel main bodies 351 are in opposite positions (coming in contact with different rails).

The chassis 463 is provided with the conductive contacts 441, 445 positioned above the follower wheel devices 331 of the carriages 370C. The conductive contacts 441, 445 are mounted in cylindrical guide members 451 formed on an upper portion of the chassis 463. One of the conductive contacts 441, 445 is electrically connected to a positive terminal of an electronic substrate 466 provided in the vehicle body 465 and the other of the conductive contacts 441, 445 is electrically connected to a negative terminal of the electronic substrate 466.

The chassis 463 is formed with openings for allowing lower ends of the conductive contacts 441, 445 to protrude from the lower face of the chassis 463. The lower ends of the conductive contacts 441, 445 protruding through the openings come in sliding contact with the conductive rings 360, 360 of the follower wheel devices 331, 331 mounted to the carriages 370C. The electronic substrate 466 is provided with electric components, for example, a light emitting device such as an LED and a sound generating device.

As shown in FIGS. 30, 31(*a*), and 31(*b*), a toy passenger vehicle 471 has basically the same structure as the toy passenger vehicle 461, but a chassis 473 is not formed with the guide members 451, 451, because there is no electric component, in a toy vehicle main body 472, actuated by power fed from the rails. Therefore, the follower wheel devices 301A, 365 are rotatably mounted to the carriage frame 371 thereby to form a follower-side carriage 370D. The follower-side carriage 370D is mounted to the chassis 473 by locking locking lugs 393, 393 of the carriage frame 371 in the locking grooves 410, 410. When the carriage frame 371 is mounted to the chassis 473, guide protrusions 395, 395 protrude into guide grooves 408, 408 formed in the chassis 473 and the guide protrusions 395, 395 can rotate within areas in which they are guided by the guide grooves 408, 408. The follower wheel device 301A of one of the pair of carriages 370D, 370D and the follower wheel device 301A of the other are rotatably mounted to the carriage frames 371 so that the second wheels 320A are in opposite positions (coming in contact with different rails).

The powered toy vehicle 401 and the toy passenger vehicles 461, 471 are coupled by a coupler 481. As shown in FIGS. 32(*a*), 32 (*b*), the coupler 481 is integrally formed of a synthetic resin and includes a coupling shaft 482 and a design member 483 formed substantially at a center of the coupling shaft 482. As shown in FIGS. 33(*a*) to 33(*c*), the coupling shaft 482 couples the powered toy vehicle 401 and the toy passenger vehicle 461 by detachably inserting one end 484 of the coupling shaft 482 into the coupling hole 378A of the carriage 370B disposed at the rear portion of the powered toy vehicle 401 and detachably inserting the other end 485 of the coupling shaft 482 into the coupling hole 378A of the carriage 370C disposed at the front portion of the toy passenger vehicle 461. The coupling shaft 482 couples the toy passenger vehicle 461 and the toy passenger vehicle 471 by detachably inserting one end 484 of the coupling shaft 482 into the coupling hole 378A of the carriage 370C disposed at the rear portion of the toy passenger vehicle 461 and detachably inserting the other end 485 of the coupling shaft 482 into the coupling hole 378A of the carriage 370D disposed at the front portion of the toy passenger vehicle 471. In this way, it is possible to couple the respective toy vehicles.

Next, a rail track device according to the present invention will be described based on FIGS. 34 to 40(*b*). FIG. 34 is a perspective view of another embodiment of the rail track device according to the present invention. FIG. 35 is an exploded perspective view of FIG. 34. FIGS. 36(*a*) and 36(*b*) are explanatory views of the rail track device, wherein FIG. 36(*a*) is a plan view and FIG. 36(*b*) is a side view. FIGS. 37(*a*) to 37(*c*) are explanatory views of the rail track device, wherein FIG. 37(*a*) is a sectional view, FIG. 37(*b*) is a bottom view, and FIG. 37(*c*) is a side sectional view. FIGS. 38(*a*) to 38(*c*) are explanatory views of the rail track device from which a bottom plate is detached and which is viewed from below. FIG. 39 is an explanatory view illustrating a relationship between a rail track belt and metal rails. FIGS. 40(*a*) and 40(*b*) are explanatory views of the metal rail.

As shown in FIGS. 34 and 35, the rail track device 501 includes a rail track belt 502 made of a synthetic resin and a pair of metal rails 561, 561 to be inserted into a pair of grooves 515, 516 formed in the rail track belt 502. Each of the metal rails 561 is formed with an insertion recessed portion 572 at one end and an insertion protruding portion 581 at the other end. The rail track belt 502 is formed at one sides of ends thereof with mounting portions 530, 531 to which magnets 550 having conductivity are mounted. The magnets 550 mounted to the mounting portions 530, 531 are structured to be located in such positions as to be in contact with the metal rails 561. The rail track belt 502 is structured to be connected to the other rail track belt 502 in such a way that, when an insertion protruding portion 581 of the metal rail 561 of the other rail track belt 502 is inserted into the insertion recessed portion 572 of the metal rail 561, the other metal rail 561 come in contact with and is attracted by the magnet 550 thereby to connect the metal rail 561 to the other metal rail 561.

As shown in FIG. 39, a method of manufacturing the rail track device 501 includes a first step of inserting the pair of metal rails 561, 561 into the pair of grooves 515, 516 in the rail track belt 502 made of a synthetic resin, inserting insertion chips 563, 565, 566, 567 of the pair of metal rails 561, 561 into the insertion holes 521, 522, 523, 524 in the rail track belt 502, and locking locking lugs 571, 574, 575, 576, 578, 579 of the insertion chips 563, 565, 566, 567 to the insertion holes 521, 522, 523, 524 to fix the pair of metal rails 561, 561 to the rail track belt 502, a second step of mounting the magnets 550 to the mounting portions 530, 531 formed at the one sides of the ends of the rail track belt 502, and a third step of mounting the bottom plate 545 to a bottom portion of the rail track belt 502.

As shown in FIGS. 34 and 35, the rail track device 501 includes the rail track belt 502 made of a synthetic resin and the pair of metal rails 561, 561. The rail track belt 502 is configured by an upper face plate 503, a right slope plate 505 arranged to be connected to a right side of the upper face plate 503, a left slope plate 506 provided to be adjacent to a left side of the upper face plate 503, a right side plate 507 provided to be adjacent to a lower end of the right slope plate 505, a left side plate 508 provided to be adjacent to a lower end of the left slope plate 506, a front face plate 510 provided to be adjacent to a front end of the upper face plate 503, and a rear face plate 511 provided to be adjacent to a rear end of the upper face plate 503. The rail track belt 502 is formed to be hollow and in a trapezoidal shape when viewed from the front.

The upper face plate 503 of the rail track belt 502 is formed with protrusions 513 in the shape of a cross tie. The upper face plate 503 is formed with the pair of grooves 515, 516 into which the pair of metal rails 561, 561 is inserted. Each of the grooves 515, 516 is formed being surrounded by side faces 518, 518 and a bottom face 519 into a substantially angular U shape. As shown in FIG. 39, the bottom faces 519 are formed, at predetermine portions thereof, with the insertion holes 521, 522, 523, 524. The right groove 515 is formed with the insertion holes 521, 522, 523, 524 in this order from the front face plate 510 side and the left groove 516 is formed with the insertion holes 521, 522, 523, 524 in this order from the rear face plate 511 side.

As shown in FIG. 39, a back face 526 of the upper face plate 503 is formed with the pair of substantially L-shaped magnet housing frames 530, 531. The right magnet housing frame 530 is formed along the right side plate 507 and the front face plate 510 and the left magnet housing frame 531 is formed along the left side plate 508 and the rear face plate 511. The magnet housing frame 530 is formed with an insertion groove 532 into which the metal rail 561 is to be inserted. The magnet housing frame 531 is formed with an insertion groove 535 into which the metal rail 561 is to be inserted. The magnet 550 is pushed and mounted into each of the magnet housing frames 530, 531. The magnets 550 are formed of material having conductivity such as neodymium magnets. Formed at opposite two positions of the back face 526 of the upper face plate 503 are bosses 540 each formed with an internal thread portion 541. Moreover, formed at three positions of the back face 526 of the upper face plate 503 are bosses 543 each formed with a positioning hole 542.

As shown in FIG. 35, the rail track belt 502 has the bottom plate 545 mounted to a hollow chamber surrounded with the front face plate 510, the rear face plate 511, the right side plate 507, and the left side plate 508. The bottom plate 545 is formed, substantially at a center thereof, with a recessed step portion 545*a*. The bottom plate 545 is formed, at opposite sides, with fitting pins 546 to be fitted in the positioning holes 542 of the upper face plate 503. A fitting hole 545*b* in which the boss 543 is to be fitted is formed at the recessed step portion 545*a*. The bottom plate 545 is formed with through holes 547 facing the internal thread portions 541 of the upper face plate 503. The bottom plate 545 is mounted to the rail track belt 502 by fitting the fitting pins 546 in the positioning holes 542 of the upper face plate 503, fitting the boss 543 in the fitting hole 545*b*, and screwing screws 248 into the internal thread portions 541 through the through holes 547. The magnets 550 mounted to the magnet housing frames 530, 531 are prevented by the bottom plate 545 from coming off the magnet housing frames 530, 531.

Each of the metal rails 561 is formed to have substantially the same length as the rail track belt 502, has contact faces to come in contact with the bottom face 519 of the groove 515 or 516, and is formed with a front insertion chip 563 to be inserted into the insertion hole 521 and the insertion groove 532 of the groove 515 or 516, a first middle insertion chip 565 to be inserted through the insertion hole 522 of the groove 515 or 516, a second middle insertion chip 566 to be inserted through the insertion hole 523 of the groove 515 or 516, and a rear insertion chip 567 to be inserted through the insertion hole of the groove 515 or 516.

As shown in FIGS. 38(*a*) to 38(*c*), the front insertion chip is formed with the locking lug 571 at its rear portion and the insertion recessed portion 572 at its front portion. The magnets 550 mounted to the magnet housing frames 530, 531 are in contact with side faces of the front insertion chips 563. The first middle insertion chip 565 is formed with the locking lug 574 at its front portion and the locking lug 575 at its rear portion. The second middle insertion chip 566 is formed with the locking lug 576 at its front portion and the locking lug 578 at its rear portion. The rear insertion chip 567 is formed with the locking lug 579 at its front portion and is formed, at its rear portion, with the insertion protruding portion 581 that can be inserted into the insertion recessed portion 572 of the front insertion chip 563.

The pair of metal rails 561 is pushed into the grooves 515, 516 of the rail track belt 502 in opposite orientations to each other. The contact faces 562 come in contact with the bottom face 519, the front insertion chips 563 are inserted into the insertion holes 521, 532, of the grooves 515, 516, the first middle insertion chips 565 are inserted through the insertion holes 522 of the grooves 515, 516, the second middle insertion chips 566 are inserted through the insertion holes 523 of the grooves 515, 516, and the rear insertion chips 567 are inserted through the insertion holes 524 of the grooves 515, 516. As shown in FIGS. 40(*a*), and 40(*b*), when the front insertion chip 563 is inserted into the insertion hole 521, the locking lug 571 is locked to the back face 526 of the upper face plate 503. When the first middle insertion chip 565 is inserted into the insertion hole 522, the locking lugs 574, 575 are locked to the back face 526 of the upper face plate 503. When the second middle insertion chip 566 is inserted into the insertion hole 523, the locking lugs 576, 578 are locked to the back face 526 of the upper face plate 503. When the rear insertion chip 567 is inserted into the insertion hole 524, the locking lug 579 is locked to the back face 526 of the upper face plate 503. The rear insertion chip 567 comes in contact with the magnet housing frames 530, 531 but not with the magnets 550. As described above, it is possible to mount the pair of metal rails 261, 261 to the rail track belt 502 by only inserting the rails into the grooves 515, 516. If the back face 526 of the upper face plate 503 is formed with guide protrusions 527, 528 for guiding the front insertion chips 563, the first middle insertion chips 565, the second middle insertion chips 566, and the rear insertion chips 567 as shown in FIG. 38(*a*) to 38(*c*), it is possible to stably retain the metal rails 561.

Next, when the magnets 550, 550 are housed in the substantially L-shaped magnet housing frames 530, 531, the magnet 550 housed in the right magnet housing frame 530 comes in contact with the side face of the front insertion chip 563 of the right metal rail 561 and the magnet 550 housed in the left magnet housing frame 531 comes in contact with the side face of the front insertion chip 563 of the left metal rail 561. The fitting pins 546 of the bottom plate 545 are fitted in the positioning holes 542 of the upper face plate 503, the boss 543 is fitted in the fitting hole 545*b* of the bottom plate 545, and the screws 248 are screwed into the internal thread portions 541 through the through holes 547 thereby to mount the bottom plate 545 to the rail track belt 502. With the bottom plate 545, the magnets 550 mounted to the magnet housing frames 530, 531 are fixed.

As shown in FIG. 34, the insertion protruding portion 581 of the metal rail 561 mounted to the left groove 516 protrudes from the front face plate 510 and the insertion protruding portion 581 of the metal rail 561 mounted to the right groove 515 protrudes from the rear face plate 511. In the metal rail 561 mounted to the right groove 515, an insertion hole 590 is formed on the front face plate 510 side by the insertion recessed portion 572, and the bottom face 519 and the side faces 518, 518 of the groove 515. In the metal rail 561 mounted to the left groove 516, an insertion hole 590 is formed on the rear face plate 511 side by the insertion recessed portion 572, and the bottom face 519 and the side faces 518, 518 of the groove 516.

As shown in FIGS. 36(*a*) to 37(*b*), if the front face plate 510 of the rail track belt 502 of the rail track device 501 is brought in contact with the rear face plate 511 of the rail track belt 502 of the other rail track device, the insertion protruding portions 581 are inserted into the insertion holes 590 and the side faces of the insertion protruding portions 581 come in contact with the magnets 550. With attracting forces of the magnets 550, the rail track devices 501 are coupled to each other and the insertion protruding portions 581 and the insertion recessed portions 572 of the metal rails 561 come in direct contact with each other. In this way, the rail track devices 501 may be coupled in a straight line or ring shape. Because the metal rails 561 of the rail track devices 501 coupled in the straight line or ring shape are in direct contact with each other as described above, it is possible to pass an electric current throughout the rails. Even if the metal rails 561 are not in direct contact with each other, the metal rails 561 are electrically connected through the magnets 550 having conductivity and therefore it is possible to pass an electric current throughout the rails.

It is possible to place the drive wheel devices 301, 301 and the follower wheel devices 331, 331 of the powered toy vehicle 401 on the metal rails 561, 561 of the rail track device 501. As shown in FIG. 16, the second wheel main bodies 321, 321 and the fourth wheel main bodies 351, 351 formed of the members attracting with magnetic forces alternately come in contact with the metal rails 561, 561. A positive electrode of a power source is connected to one (561A) of the metal rails 561 and a negative electrode of the power source is connected to the other (561B) of the metal rails 561.

The electric current flows from one of the fourth wheel main bodies 351 (351A) in contact with the metal rail 561A to the metal rail 561B via the conductive ring 360, the first conductive contact 441, one of the contact terminals 455, the positive terminal of the drive motor 416, the negative terminal of the drive motor 416, the other contact terminal 456, the second conductive contact 445, the conductive ring 360, and the other of the fourth wheel main bodies 351 (351B) as shown in FIG. 25. With this electric current, the drive motor 416 rotates, the rotation is transmitted to the gears 308, 308 via the gear train 420, and the drive wheel devices 301, 301 rotate on the metal rails 561, 561. As a result, the powered toy vehicle 401 can travel on the rail track device 501.

When the powered toy vehicle 401 is traveling on a curve, inner wheels try to rotate slowly and outer wheels try to rotate fast. Because the wheels not affected by the magnets slip on the rails, there is less resistance of magnetic force and less load is applied on the drive motor 416 as compared with the conventional toy vehicle in which both the wheels rotate while attracting with the magnets.

The toy passenger vehicle 461 is coupled to the powered toy vehicle 401 as described above and the follower wheel devices 331, 331, 365, 365 of the toy passenger vehicle 461 can be placed on the metal rails 561, 561 of the rail track device 501. The positive electrode of the power source is connected to one of the metal rails 561 (561A) and the negative electrode of the power source is connected to the other of the metal rails 561 (561B)

An electric current flows from one (351C) of the fourth wheel main bodies 351 in contact with the metal rail 561A to the metal rail 561B via the conductive ring 360, the first conductive contact 441, the electronic substrate 466, the second conductive contact 445, the conductive ring 360, and the other (351D) of the fourth wheel main bodies 351. With this electric current, an electric component of the electronic substrate 466 is actuated.

The powered toy vehicle 401 and the toy passenger vehicles 461, 471 are extremely small and travel on the metal rails 561, 561 at an interval of about 3 mm. Although the powered toy vehicle 401 and the toy passenger vehicles 461, 471 are extremely lightweight, the second wheel main bodies 321 of the drive wheel devices 301 and the fourth wheel main bodies 351 of the follower wheel devices 331 in contact with the metal rails 561 are formed of the members attracting with the magnetic forces. Therefore, the second wheel main bodies 321 and the fourth wheel main bodies 351 attract the metal rails 561 with the magnetic forces, rotation of the drive wheel devices 301 and the follower wheel devices 331 is reliably transmitted to the metal rails 561 without slips, and the vehicles travel even an upward slope. Moreover, because the second wheel main bodies 321 of the drive wheel devices 301 and the fourth wheel main bodies 531 of the follower wheel devices 331 are attracting the metal rails 561 with the magnetic forces, the vehicles do not come off and fall from the metal rails 561.

If the insertion protruding portion 581 of the metal rail 561 of the other rail track belt 502 is inserted into the insertion recessed portion 572 of the rail track belt 502 of the rail track device 501, the insertion protruding portion 581 of the other metal rail 561 comes in contact with and is attracted by the magnet 550 and the metal rails 561 can be directly connected to the other metal rails 561 by the magnets 550. In this way, it is possible to couple the other rail track belt 502. If the rail track belts 502 are pulled apart with forces greater than the magnetic forces of the magnets 550, connection between the metal rails 561 and coupling between the rail track belts 502 of the rail track devices 501 can be cancelled easily. As seen from the above, the rail track devices 501 are functional and have simplified structures, because connection of the metal rails 561 and coupling of the rail track belts 502 by the magnets 550 can be carried out simultaneously and canceling of the connection and coupling can also be carried out simultaneously. Therefore, the rail track device 501 can be reduced in size and weight in such a way that the interval between the metal rails 561, 561 is as short as about 3 mm. Because the rail track device 501 can be reduced in size and weight, the magnetic forces of the magnets 550 are sufficient for connection and coupling. The method of manufacturing the rail track device 501 is extremely easy, because the metal rails 561, 561 can be fixed to the rail track belt 502 by only inserting the pair of metal rails 561, 561 into the pair of grooves 515, 516 in the rail track belt 502.

Other embodiments of the wheel devices for a toy vehicle according to the present invention and the toy vehicles mounted with the wheel devices will be described based on FIGS. 43(*a*) to 47. FIGS. 43(*a*) to 43(*c*) are general views of another embodiment of the drive wheel device for a toy vehicle according to the present invention, wherein FIG. 43(*a*) is a sectional view, FIG. 43(*b*) is a front view, and FIG. 43(*c*) is a perspective view. FIGS. 44(*a*) to 45(*c*) are general views of other embodiments of the follower wheel device for a toy vehicle according to the present invention, wherein FIGS. 44(*a*), 45(*a*) are sectional views, FIGS. 44(*b*), 45(*b*) are front views, and FIGS. 44(*c*), 45(*c*) are perspective views. FIGS. 46, 47 are exploded perspective views of the drive wheel devices and the follower wheel devices for a toy vehicle according to the present invention mounted into toy vehicles.

The drive wheel device, the follower wheel device, and the toy vehicle mounted with them will be described further in detail. As shown in FIG. 43, the drive wheel device 601 includes a first axle 602, a first wheel 610, and a second wheel 620. The first axle 602 is made of a synthetic resin material such as ABS resin and formed into a cylindrical shape. To a peripheral face of the first axle 602, a cylindrical member 605 having a gear 608 is secured. The cylindrical member 605 is made of a synthetic resin material such as polyacetal (POM). Cog tips of the gear 608 are curved to form spherical surfaces.

The first wheel 610 includes a first wheel main body 611 and a magnet ring 617. The first wheel main body 611 includes a mounting shaft 619, a first flange 612, and a fitting shaft 613 and is integrally molded as a metal member such as an iron member. The first flange 612 is attached with the mounting shaft 619 substantially coaxial with the first flange 612 at an outer side face 615 thereof. The first flange 612 is provided, at an inner side face 616 thereof, with the fitting shaft 613 substantially coaxial with the first flange 612. A tip end face 618 of the mounting shaft 619 is formed with a substantially conical support recessed portion 614 substantially coaxial with the first wheel main body 611. To an outer peripheral face of the mounting shaft 619, the magnet ring 617 is fixedly mounted to come in contact with the first flange 612. The magnet ring 617 has a smaller outer diameter than the first flange 612. The first wheel 610 is fixed with its fitting shaft 613 fitted into the first axle 602. Since the second wheel 620 has the same structure as the first wheel 610, description of the second wheel 620 will not be made here. The magnet rings 617, 617 function as wheels traveling on the rails 561, 561.

As shown in FIGS. 44(*a*) to 44(*c*), the follower wheel device 631 includes a second axle 632, a third wheel 640, and a fourth wheel 650. The second axle 632 is formed of a metal member such as a copper member into a cylindrical shape and has a similar function to the above-described conductive ring 360. The third wheel 640 includes a third wheel main body 641 and a magnet ring 647. The third wheel main body 641 includes a mounting shaft 649, a third flange 642, and a fitting shaft 643 and is integrally molded as a metal member such as a copper member. The third flange 642 is attached with the mounting shaft 649 substantially coaxial with the third flange 642 at an outer side face 645 thereof. The third flange 642 is attached with the fitting shaft 643 substantially coaxial with the third flange 642 at an inner side face 646 thereof. A tip end face 648 of the mounting shaft 649 is formed with a substantially conical support recessed portion 644 substantially coaxial with the third wheel main body 641. To an outer peripheral face of the mounting shaft 649, the magnet ring 647 is fixedly mounted to come in contact with the third flange 642. The magnet ring 647 has a smaller outer diameter than the third flange 642. The third wheel 640 is fixed with its fitting shaft 643 fitted into the second axle 632.

The fourth wheel 650 includes a fourth wheel main body 651, a fourth flange 652, and a fitting shaft 653 and is integrally formed of a metal member such as a copper member. The fourth flange 652 is installed by the fourth wheel main body 651 substantially coaxial with the fourth flange 652 at an outer side face 655 thereof. The fourth flange 652 is attached with the fitting shaft 653 substantially coaxial with the fourth flange 652 at an inner side face 656 thereof. A tip end face 658 of the fourth wheel main body 651 is formed with a substantially conical support recessed portion 654 substantially coaxial with the fourth wheel main body 651. The fourth flange 652 has substantially the same outer diameter as the third flange 642. The fourth wheel main body 651 has substantially the same outer diameter as the magnet ring 647. The fourth wheel 650 is mounted to an auxiliary member 661. The auxiliary member 661 is constituted by a cylindrical trunk portion 662 and a locking flange 663 formed at one end of the trunk portion 662 and is integrally molded of a synthetic resin material such as ABS resin. The locking flange 663 has substantially the same outer diameter as the fourth flange 652. The fourth wheel 650 is fixedly mounted to the auxiliary member 661 with the fitting shaft 653 fitted in the trunk portion 662 on the locking flange 663 side and the fourth flange 652 joined to the locking flange 663. The auxiliary member 661 is fixed with the trunk portion 662 inserted into the second axle 632 until the locking flange 663 is locked to an end face of the second axle 632. In this way, in the follower wheel device 631, the third wheel 640 and the fourth wheel 650 are mounted to opposite sides of the second axle 632.

As shown in FIGS. 45(*a*) to 45(*c*), the follower wheel device 671 includes a second axle 672 and the pair of fourth wheels 650. The second axle 672 is formed of a synthetic resin material such as ABS resin into a cylindrical shape. Each of the fourth wheels 650 is fixedly mounted to the second axle 672 with the fitting shaft 653 fitted in the second axle 672 and the fourth flange 652 joined to an end face of the second axle 672.

As shown in FIGS. 46 and 47, the above-described drive wheel device 601, and the follower wheel devices 631, 671 are rotatably mounted to the carriage frames 371 of the toy vehicles. The drive wheel device 601, the follower wheel devices 631, 671 are mounted into the carriage frames 371 to form the carriages.

As shown in FIG. 46, the pair of drive wheel devices 601, 601 is rotatably mounted to the carriage frame 371 of the powered toy vehicle 401 so that the first wheel main bodies 611 are in opposite positions (coming in contact with different rails). The carriage frame 371 and the pair of drive wheel devices 601, 601 form the drive-side carriage 370A.

As shown in FIG. 46, the drive-side carriage 370A is mounted to the chassis 403 by locking the locking lugs 393, 393 of the carriage frame 371 to the locking grooves 410, 410. When the carriage frame 371 is mounted to the chassis 403, the guide protrusions 395, 395 protrude into guide grooves 408, 408 formed in the chassis 403 and the guide protrusions 395, 395 can rotate within areas in which they are guided by the guide grooves 408, 408.

As shown in FIG. 46, the pair of follower wheel devices 631, 631 is rotatably mounted to the carriage frame 371 of the powered toy vehicle 401 so that the third wheel main bodies 641 are in opposite positions (coming in contact with different rails). The carriage frame 371 and the pair of follower wheel devices 631, 631 form the follower-side carriage 370B. The follower-side carriage 370B is mounted similarly to the carriage 370A.

The chassis 403 is provided with the drive motor 416 and a gear train 420A for transmitting rotation of the drive motor to the gears 608, 608 of the pair of drive wheel devices 601, 601. The gear train 420A consists of a drive gear 421 mounted to a drive shaft of the drive motor 416, a crown gear engaged with the drive gear 421, a small gear 423 integral with the crown gear 422; a large gear 429 engaged with the small gear 423, a small gear 428 integral with the large gear 429, and a final gear 430 integral with the small gear 428. Cog tips of the final gear 430 are curved into spherical surfaces.

The chassis 403 is mounted with a gear box 431A with which the gear train 420A is rotatably mounted on the chassis 403. The final gear 430 is adapted to be placed above the pair of gears 608, 608 of the carriage 370A mounted onto the chassis 403. The chassis 403 is formed with an opening 433 for allowing the final gear 430 to protrude through the lower face of the chassis 403 and the final gear 430 protruding through the opening 433 is engaged with the gears 608, 608 of the drive wheel devices 601, 601 mounted to the carriage 370A. As shown in FIG. 46, lower ends of the conductive contacts 441, 445 protrude from the openings 454 to come in sliding contact with the second axles 632, 632 of the follower wheel devices 631, 631 mounted to the carriage 370B.

As shown in FIG. 47, in the toy passenger vehicle 461, the follower wheel devices 631, 671 are rotatably mounted to the carriage frames 371 to form the follower-side carriages 370C. The follower wheel device 631 of one of the pair of carriages 370C, 370C and the follower wheel device 631 of the other are rotatably mounted to the carriage frames 371 so that the third wheel main bodies 641 are in opposite positions (coming in contact with different rails). Lower ends of the conductive contacts 441, 445 come in sliding contact with the second axles 632, 632 of the follower wheel devices 631, 631 mounted to the carriages 370C.

The powered toy vehicle 401 and the toy passenger vehicle 461 are coupled by a coupler. It is possible to place the drive wheel devices 601 and the follower wheel devices 631 of the powered toy vehicle 401 on the metal rails 561, 561 of the rail track device 501. The pair of magnet rings 617, 617 of the drive wheel device 601 comes in contact with the metal rails 561, 561 while attracting the rails. The one magnet ring 647 of the follower wheel device 631 come in contact with the metal rail 561 while attracting the rail. A positive electrode of a power source is connected to one (561A) of the metal rails 561 and a negative electrode of the power source is connected to the other (561B) of the metal rails 561.

An electric current flows from one (647A) of the magnet rings 647 of the third wheel main bodies 641 in contact with the metal rail 561A to the metal rail 561B via the third wheel main body 641, the second axle 632, the first conductive contact 441, the one contact terminal 455, the positive terminal of the drive motor 416, the negative terminal of the drive motor 416, the other contact terminal 456, the second conductive contact 445, the second axle 632, the third wheel main body 641, and the other (647B) of the magnet rings 647 of the third wheel main bodies 641. With this electric current, the drive motor 416 rotates, the rotation is transmitted to the gears 608, 608 via the gear train 420A, and the drive wheel devices 601, 601 rotate on the metal rails 561, 561. As a result, the powered toy vehicle 401 can travel on the rail track device 501.

The toy passenger vehicle 461 is coupled to the powered toy vehicle 401 as described above with the follower wheel devices 631, 671 of the toy passenger vehicle 461 placed on the metal rails 561, 561 of the rail track device 501. The positive electrode of the power source is connected to one (561A) of the metal rails 561 and the negative electrode of the power source is connected to the other (561B) of the metal rails 561. An electric current flows from one (647A) of the magnet rings 647 of the third wheel main bodies 641 in contact with the metal rail 561A to the metal rail 561B via the third wheel main body 641, the second axle 632, the first conductive contact 441, the electronic substrate 466, the second conductive contact 445, the second axle 632, the third wheel main body 641, and the other (647B) of the magnet rings 647 of the third wheel main bodies 641. With this electric current, the electric component of the electronic substrate 466 is actuated.

The powered toy vehicle 401 and the toy passenger vehicle 461 are extremely small and travel on the metal rails 561, 561 at an interval of about 3 mm. Although the powered toy vehicle 401 and the toy passenger vehicle 461 are extremely lightweight, the first wheels 610 and the second wheels 620 of the drive wheel devices 601 and the third wheels 640 of the follower wheel devices 631 in contact with the metal rails 561 are formed of members attracting with the magnetic forces. Therefore, rotation of the drive wheel devices 601 and the follower wheel devices 631 is reliably transmitted to the metal rails 561 without slips, and the vehicles travel even on an upward slope.

Other embodiments of the wheel devices for a toy vehicle according to the present invention and the toy vehicles mounted with the wheel devices will be described based on FIGS. 48(*a*) to 55. FIGS. 48(*a*) to 48(*c*) are general views of another embodiment of the drive wheel device for a toy vehicle according to the present invention, wherein FIG. 48(*a*) is a sectional view, FIG. 48(*b*) is a front view, and FIG. 48(*c*) is a perspective view. FIGS. 49(*a*) to 50(*c*) are general views of other embodiments of the follower wheel device for a toy vehicle according to the present invention, wherein FIGS. 49(*a*), and 50 (*a*) are sectional views, FIGS. 49(*b*), 50(*b*) are front views, and FIGS. 49(*c*), and 50(*c*) are perspective views. FIGS. 51(*a*), and 51(*b*) are exploded perspective views of the drive wheel devices for a toy vehicle according to the present invention mounted into a carriage, wherein FIG. 51(*a*) is a perspective views from above and FIG. 51(*b*) is an exploded perspective view. FIGS. 52(*a*), and 52 (*b*) are exploded perspective views of the follower wheel devices for a toy vehicle according to the present invention mounted into a carriage, wherein FIG. 52(*a*) is a perspective view from above and FIG. 52(*b*) is an exploded perspective view. FIG. 53 is an exploded perspective view of the drive wheel devices and the follower wheel devices for a toy vehicle according to the present invention mounted into a toy vehicle. FIGS. 54(*a*) to 54(*e*) are sectional views of the wheel devices for a toy vehicle according to the present invention mounted into a toy vehicle, wherein FIG. 54(*a*) is a side view of the toy vehicle, FIG. 54(*b*) is a sectional view of the toy vehicle taken along a line A-A, FIG. 54(*c*) is a sectional view of the toy vehicle taken along a line B-B, FIG. 54(*d*) is a sectional view of the toy vehicle taken along a line C-C, and FIG. 54(*e*) is a sectional view of the toy vehicle taken along a line D-D. FIG. 55 is an exploded perspective view of other follower wheel devices for a toy vehicle according to the present invention mounted into a toy vehicle.

The drive wheel device, the follower wheel devices, and the toy vehicle mounted with them will be described in detail. As shown in FIGS. 48(*a*) to 48(*c*), the drive wheel device 701 includes a first axle 702, a first wheel 710, and a second wheel 720. The first axle 702 is made of a synthetic resin material such as polyacetal (POM) and formed into a cylindrical shape. Substantially at a center and a peripheral face of the first axle 702, a gear 708 is molded integrally. Cog tips of the gear 708 are curved to form spherical surfaces.

The first wheel 710 includes a first wheel main body 711 and a magnet ring 717. The first wheel main body 711 includes a mounting shaft 719, a first flange 712, and a fitting shaft 713 and is integrally molded of a metal member such as a copper member. The first flange 712 is provided, at an outer side face 715 thereof, with the mounting shaft 719 substantially coaxial with the first flange 712. The first flange 712 is attached with the fitting shaft 713 substantially coaxial with the first flange 712 at an inner side face 716 thereof. A tip end face 718 of the mounting shaft 719 is formed with a substantially conical support recessed portion 714 substantially coaxial with the first wheel main body 711. To an outer peripheral face of the mounting shaft 719, the magnet ring 717 is fixedly mounted to come in contact with the first flange 712. The magnet ring 717 has a smaller outer diameter than the first flange 712. The first wheel 710 is fixed with its fitting shaft 713 fitted into the first axle 702. Since the second wheel 720 has the same structure as the first wheel 710, description of the second wheel 720 will not be made here. The magnet rings 717, 717 function as wheels traveling on the rails 561, 561.

As shown in FIGS. 49(*a*) to 49(*c*), the follower wheel device 731 includes a second axle 732, a first wheel 710, and a second wheel 720. The second axle 732 is made of a synthetic resin material such as polyacetal (POM) into a cylindrical shape. The first wheel 710 and the second wheel 720 are fixed with their fitting shafts 713 fitted in the second axle 732. Magnet rings 717, 717 function as wheels traveling on the rails 561, 561.

As shown in FIGS. 50(*a*) to 50(*c*), the follower wheel device 751 includes a second axle 752 and a pair of fourth wheels 760. Each of the fourth wheels 760 includes a fourth wheel main body 761, a fourth flange 762, and a fitting shaft 763 and is integrally molded as a metal member such as a copper member. The fourth flange 762 is provided, at an outer side face 765 thereof, with the fourth wheel main body 761 substantially coaxial with the fourth flange 762. The fourth flange 762 is provided, at an inner side face 766 thereof, with the fitting shaft 763 substantially coaxial with the fourth flange 762. A tip end face 768 of the fourth wheel main body 761 is formed with a substantially conical support recessed portion 764 substantially coaxial with the fourth wheel main body 761. The fourth wheel main body 761 has substantially the same outer diameter as the magnet ring 717. The fourth wheel 760 is fixedly mounted to the second axle 752 with the fitting shaft 763 fitted in the second axle 752 and the fourth flange 762 joined to an end face of the second axle 752. In this way, in the follower wheel device 751, the fourth wheels 760 are mounted to opposite sides of the second axle 752.

As shown in FIGS. 51(*a*) to 52(*b*), the above-described drive wheel device 701 and the follower wheel device 731 are rotatably mounted to the carriage frames 771, 821 of the toy vehicles. The drive wheel devices 701 are mounted into the carriage frame 771 to form the carriage 770A. The follower wheel devices 731 are mounted into the carriage frame 821 to form the carriage 770B.

As shown in FIGS. 51(*a*) and 51(*b*), the carriage frame 771 is configured by a substantially rectangular main frame 772, a middle member 773 for partitioning an inside of the main frame 772, and locking lugs 775, and the like, and is integrally molded of a synthetic resin. The main frame 772 is configured by a pair of longitudinal members 776, 776 in a longitudinal direction and a pair of lateral members 777, 777 in a lateral direction and provided at opposite ends of the longitudinal members 776, 776. An outer face 778 of the lateral member 777 is formed of a convex curved face in the shape of an arc having a center substantially at a center of the main frame 772. The outer face 778 of one of the lateral members 777 is formed, substantially at a center thereof, with a coupling hole 778A.

The middle member 773 is provided to connect substantially central portions of the pair of longitudinal members 776, 776 and is mounted to lower faces of the longitudinal members 776, 776 to be in positions lower than the lateral members 777, 777. The middle member 773 forms housing portions 781, 782 for housing the drive wheel devices 701, 701 in the main frame 772. The middle member 773 is formed with a recessed step portion 774 at a middle portion to avoid contact with the final gear 430 and a pair of locking protrusions 789, 789 at each of opposite ends. Into a clearance between each pair of locking protrusions 789, 789 and an inner face of the longitudinal member 776, a bearing plate 800 is inserted and mounted. The bearing plate 800 is formed by pressing a metal sheet such as a copper sheet. The bearing plate 800 is formed with a fitting recessed portion 801 to be fitted over the middle member 773 substantially at a center of a lower end of the plate 800, support protruding portions 802, 802 at opposite sides of a front face of the plate 800, and an L-shaped protruding chip 805 substantially at a center of an upper end of the plate 800. The support protruding portions 802 are formed into substantially conical shapes and rotatably fitted in the support recessed portions 714 of the above-described drive wheel devices 701. The protruding chip 805 is formed of a spring receiving portion 806 and a spring insertion portion 807 into the substantially L shape as described above.

In the drive wheel device 701, the support protruding portion 802 of one of the bearing plates 800 is rotatably inserted into one of the support recessed portions 714 and the support protruding portion 802 of the other bearing plate 800 is rotatably inserted into the other support recessed portion 714. In this way, with the pair of drive wheel devices 701, 701 sandwiched between the pair of bearing plates 800, 800, the pair of bearing plates 800, 800 are inserted into the clearances between the pairs of locking protrusions 789, 789 and the inner faces of the longitudinal members 776. As a result, the drive wheel devices 701, 701 are rotatably mounted to the carriage frame 771. In other words, the drive wheel devices 701 are rotatably mounted to the carriage frame 771 with their support recessed portions 714, 714 rotatably supported by the support protruding portions 802, 802 of the pair of bearing plates 800, 800 mounted to the carriage frame 771. When the bearing plate 800 is inserted into the clearance between the pair of locking protrusions 789, 789 and the inner face of the longitudinal member 776, the fitting recessed portion 801 is fitted over the middle member 773 and therefore the bearing plate 800 is positioned and retained stably. Respective devices of the pair of drive wheel devices 701, 701 are housed respectively in the housing portion 781 and the housing portion 782 of the carriage frame 771. The lateral members 777, 777 are formed, substantially at centers of upper faces 777B, 777B thereof, with the locking lugs 775, 775.

As shown in FIGS. 52(*a*), and 52(*b*), the carriage frame 821 is configured by a substantially rectangular main frame 822, a middle member 823 for partitioning an inside of the main frame 822, and locking lugs 825 . . . and is integrally molded of a synthetic resin. The main frame 822 is configured by a pair of longitudinal members 826, 826 in a longitudinal direction and a pair of lateral members 827, 827 in a lateral direction and provided at opposite ends of the longitudinal members 826, 826. An outer face 828 of the lateral member 827 is formed of a convex curved face in the shape of an arc having a center substantially at a center of the main frame 822. The outer face 828 of one of the lateral members 827 is formed, substantially at a center thereof, with a coupling hole 828A.

The middle member 823 is provided to connect substantially central portions of the pair of longitudinal members 826, 826 and is mounted to lower faces of the longitudinal members 826, 826 to be in positions lower than the lateral members 827, 827. The middle member 823 forms housing portions 831, 832 for housing the follower wheel devices 731, 731 in the main frame 822. The middle member 823 is formed, on an upper face thereof, with a pair of fitting protrusions 841, 841. The upper face of the middle member 823 is mounted with a fixing member 835. The fixing member 835 is formed in the shape of a rectangular parallelepiped, formed with fitting holes 836, 836 to be fitted over the fitting protrusions 841, 841 of the middle member 823, and formed to project, at a center of an upper face thereof, with a center shaft 837. The fixing member 835 is fixedly mounted to the middle member 823 when their fitting holes 836, 836 are fitted over the fitting protrusions 841, 841 of the middle member 823. When the fixing member 835 is mounted to the middle member 823, clearances are formed between the fixing member 835 and inner faces of the longitudinal members 826, 826. Into the clearances, the bearing plates 800 are inserted and mounted.

In the follower wheel device 731, the support protruding portion 802 of one of the bearing plates 800 is rotatably inserted into one of the support recessed portions 714 and the support protruding portion 802 of the other bearing plate 800 is rotatably inserted into the other support recessed portion 714. In this way, with the pair of follower wheel devices 731, 731 sandwiched between the pair of bearing plates 800, 800, the pair of bearing plates 800, 800 are inserted into the clearances between the fixing member 835 and the inner faces of the longitudinal members 776. As a result, the follower wheel devices 731, 731 are rotatably mounted to the carriage frame 821. In other words, the follower wheel devices 731 are rotatably mounted to the carriage frame 821 with their support recessed portions 714, 714 rotatably supported by the support protruding portions 802, 802 of the pair of bearing plates 800, 800 mounted to the carriage frame 821. When the bearing plate 800 is inserted into the clearance between the fixing member 835 and the inner face of the longitudinal member 776, the fitting recessed portion 801 is fitted over the middle member 823 and therefore the bearing plate 800 is positioned and retained stably. Respective devices of the pair of follower wheel devices 731, 731 are housed respectively in the housing portion 831 and the housing portion 832 of the carriage frame 821. The lateral members 827, 827 are formed, substantially at centers of upper faces 827B, 827B thereof, with the locking lugs 825, 825.

As shown in FIG. 53, a toy vehicle main body 852 of a powered toy vehicle 851 includes a chassis 853 and a vehicle body 855 mounted to the chassis 853. Formed at each of a front portion and a rear portion of the chassis 853 is a pair of curved locking grooves 860, 860 which are opposed to each other and to which the carriage frames 771, 821 can be mounted.

The drive-side carriage 770A is mounted to the chassis 853 by locking the locking lugs 775, 775 of the carriage frame 771 in the locking grooves 860, 860. The follower-side carriage 770B is mounted to the chassis 853 by locking the locking lugs 825, 825 of the carriage frame 821 in the locking grooves 860, 860. The carriage 770B can rotate about the center shaft 837, because the center shaft 837 formed on the upper face of the fixing member 835 is pivoted in a bearing hole formed in the lower face of the chassis 853.

The chassis 853 is provided with the drive motor 416 and the above-described gear train 420A. The chassis 853 is mounted with a gear box 856 in which the above-described gear train 420A is rotatably mounted. The final gear 430 is adapted to be placed above the pair of gears 708, 708 of the carriage 770A mounted to the chassis 853. The chassis 853 is formed with an opening 854 for allowing the final gear 430 to protrude from the lower face of the chassis 853 and the final gear 430 protruding through the opening 854 is engaged with the gears 708, 708 of the drive wheel devices 701, 701 mounted to the carriage 770A.

The chassis 853 is provided with the conductive contacts 441, 445 positioned above the bearing plates 800, 800 of the carriage 770A. The conductive contacts 441, 445 are spring members made of conductive metal. The conductive contacts 441, 445 are guided by substantially angular U-shaped guide grooves 845, 845 formed on opposite sides of the gear box 856 and substantially angular U-shaped guide recessed portions 857, 857 formed on opposite sides of the chassis 853. Upper ends of the conductive contacts 441, 445 come in contact with conductive contact plates 847, 848. Lower ends of the conductive contacts 441, 445 are pressed against the spring receiving portions 806, 806 with the spring insertion portions 807, 807 of the bearing plates 800, 800 inserted into lower portions of the conductive contacts 441, 445. The conductive contact terminals 441, 445 prevent the bearing plates 800, 800 from coming off the carriage frame 771 and also function as suspensions of the drive wheel device 701.

The chassis 853 is provided with the conductive contacts 441, 445 positioned above the bearing plates 800, 800 of the carriage 770B. The conductive contacts 441, 445 are spring members made of conductive metal. The conductive contacts 441, 445 are guided by substantially angular U-shaped guide grooves 843, 843 formed on opposite sides of the guide member 842 formed at an upper portion of the chassis 853. Upper ends of the conductive contacts 441, 445 come in contact with conductive contact plates 847, 848. Lower ends of the conductive contacts 441, 445 are pressed against the spring receiving portions 806, 806 with the spring insertion portions 807, 807 of the bearing plates 800, 800 inserted into lower portions of the conductive contacts 441, 445. The conductive contact terminals 441, 445 prevent the bearing plates 800, 800 from coming off the carriage frame 821 and also function as suspensions of the drive wheel device 731.

Inside the vehicle body 855, the conductive contact plates 847, 848 are fixedly mounted. The conductive contact plate 847 is electrically connected to the upper end of the conductive contact 441 positioned above the carriage 770A, the positive terminal of the drive motor 416, and the upper end of the conductive contact 441 positioned above the carriage 770B when the vehicle body 855 is mounted to the chassis 853. Similarly, the conductive contact plate 848 is electrically connected to the upper end of the conductive contact 445 positioned above the carriage 770A, the negative terminal of the drive motor 416, and the upper end of the conductive contact 445 positioned above the carriage 770B when the vehicle body 855 is mounted to the chassis 853.

The above-described follower wheel devices 731 and the follower wheel devices 751 are rotatably mounted to a carriage frame 371 and a carriage frame 821 of a toy passenger vehicle 861 as shown in FIG. 55. The follower wheel devices 731, 751 are mounted into the carriage frame 371 to form a carriage 770C. The follower wheel devices 731, 751 are mounted into the carriage frame 821 to form a carriage 770D.

A toy vehicle main body 862 of the toy passenger vehicle 861 includes a chassis 863 and a vehicle body 865 mounted to the chassis 863. Formed at each of a front portion and a rear portion of the chassis 863 is a pair of curved locking grooves 868, 868 which are facing each other and to which the carriage frames 371, 821 can be mounted. The carriage 770D is mounted to the chassis 863 by locking the locking lugs 825, 825 of the carriage frame 821 in the locking grooves 868, 868. The carriage 770D is mounted to the chassis 863 by locking the locking lugs 825, 825 of the carriage frame 821 to the locking grooves 868, 868. The carriage 770D can rotate about the center shaft 837, because the center shaft 837 formed on the upper face of the fixing member 835 is pivoted in the bearing hole formed in the lower face of the chassis 863. The carriage 770C is mounted to the chassis 863 by locking the locking lugs 393, 393 of the carriage frame 371 to the locking grooves 868, 868.

The chassis 863 is provided with the conductive contacts 441, 445 positioned above the bearing plates 800, 800 of the carriage 770D. The conductive contacts 441, 445 are spring members made of conductive metal. The conductive contacts 441, 445 are guided by substantially angular U-shaped guide grooves 871, 871 formed on opposite sides of a guide member 870 formed on an upper portion of the chassis 863. Upper ends of the conductive contacts 441, 445 come in contact with conductive contact plates 872, 873. Lower ends of the conductive contacts 441, 445 are pressed against the spring receiving portions 806, 806 with the spring insertion portions 807, 807 of the bearing plates 800, 800 inserted into lower portions of the conductive contacts 441, 445. The conductive contact terminals 441, 445 prevent the bearing plates 800, 800 from coming off the carriage frame 821 and also function as suspensions of the follower wheel device 731.

Inside the vehicle body 865, the conductive contact plates 872, 873 are fixedly mounted. The conductive contact plate 872 is electrically connected to the upper end of the conductive contact 441 positioned above the carriage 770D when the vehicle body 865 is mounted to the chassis 863. Similarly, the conductive contact plate 873 is electrically connected to the upper end of the conductive contact 445 positioned above the carriage 770D when the vehicle body 855 is mounted to the chassis 853. The conductive contact plates 872, 873 are electrically connected to the electric component 875 such as an LED provided in the vehicle body 865.

The powered toy vehicle 851 and the toy passenger vehicle 861 are coupled by a coupler. It is possible to place the drive wheel devices 701 and the follower wheel devices 731 of the powered toy vehicle 851 on the metal rails 561, 561 of the rail track device 501. The pairs of magnet rings 717, 717 of the drive wheel devices 701 come in contact with the metal rails 561, 561 while attracting the rails. The pairs of magnet rings 717 of the follower wheel devices 731 come in contact with the metal rails 561, 561 while attracting the rails. In this manner, all the wheels of the powered toy vehicle 851 to which power is transmitted attract the metal rails 561, 561 with magnetic forces. Therefore, all the wheels do not slip on the pair of metal rails 561, 561. As s result, power of the drive motor 416 can be reliably transmitted to the pair of metal rails 561, 561.

A positive electrode of a power source is connected to one (561A) of the metal rails 561 and a negative electrode of the power source is connected to the other (561B) of the metal rails 561. An electric current flows from the magnet rings 717, 717 (717A) of the first wheel main bodies 711, 711 of the carriage 770A in contact with the metal rail 561A to the metal rail 561B via the first wheel main bodies 711, 711, the bearing plate 800, the first conductive contact 441, one 847 of the contact terminals, the positive terminal of the drive motor 416, the negative terminal of the drive motor 416, the other contact terminal 848, the second conductive contact 445, the bearing plate 800, the first wheel main bodies 711, 711, and the magnet rings 717, 717 (717B) of the first wheel main bodies 711, 711. With this electric current, the drive motor 416 rotates, the rotation is transmitted to the gears 708, 708 via the gear train 420A, and the drive wheel devices 701, 701 rotate on the metal rails 561, 561. As a result, the powered toy vehicle 851 can travel on the rail track device 501.

An electric current flows from the magnet rings 717, 717 (717A) of the first wheel main bodies 711, 711 of the carriage 770B in contact with the metal rail 561A to the metal rail 561B via the first wheel main bodies 711, 711, the bearing plate 800, the first conductive contact 441, one 847 of the contact terminals, the positive terminal of the drive motor 416, the negative terminal of the drive motor 416, the other contact terminal 848, the second conductive contact 445, the bearing plate 800, the first wheel main bodies 711, 711, and the magnet rings 717, 717 (717B) of the first wheel main bodies 711, 711. With this electric current, the drive motor 416 rotates, the rotation is transmitted to the gears 708, 708 via the gear train 420A, and the drive wheel devices 701, 701 rotate on the metal rails 561, 561. As a result, the powered toy vehicle 851 can travel on the rail track device 501. In other words, the powered toy vehicle 851 can be powered from both the carriage 770A and carriage 770B. Especially, the powered toy vehicle 851 can be powered from any of the four magnet rings 717, 717 in contact with the metal rails 561 and therefore it is possible to reliably drive the drive motor 416 without interruption.

The toy passenger vehicle 861 is coupled to the powered toy vehicle 851 as described above with the follower wheel devices 731, 751 of the toy passenger vehicle 861 placed on the metal rails 561, 561 of the rail track device 501. The positive electrode of the power source is connected to one (561A) of the metal rails 561 and the negative electrode of the power source is connected to the other (561B) of the metal rails 561. An electric current flows from the magnet ring 717 (717A) of the first wheel main body 711 in contact with the metal rail 561A and the fourth wheel main body 761 (761A) to the metal rail 561B via the bearing plate 800, the first conductive contact 441, the conductive contact plate 872, the electric component 875, the conductive contact plate 873, the second conductive contact 445, the bearing plate 800, the magnet ring 717 (717B) of the first wheel main body 711, and the fourth wheel main body 761 (761B). With this electric current, the electric component 875 is actuated.

The powered toy vehicle 851 and the toy passenger vehicle 861 are extremely small and travel on the metal rails 561, 561 at an interval of about 3 mm. Although the powered toy vehicle 851 and the toy passenger vehicle 861 are extremely lightweight, the wheels of the drive wheel devices 701 and the follower wheel devices 731 in contact with the metal rails 561 are formed of magnets. Therefore, rotation of the drive wheel devices 701 and the follower wheel devices 731 is reliably transmitted to the metal rails 561 without slips and the vehicles travel even on an upward slope.

INDUSTRIAL APPLICABILITY

The wheel device for a toy vehicle and the toy vehicle according to the invention can be used for a toy train that travels on a pair of metal rails.

DESCRIPTION OF REFERENCE NUMERALS

Figure 1:
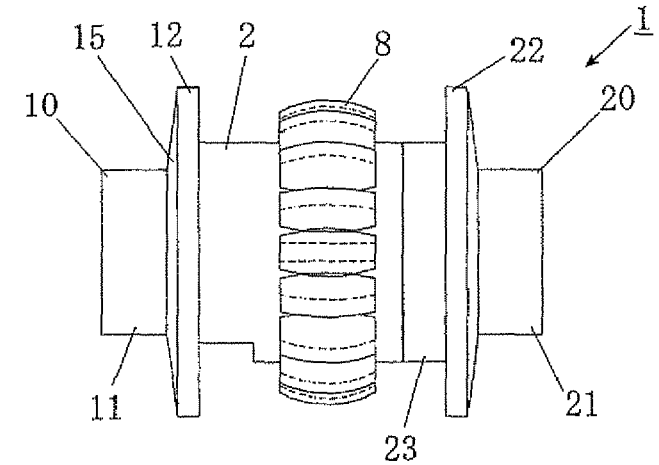
FIGS. 1(*a*) to 1(*c*) are general views of embodiments of a drive wheel device for a toy vehicle according to the present invention.
Figure 1:
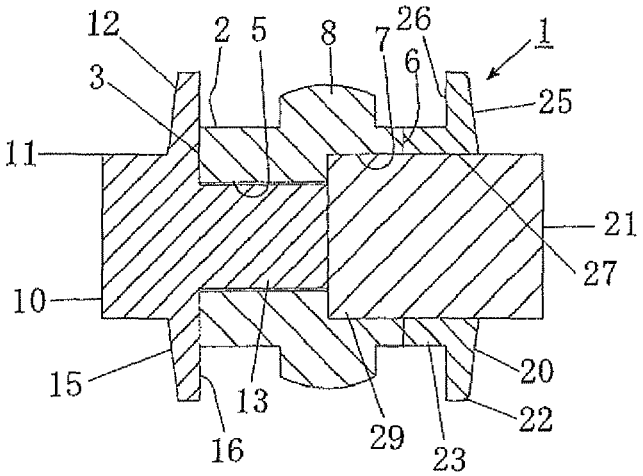
Figure 1:
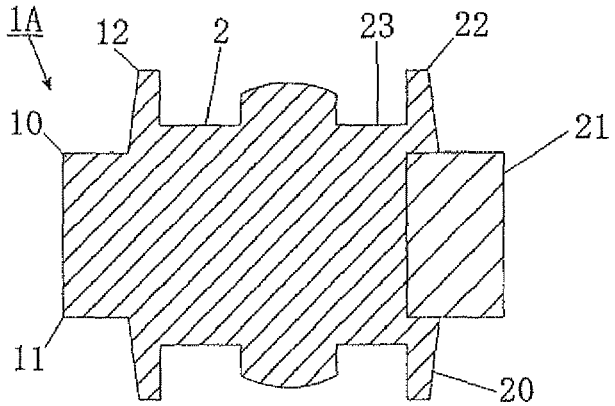
Figure 2:
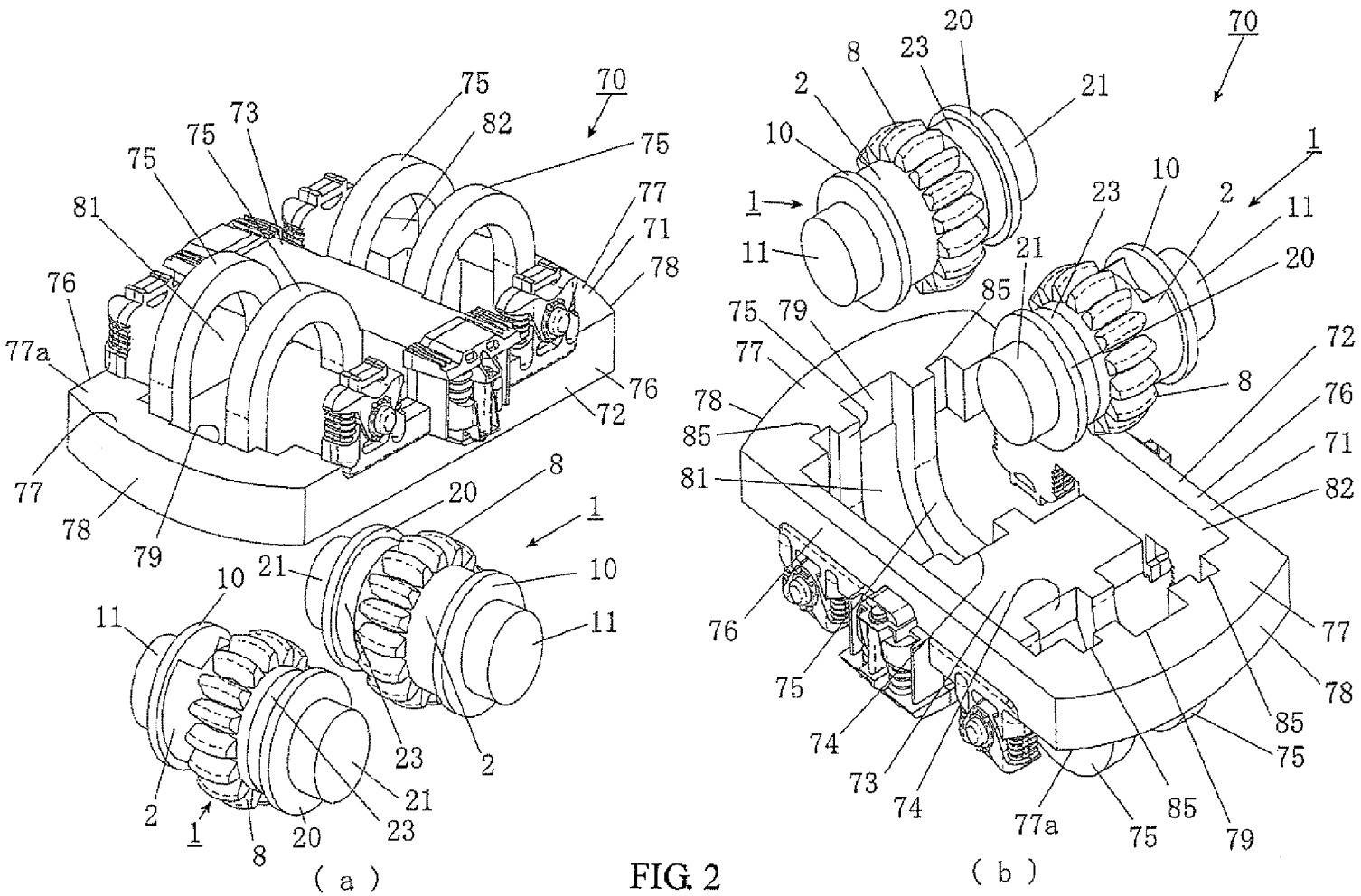
FIGS. 2(*a*) and 2(*b*) are exploded perspective views of the drive wheel devices for a toy vehicle according to the present invention mounted into a carriage.
Figure 3:
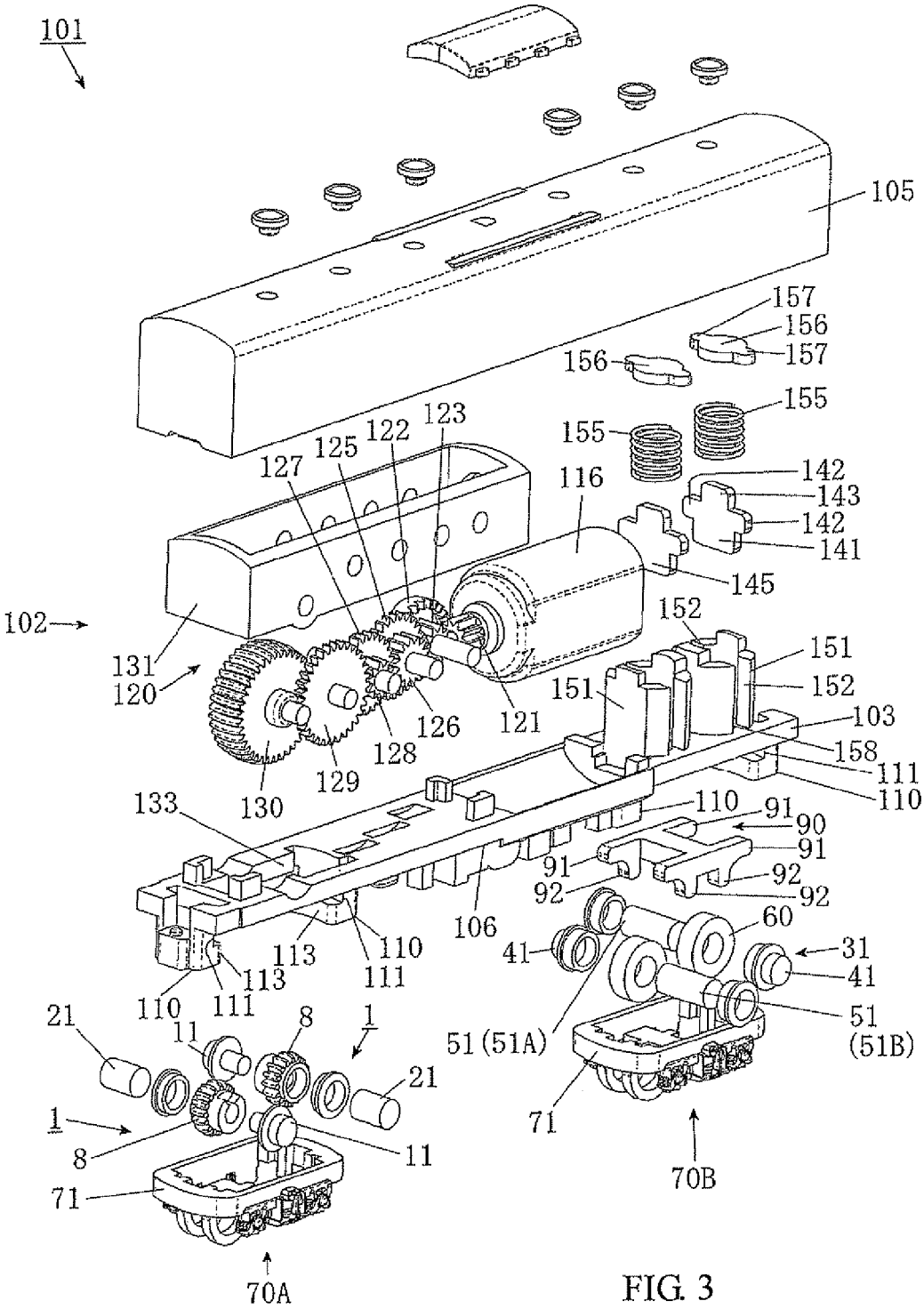
FIG. 3 is an exploded perspective view of the drive wheel devices and follower wheel devices for a toy vehicle according to the present invention mounted into a toy vehicle.
Figure 4:
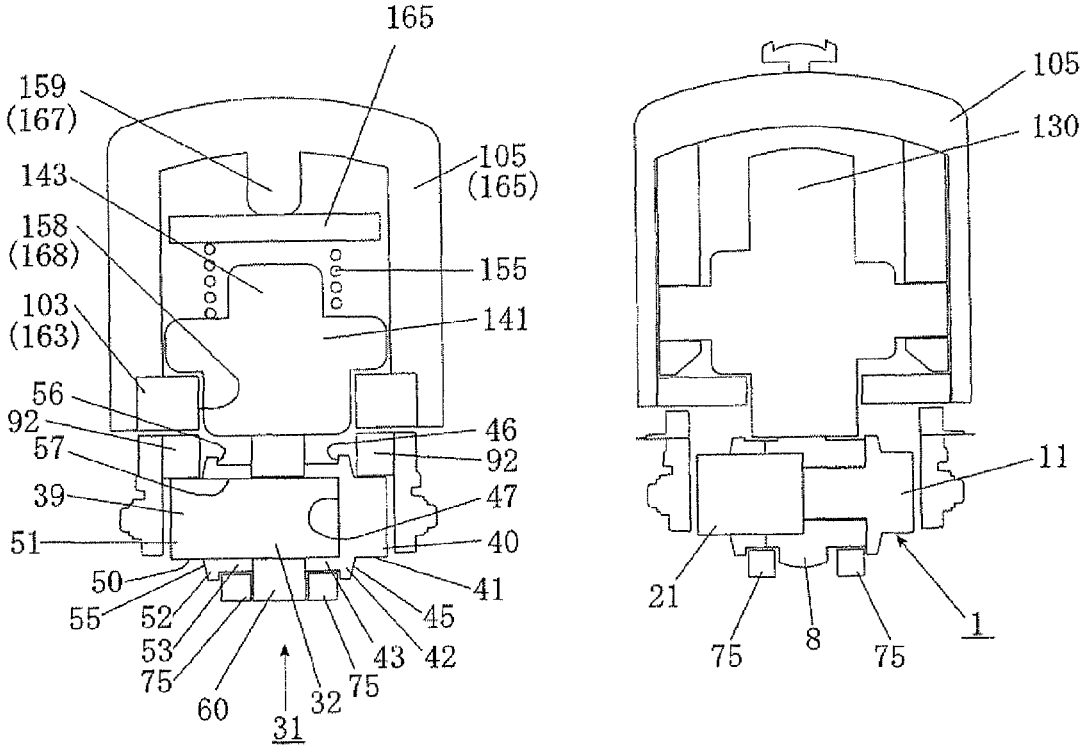
FIGS. 4(*a*) and 4(*b*) are sectional views of the wheel devices for a toy vehicle according to the present invention mounted into a toy vehicle.
Figure 5:
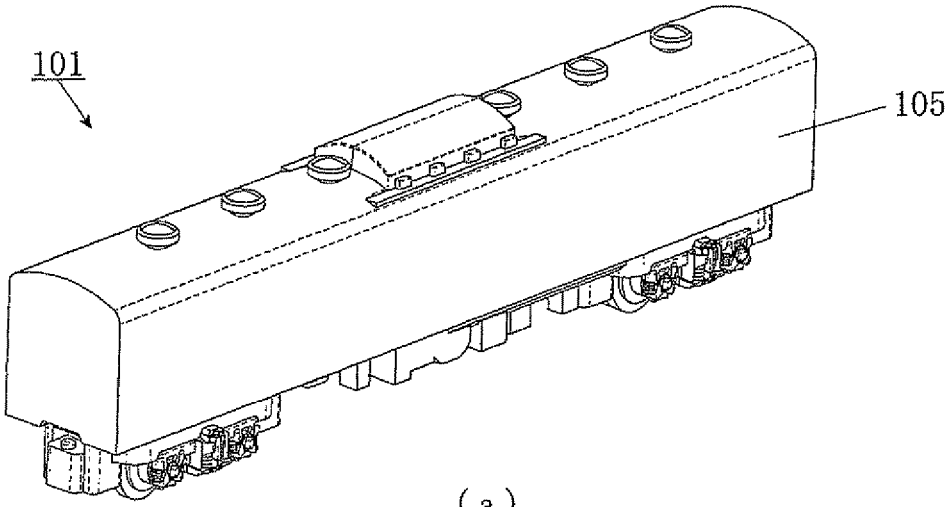
FIGS. 5(*a*) and 5(*b*) are perspective assembly drawings of FIG. 4.
Figure 5:
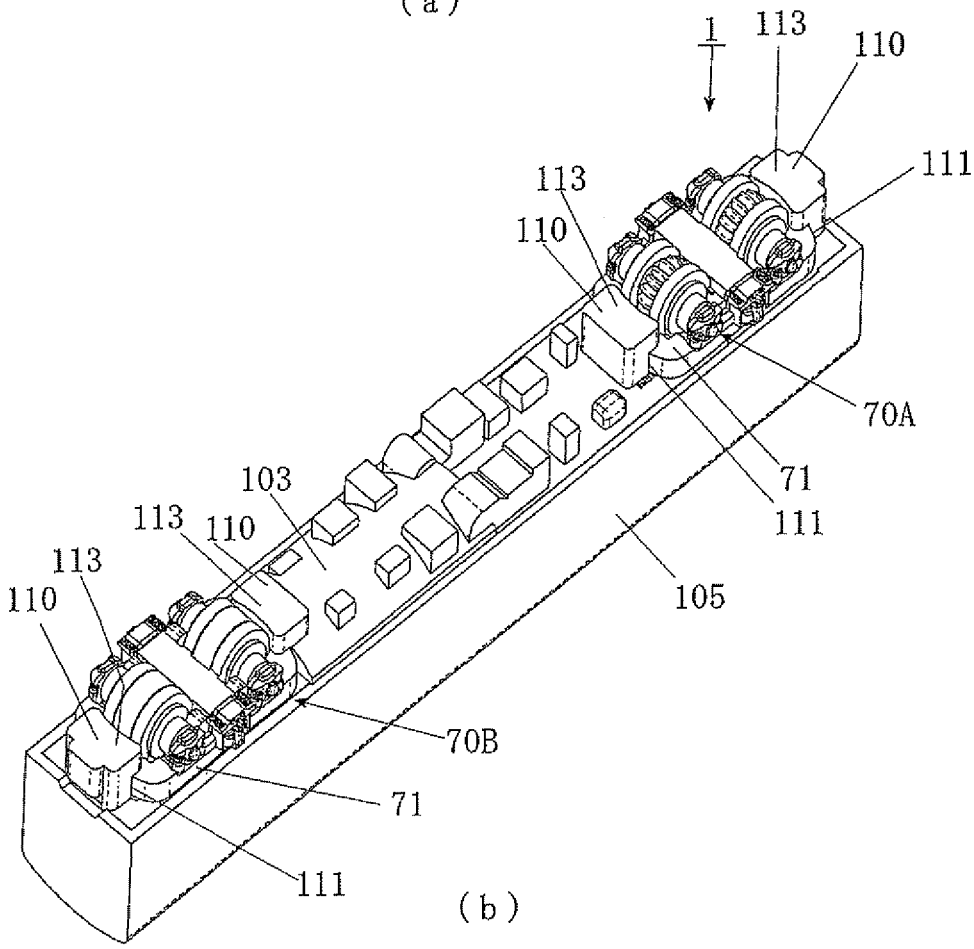
Figure 6:
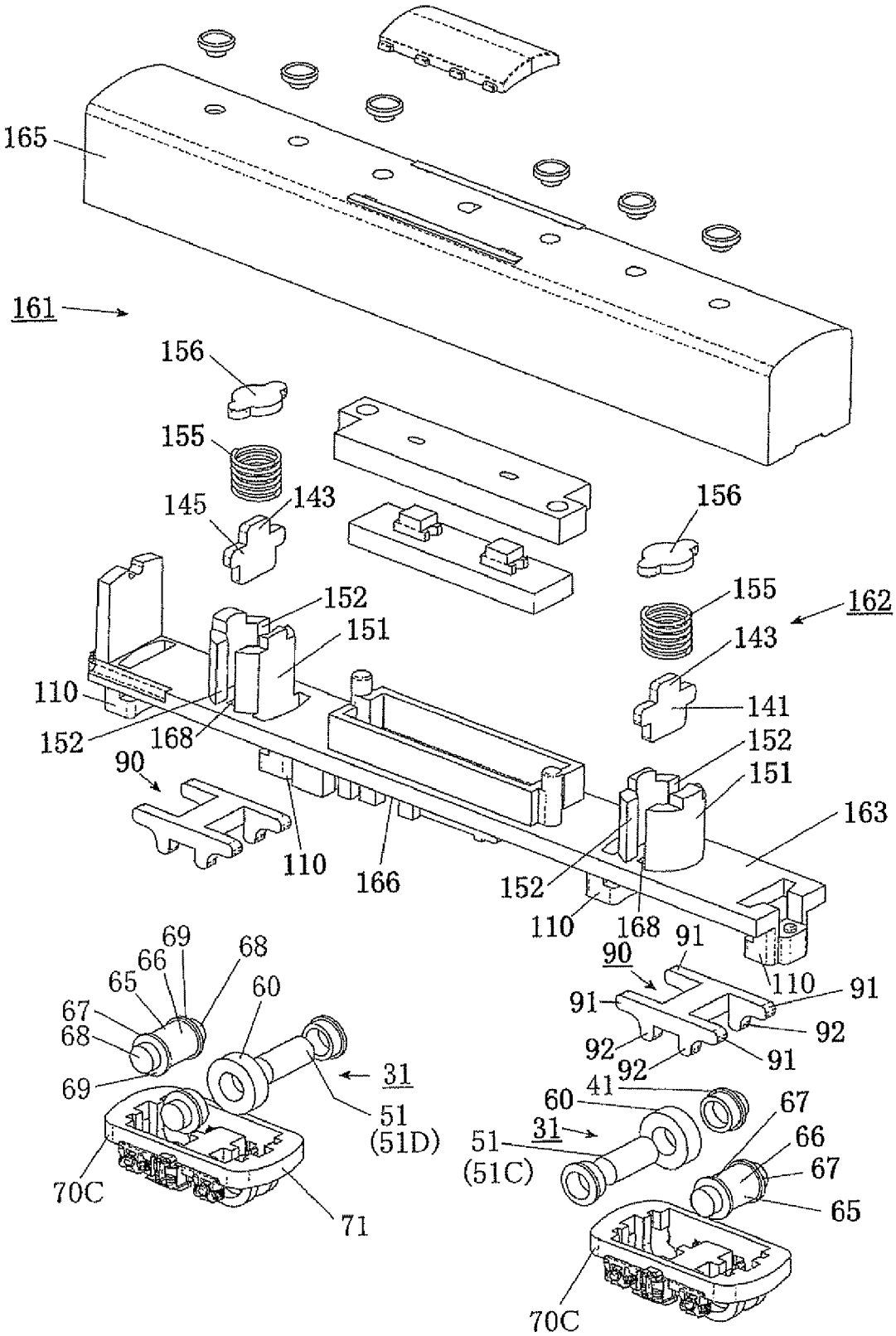
FIG. 6 is an exploded perspective view of other follower wheel devices for a toy vehicle according to the present invention mounted into a toy vehicle.
Figure 7:
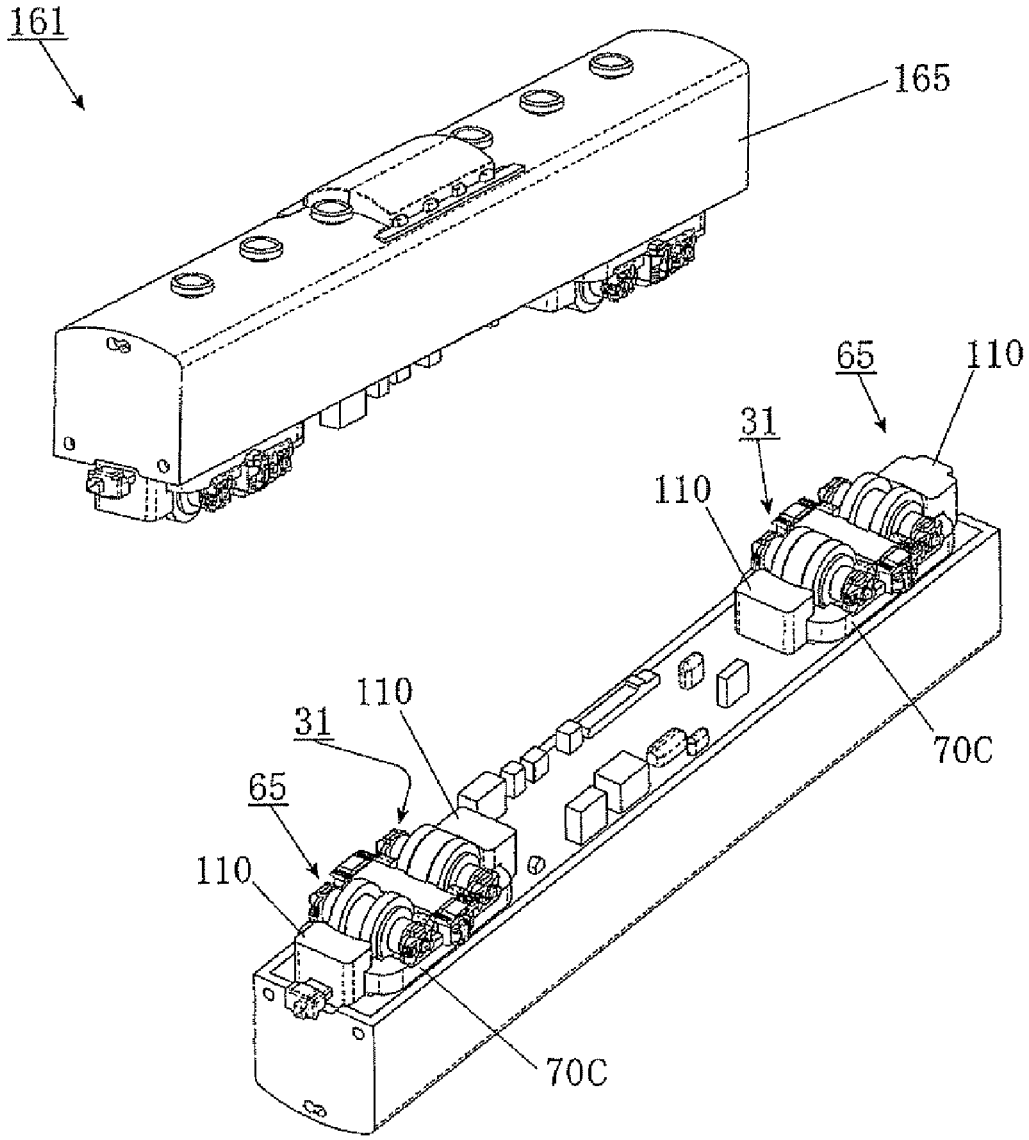
FIG. 7 is a perspective assembly drawing of FIG. 6.
Figure 8:
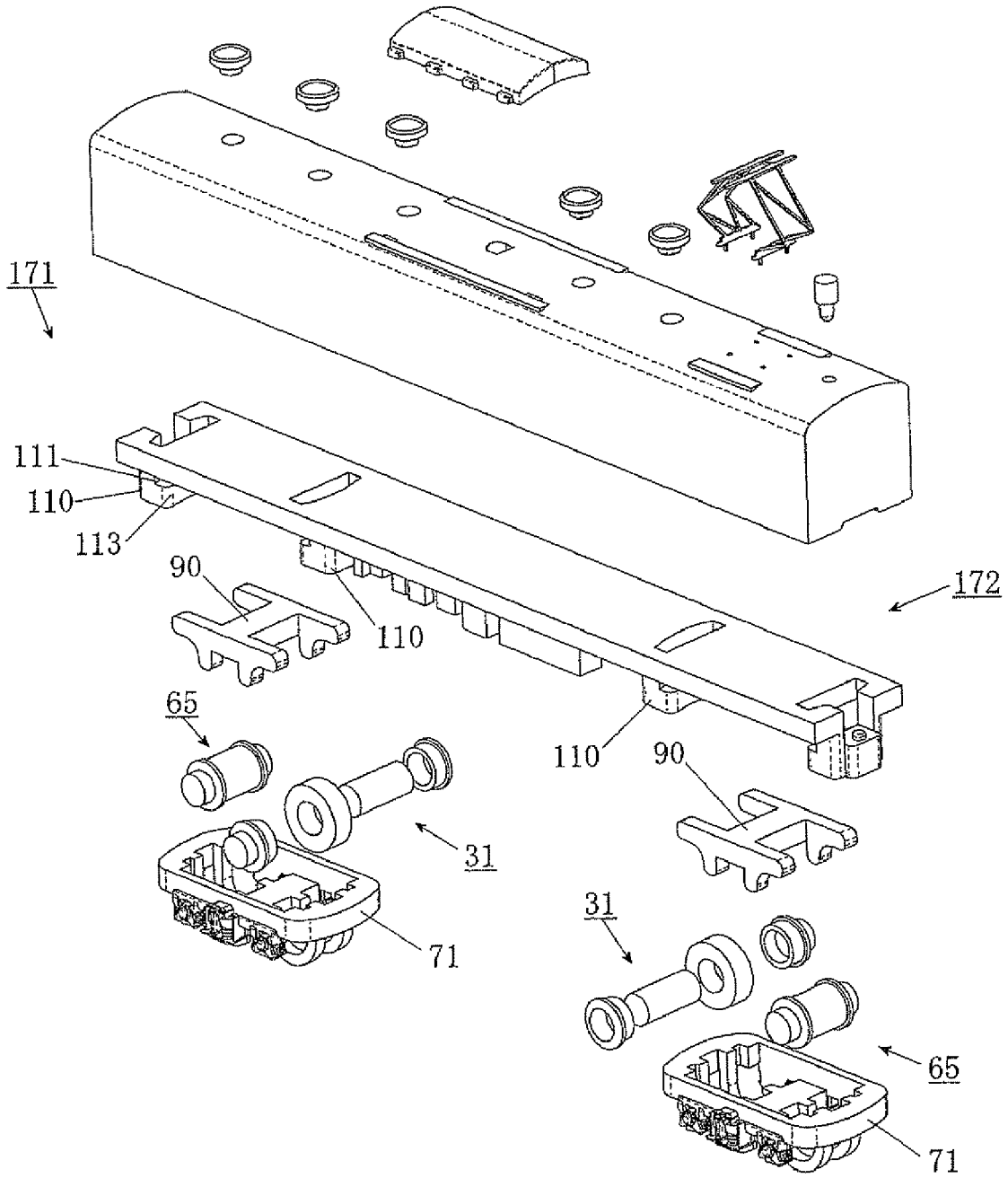
FIG. 8 is an exploded perspective view of other follower wheel devices for a toy vehicle according to the present invention mounted into a toy vehicle.
Figure 9:
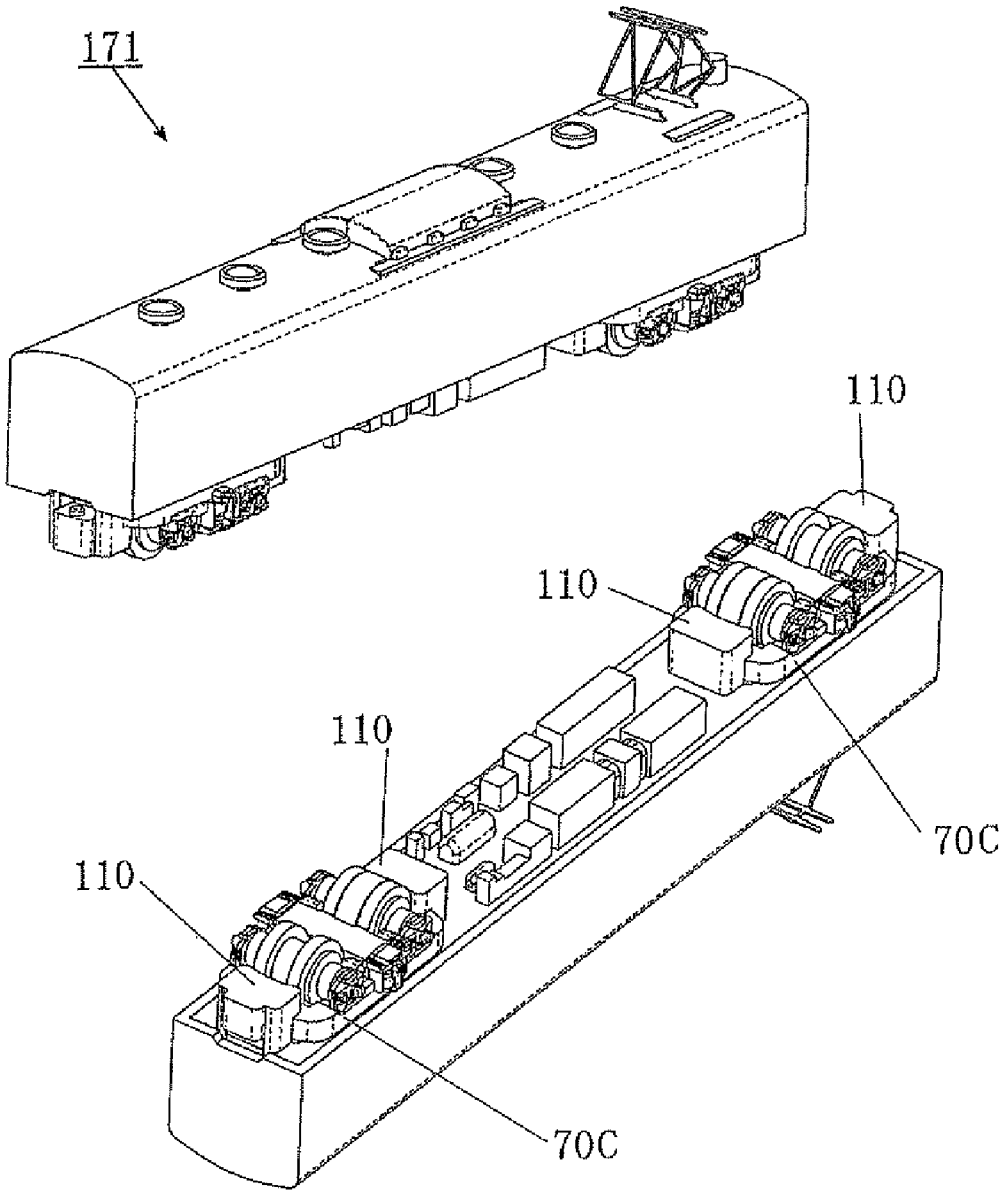
FIG. 9 is a perspective assembly drawing of FIG. 8.
Figure 10:
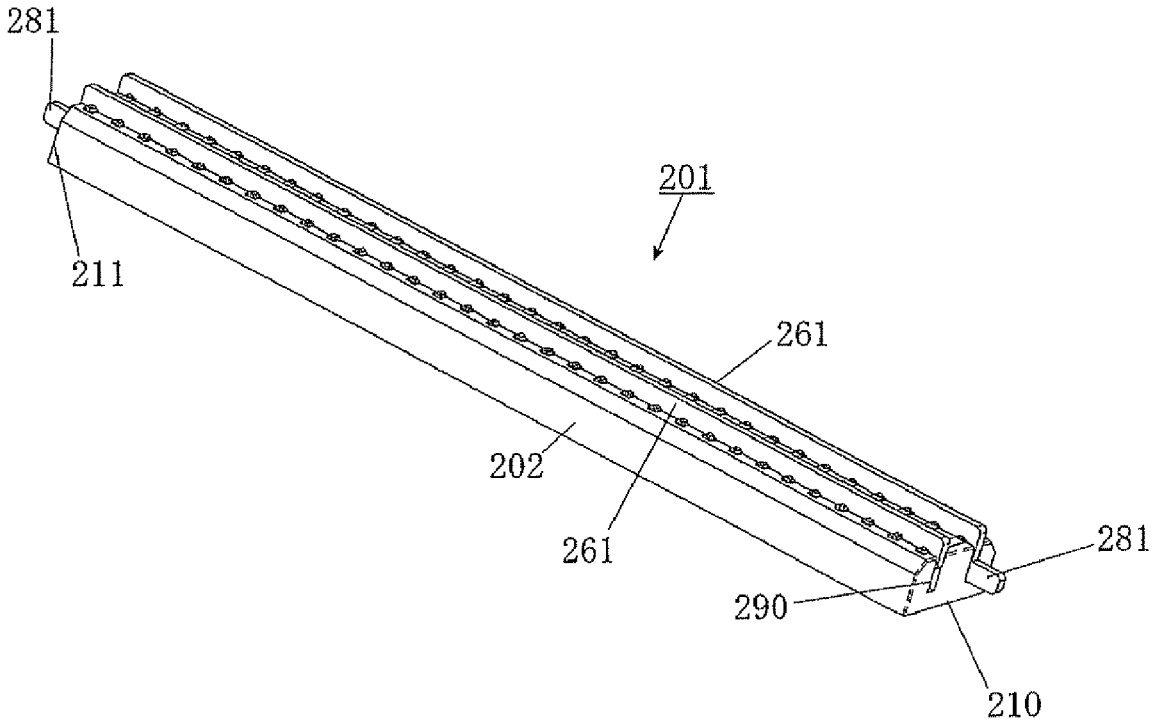
FIG. 10 is a perspective view of an embodiment of a rail track device according to the present invention.
Figure 11:
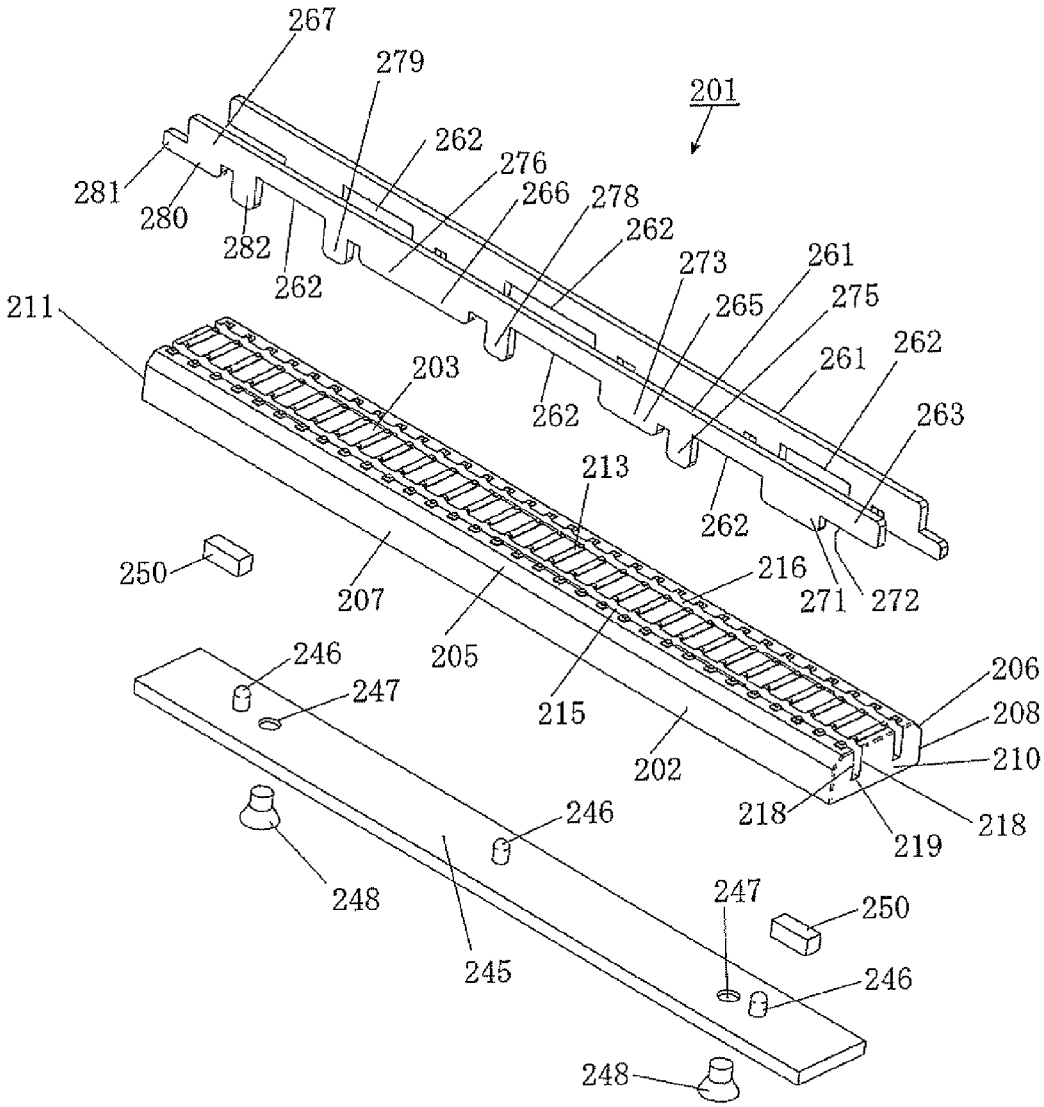
FIG. 11 is an exploded perspective view of FIG. 10.
Figure 12:
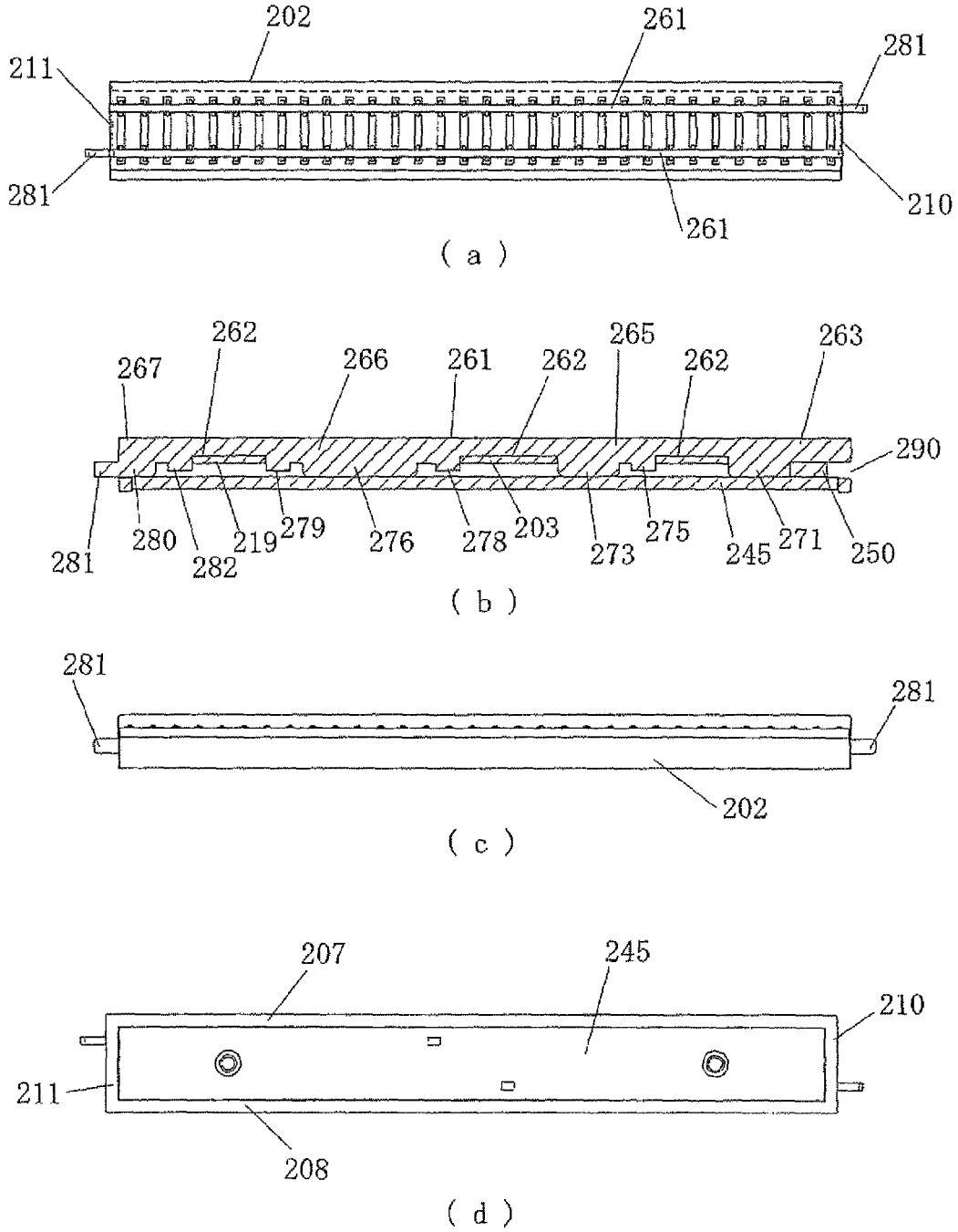
FIGS. 12(*a*) to 12(*d*) are explanatory views of the rail track device.
Figure 13:
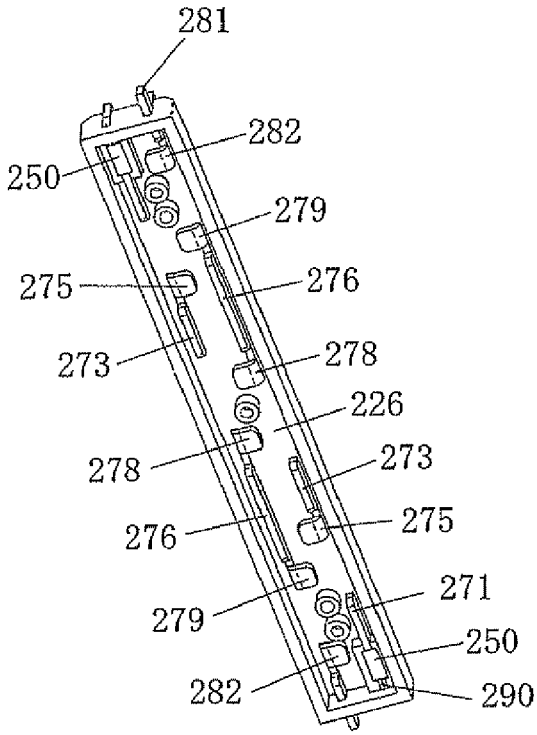
FIGS. 13(*a*) to 13(*c*) are explanatory views of the rail track device from which a bottom plate is detached and which is viewed from below.
Figure 13:
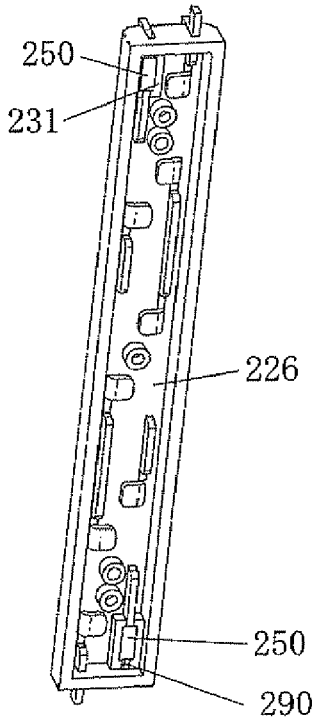
Figure 13:
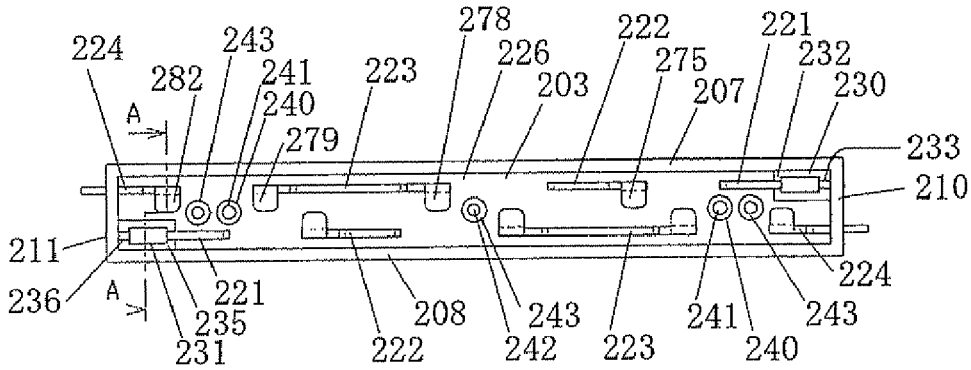
Figure 14:
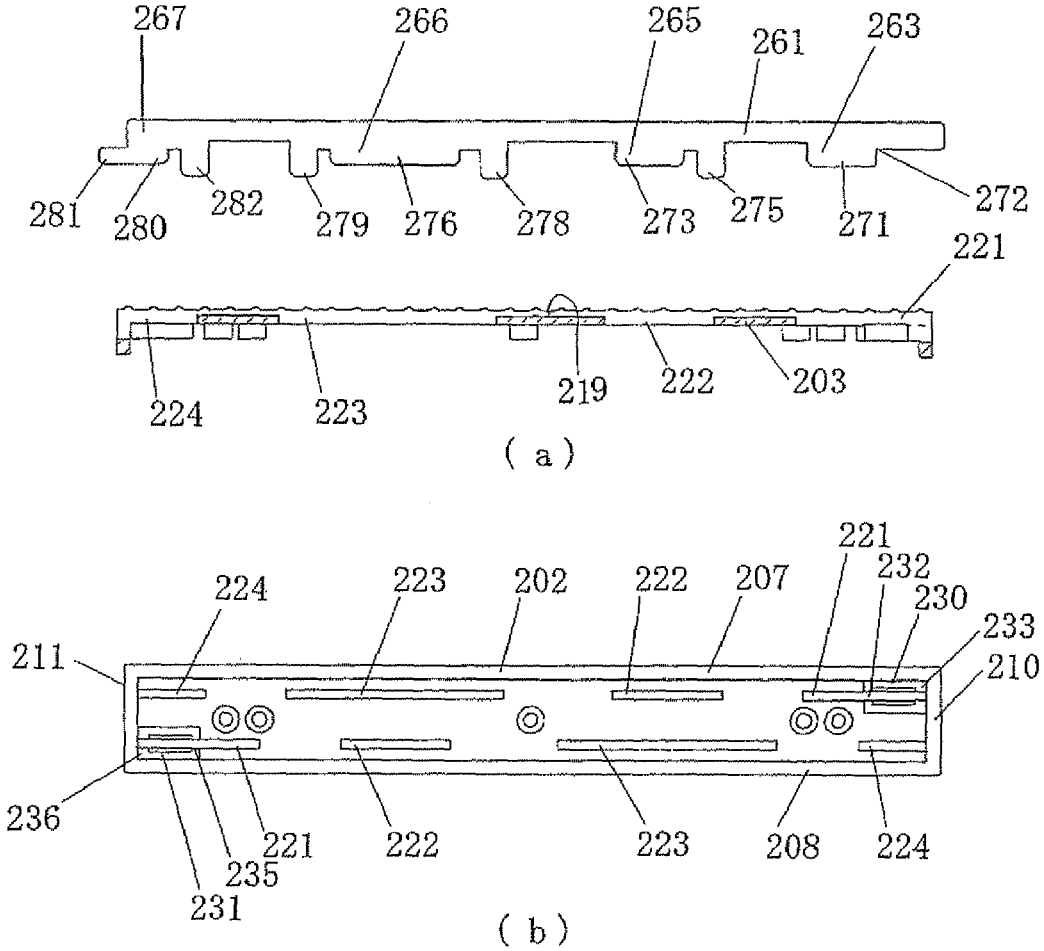
FIGS. 14(*a*) and 14(*b*) are explanatory views for explaining a relationship between a rail track belt and metal rails.
Figure 15:
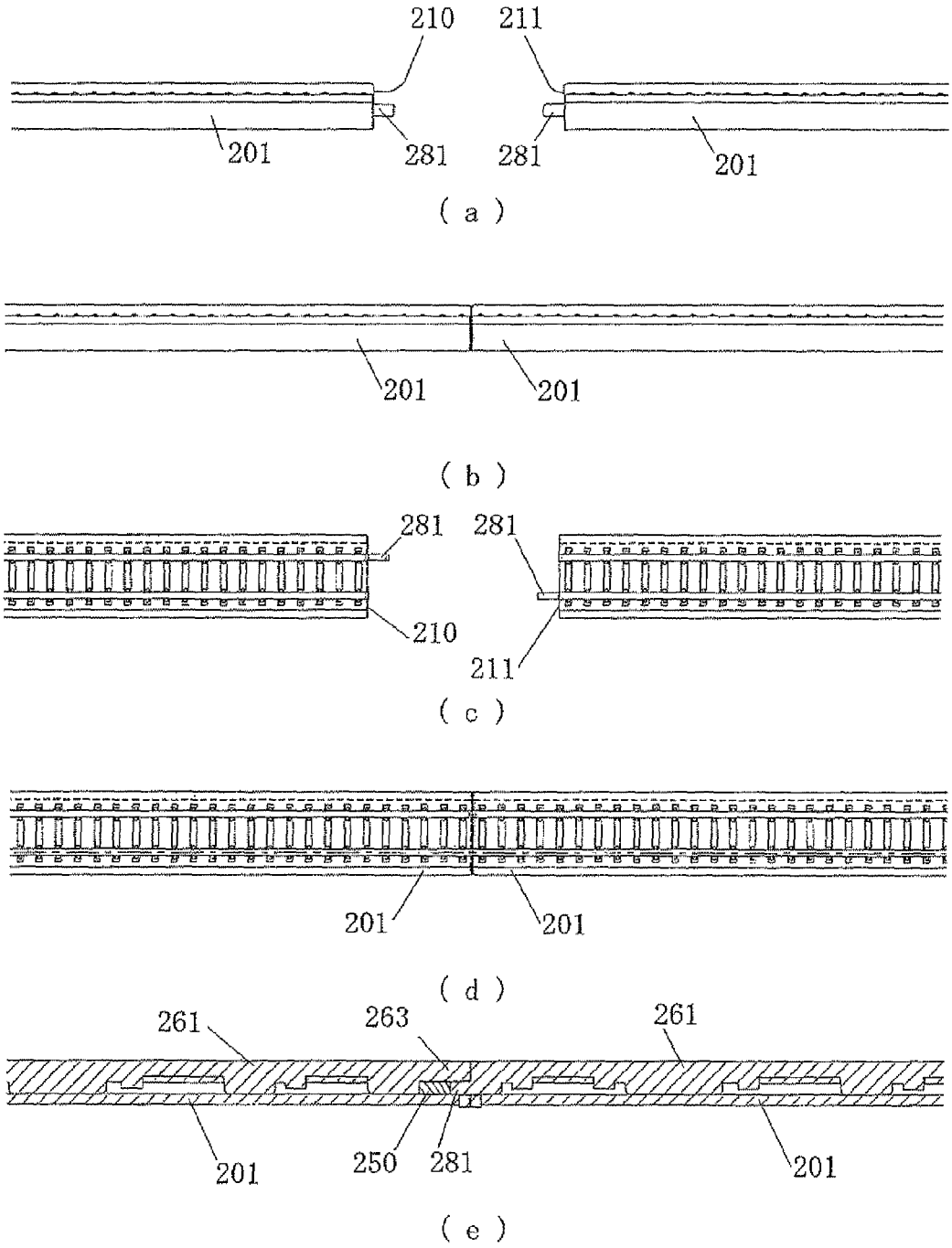
FIGS. 15(*a*) to 15(*e*) are explanatory views showing a method of connecting the rail track devices.
Figure 16:
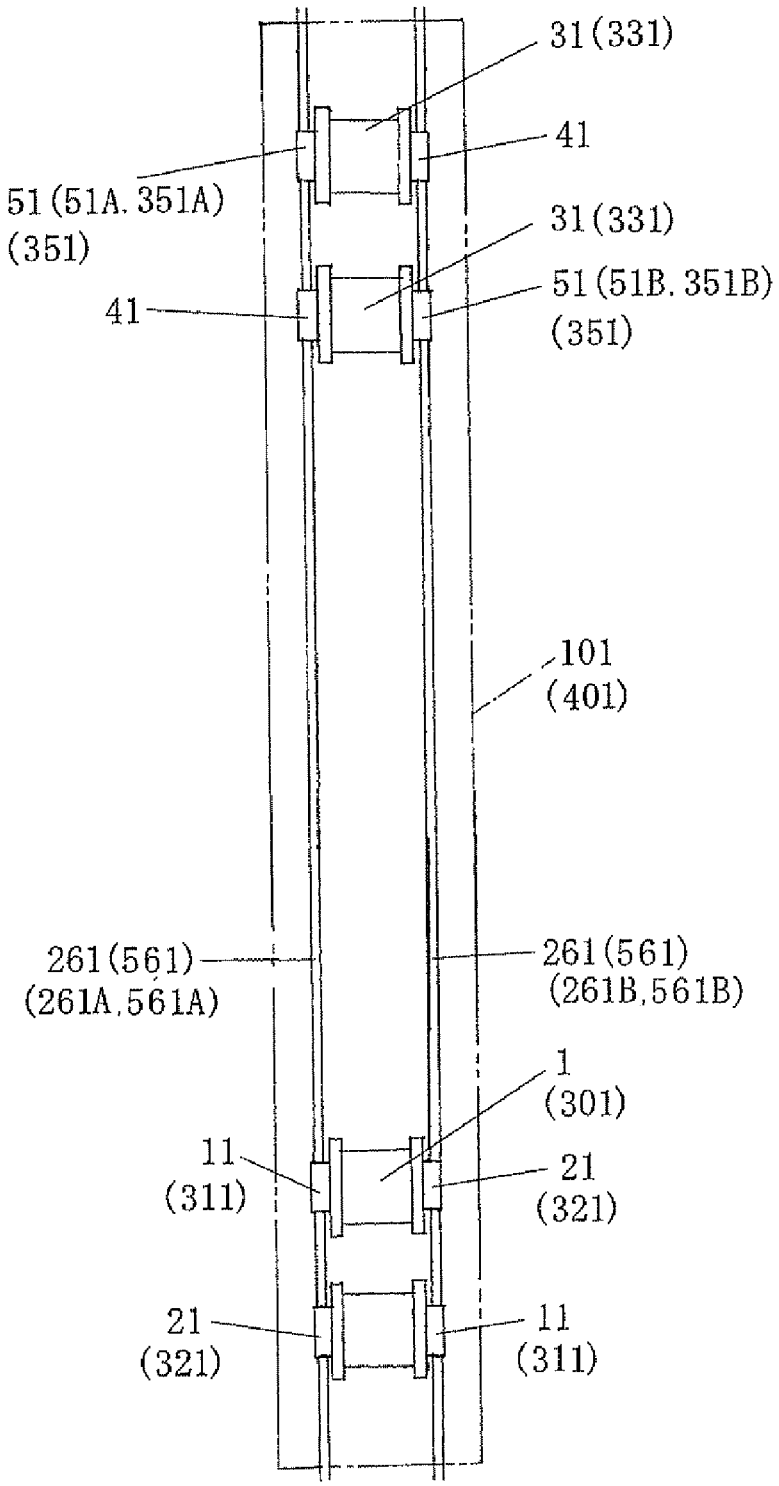
FIG. 16 is a plan view showing a relationship between the metal rails and the wheel devices.
Figure 17:
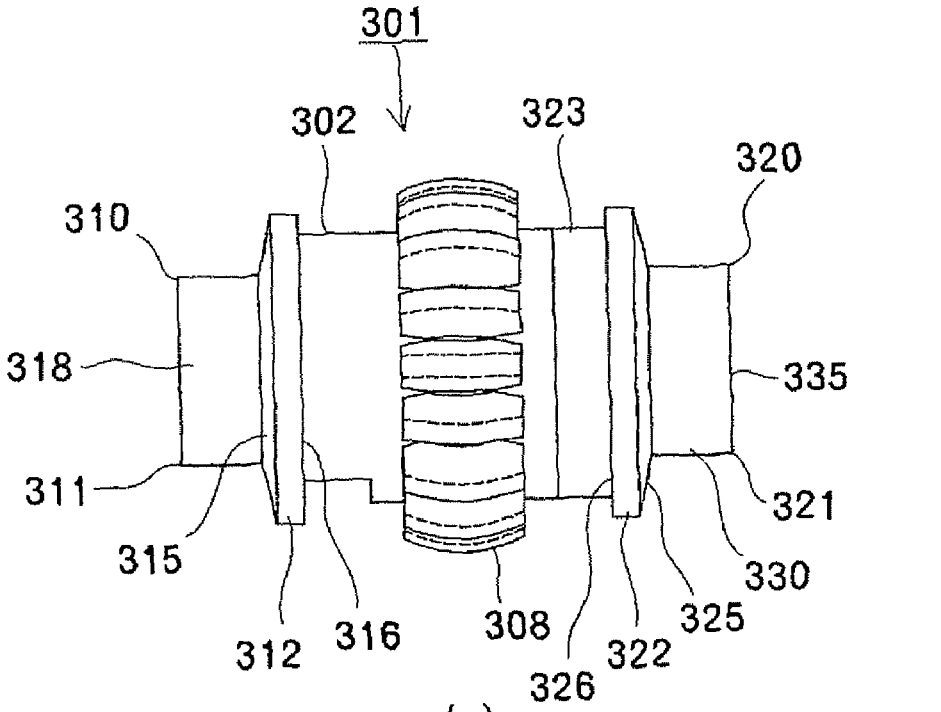
FIGS. 17(*a*) and 17(*b*) are general views of another embodiment of the drive wheel device for a toy vehicle according to the present invention.
Figure 17:
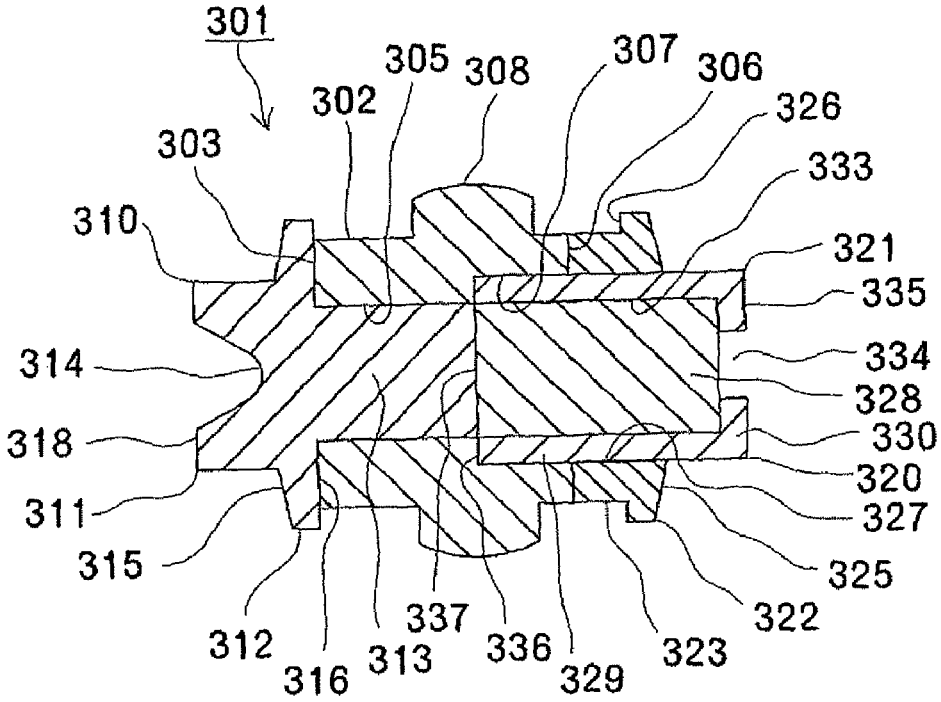
Figure 18:
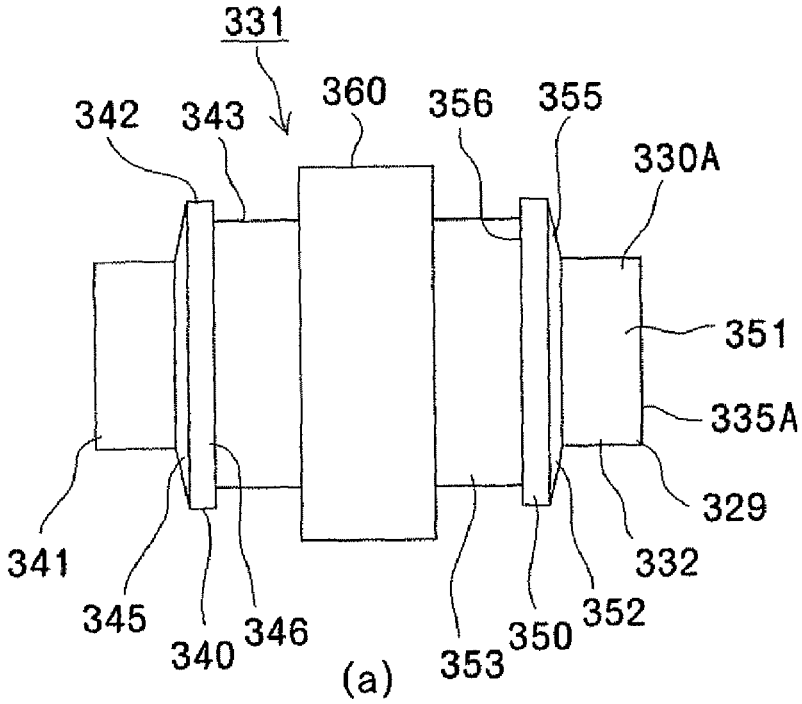
FIGS. 18(*a*) and 18(*b*) are general views of another embodiment of the follower wheel device for a toy vehicle according to the present invention.
Figure 18:
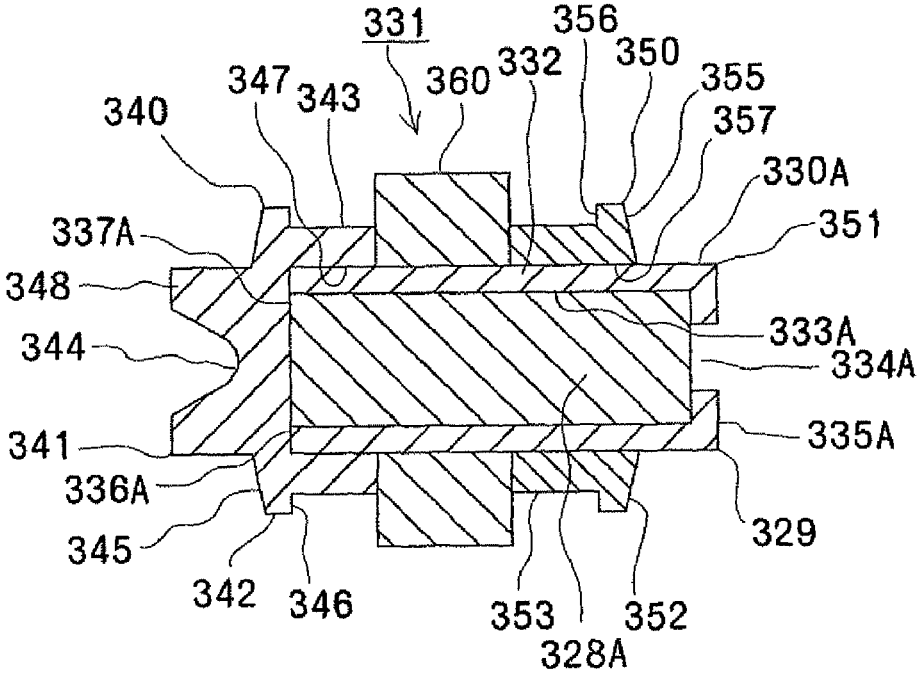
Figure 19:
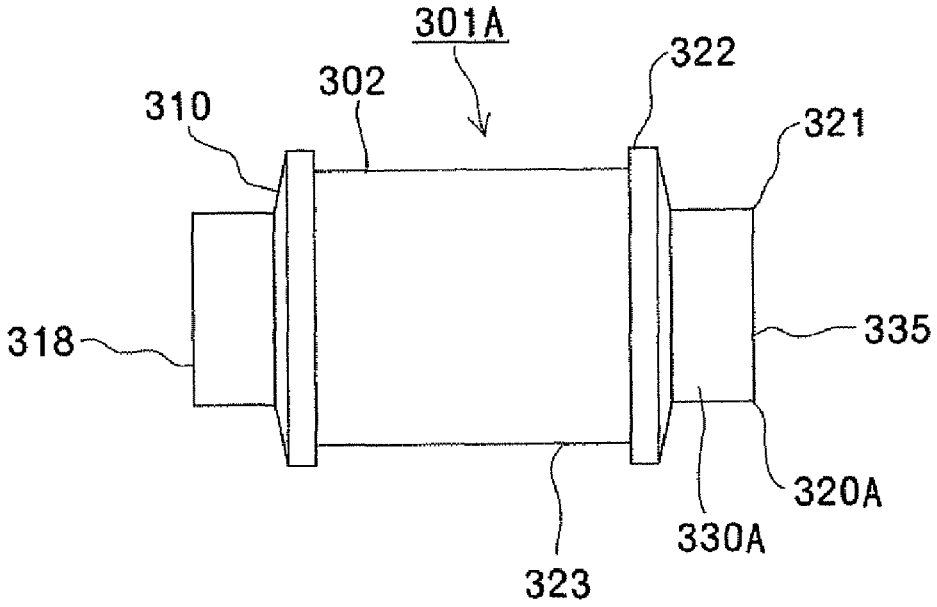
FIGS. 19(*a*) and 19(*b*) are general views of another embodiment of the follower wheel device for a toy vehicle according to the present invention.
Figure 19:
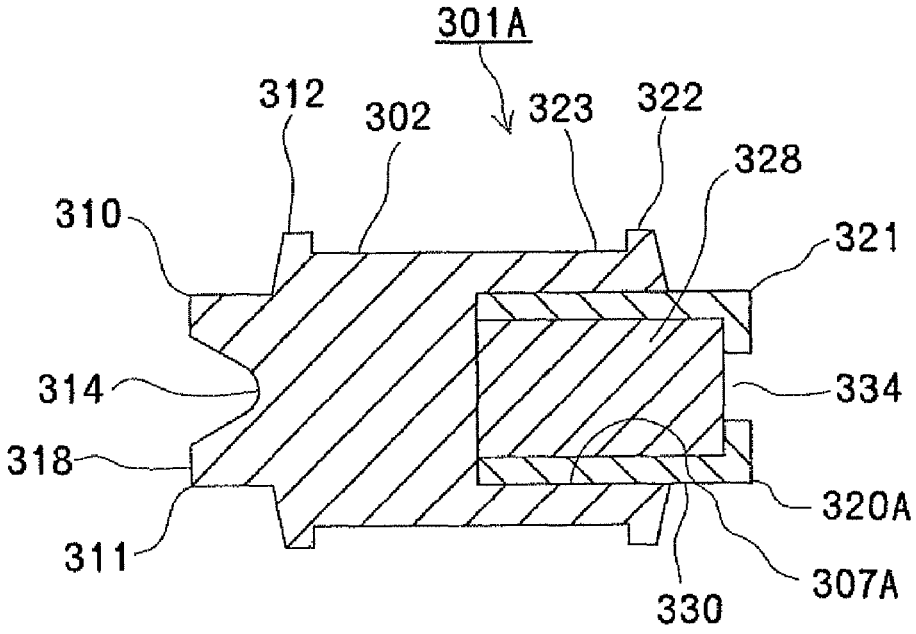
Figure 20:
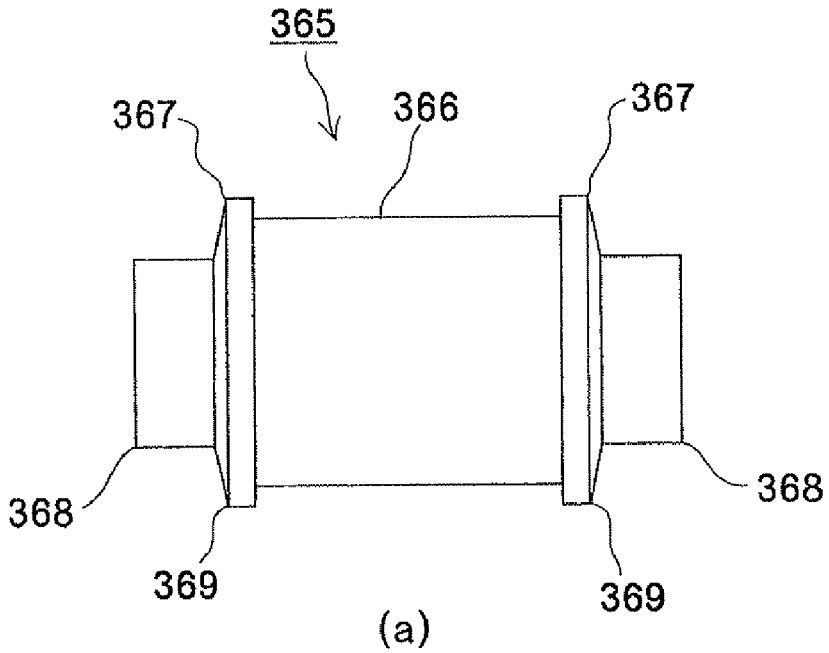
FIGS. 20(*a*) and 20(*b*) are general views of another embodiment of the follower wheel device for a toy vehicle according to the present invention.
Figure 20:
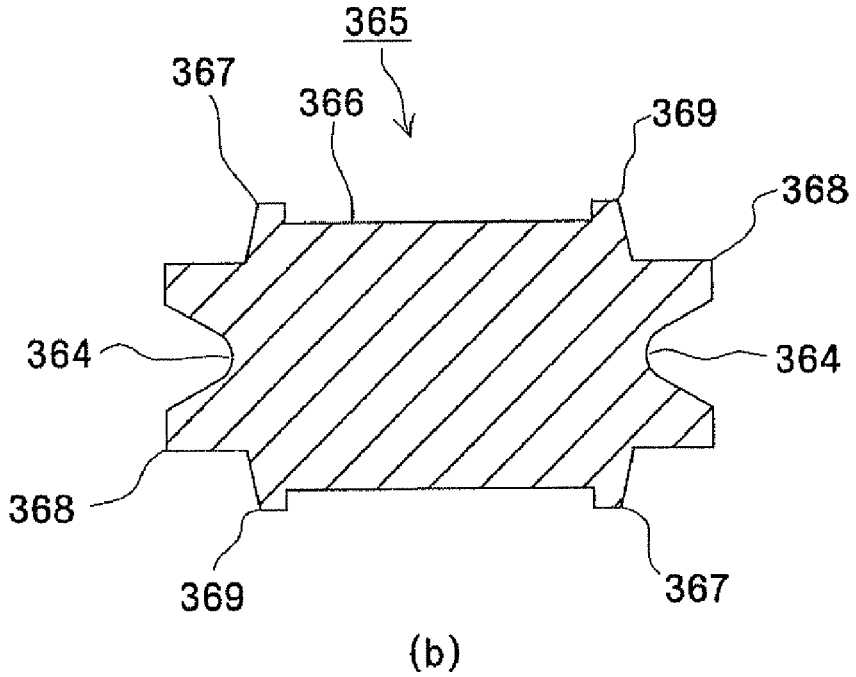
Figure 21:
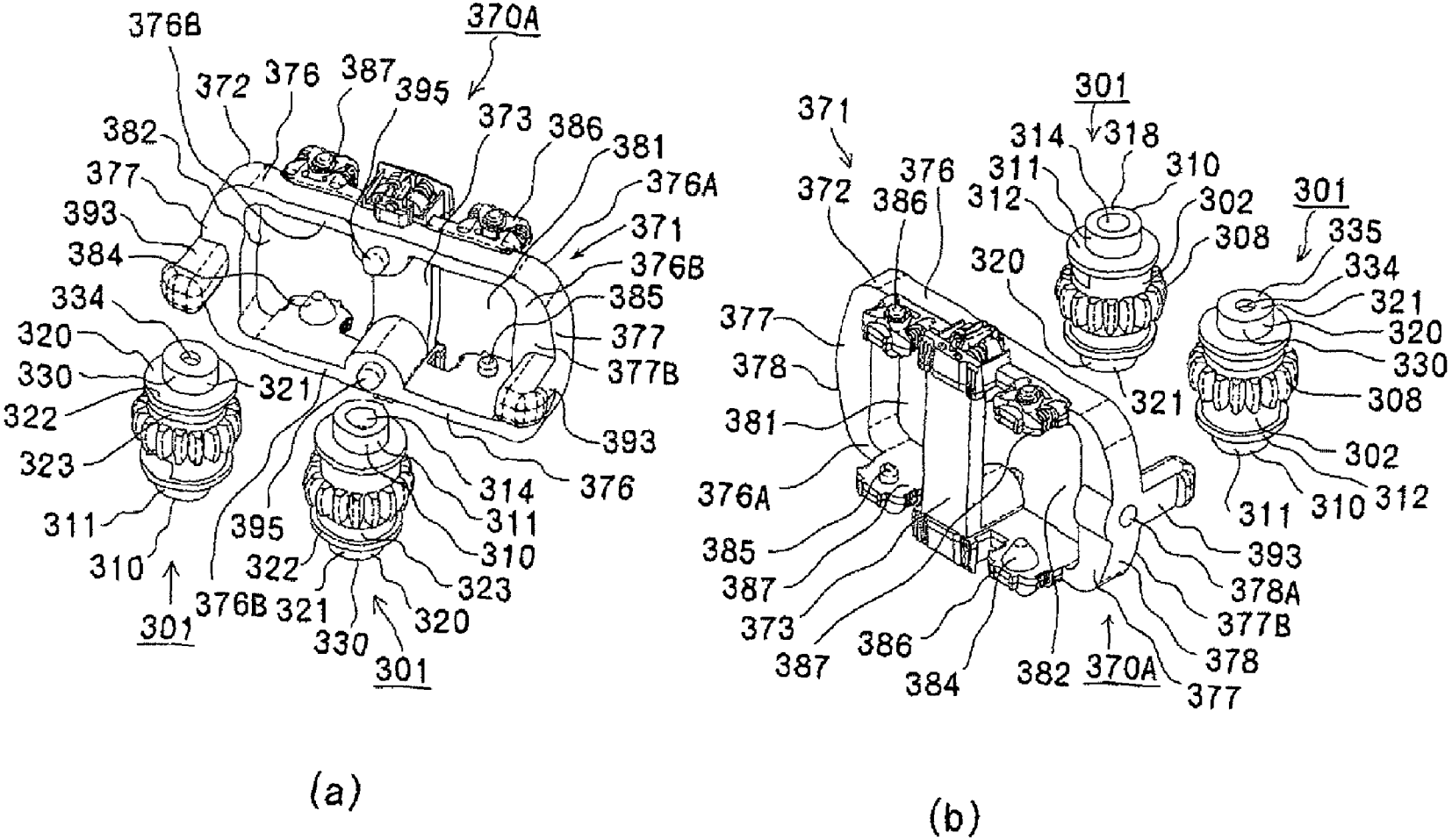
FIGS. 21(*a*) and 21(*b*) are exploded perspective views of the drive wheel devices for a toy vehicle according to the present invention mounted into a carriage.
Figure 22:
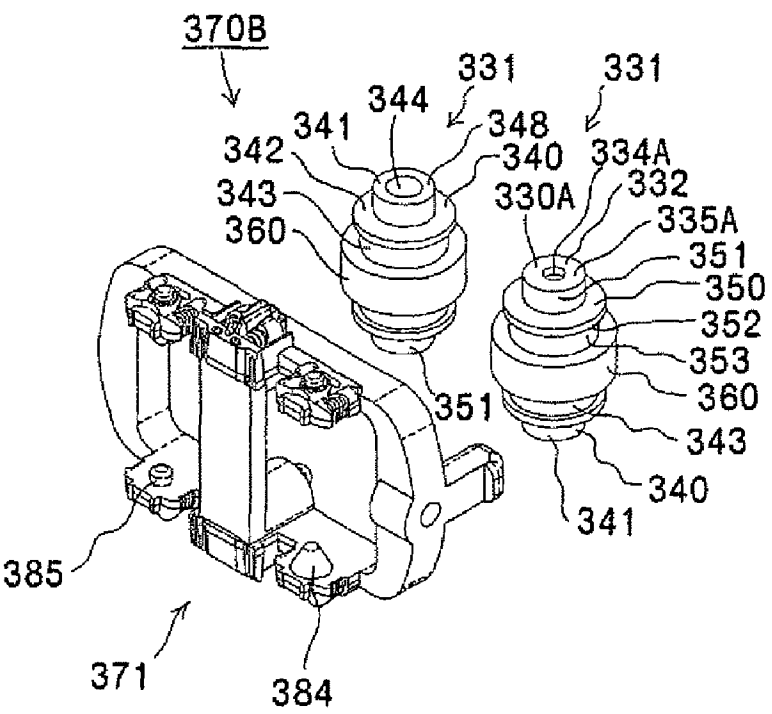
FIGS. 22(*a*) and 22(*b*) are exploded perspective views of the follower wheel devices for a toy vehicle according to the present invention mounted into a carriage.
Figure 22:
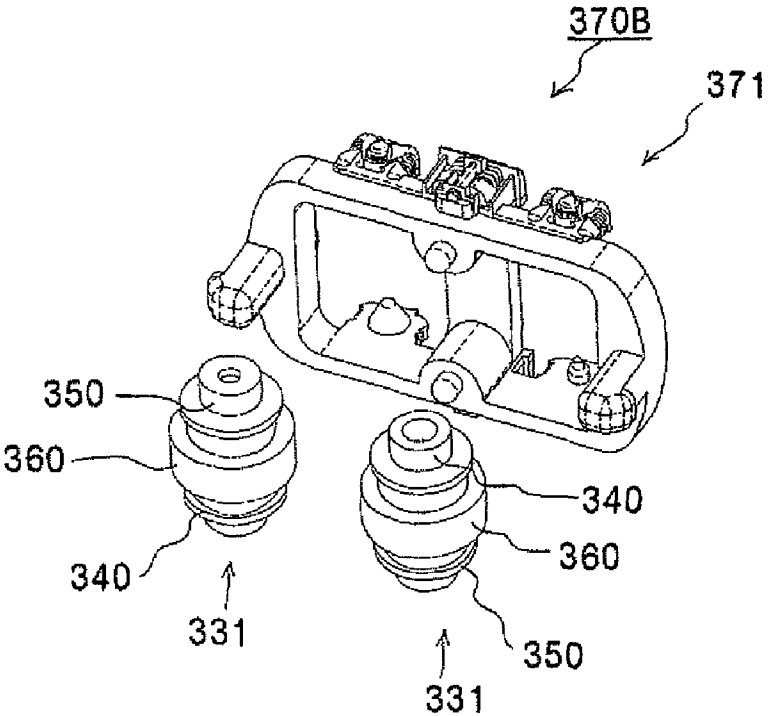
Figure 23:
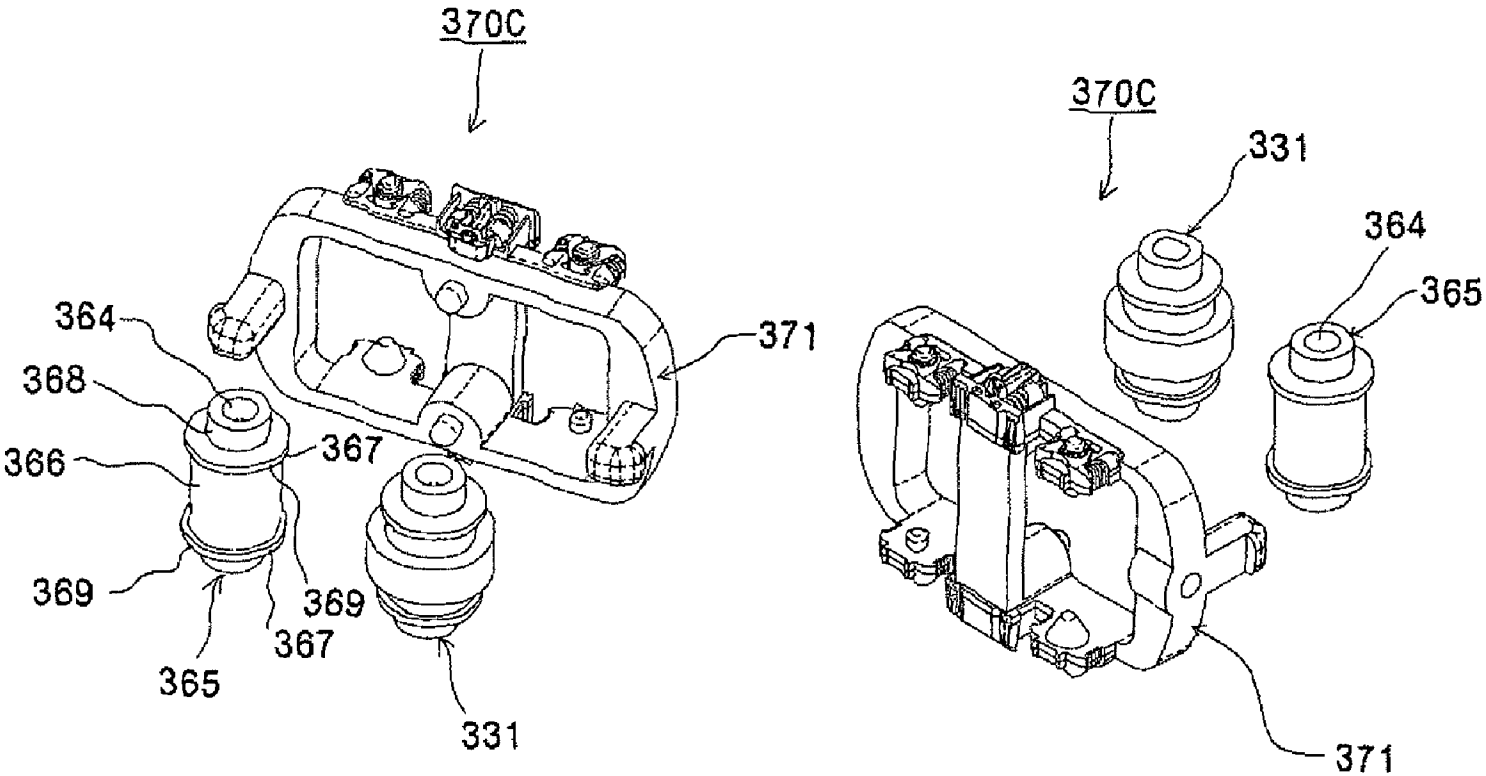
FIGS. 23(*a*) and 23(*b*) are exploded perspective views of the follower wheel devices for a toy vehicle according to the present invention mounted into a carriage.
Figure 24:
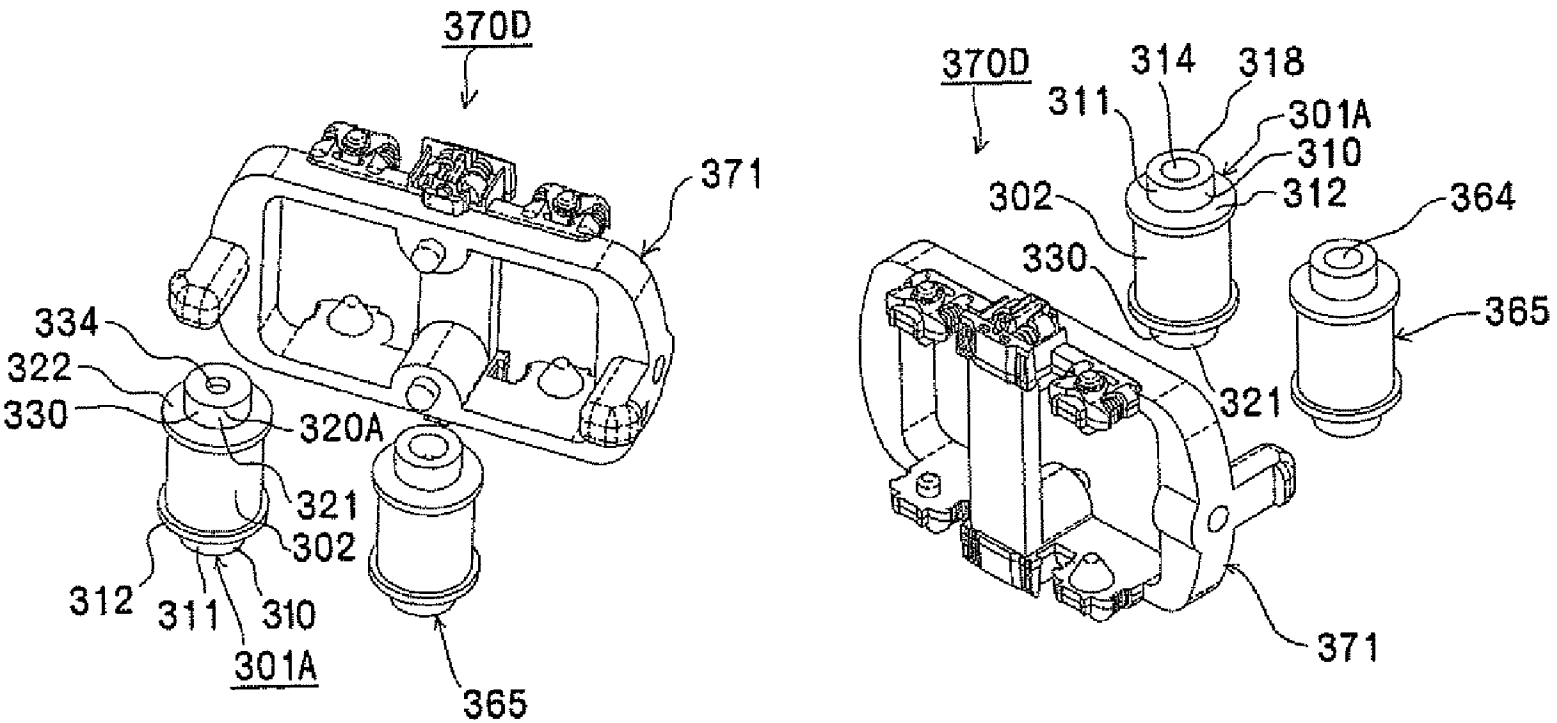
FIGS. 24(*a*) and 24(*b*) are exploded perspective views of the follower wheel devices for a toy vehicle according to the present invention mounted into a carriage.
Figure 25:
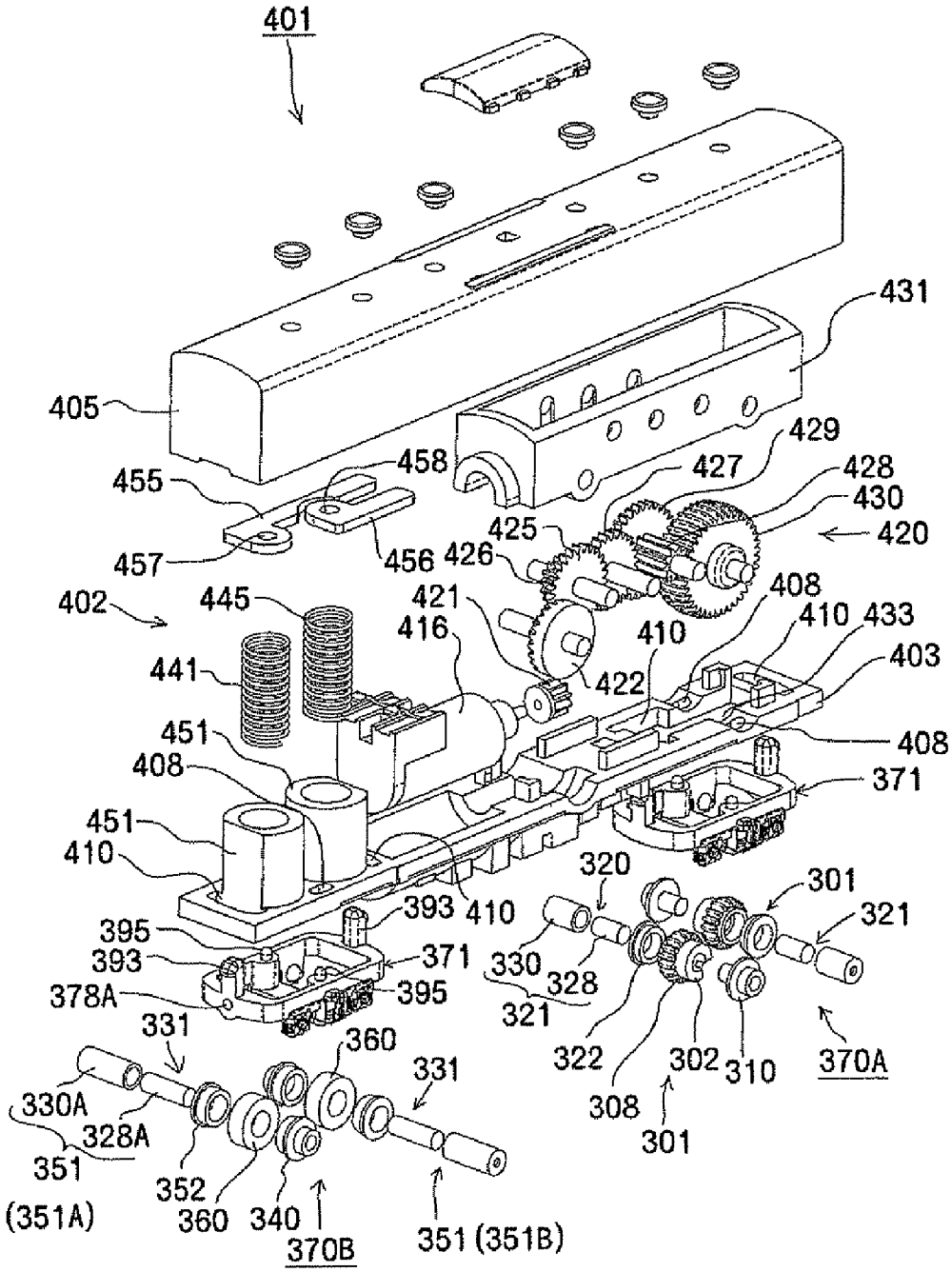
FIG. 25 is an exploded perspective view of the drive wheel devices and the follower wheel devices for a toy vehicle according to the present invention mounted into a toy vehicle.
Figure 26:
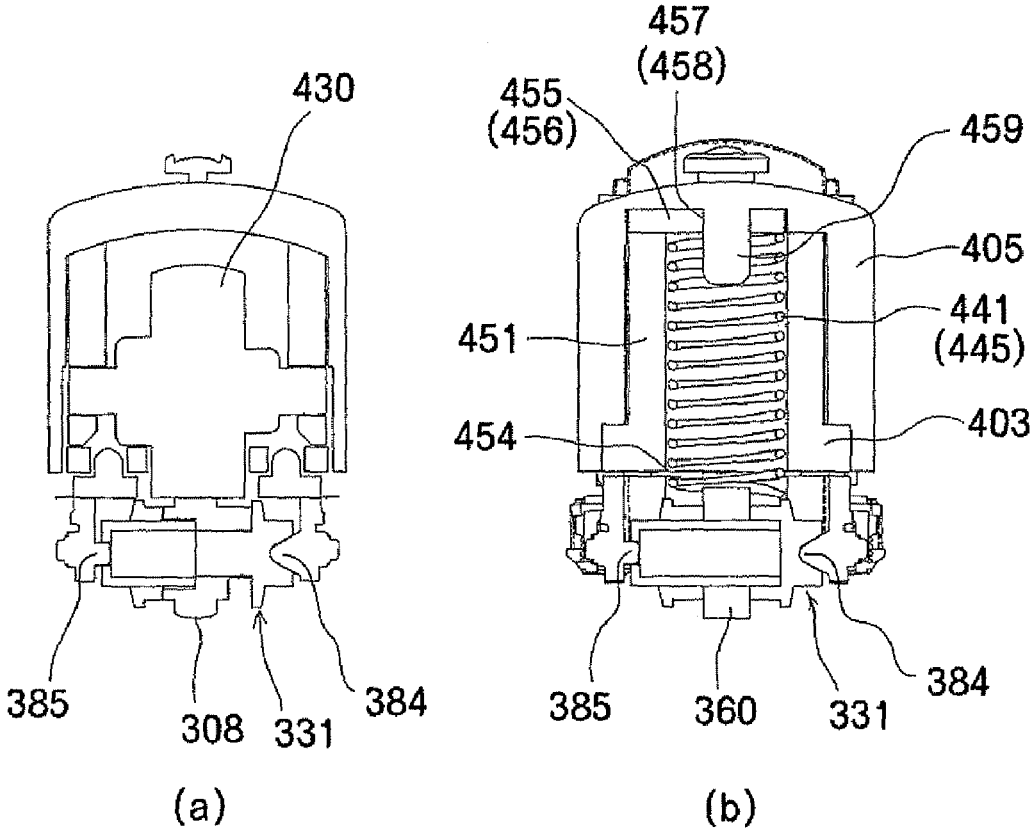
FIGS. 26(*a*) and 26(*b*) are sectional views of the wheel devices for a toy vehicle according to the present invention mounted into a toy vehicle.
Figure 27:
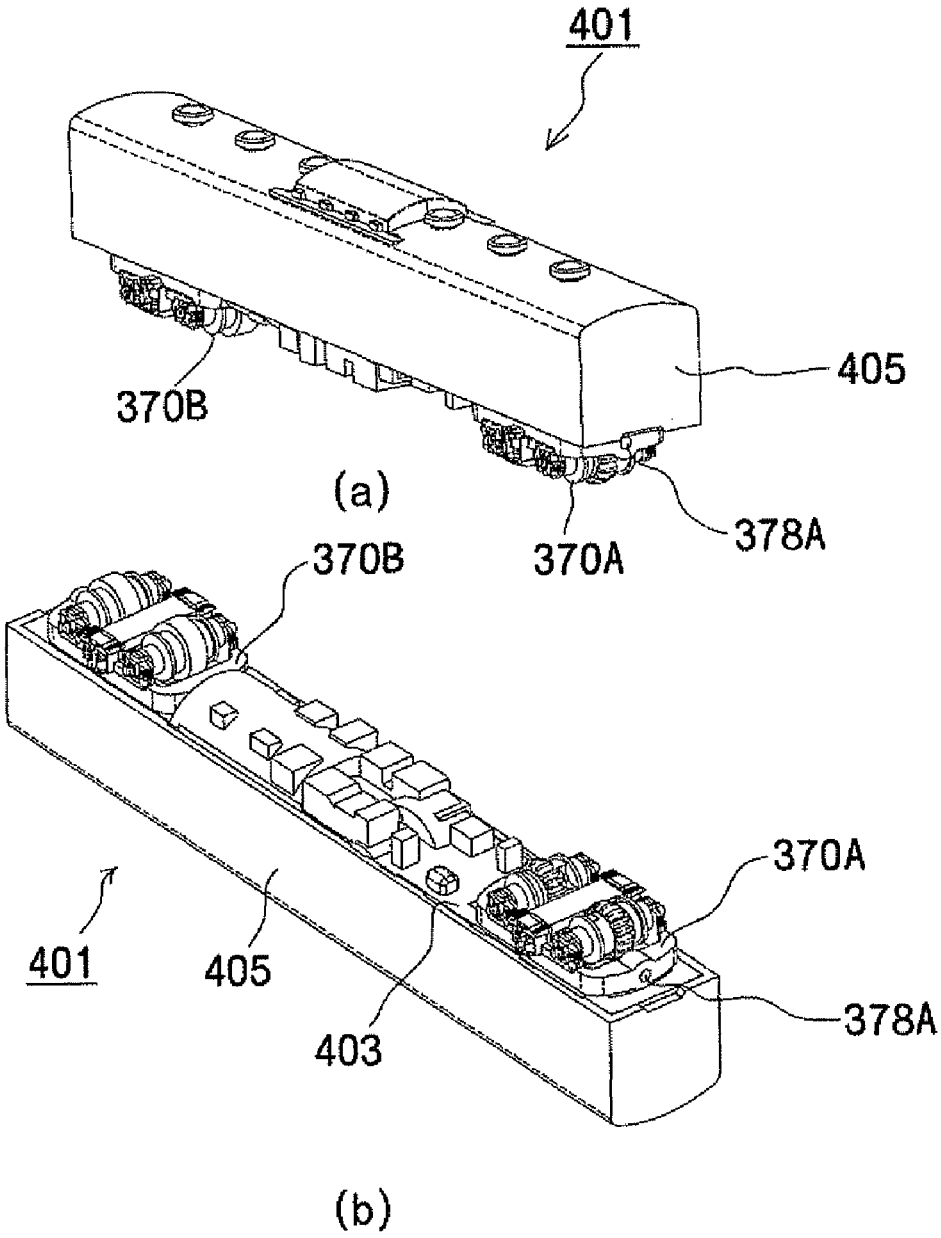
FIGS. 27(*a*) and 27(*b*) are assembly drawings of FIG. 25.
Figure 28:
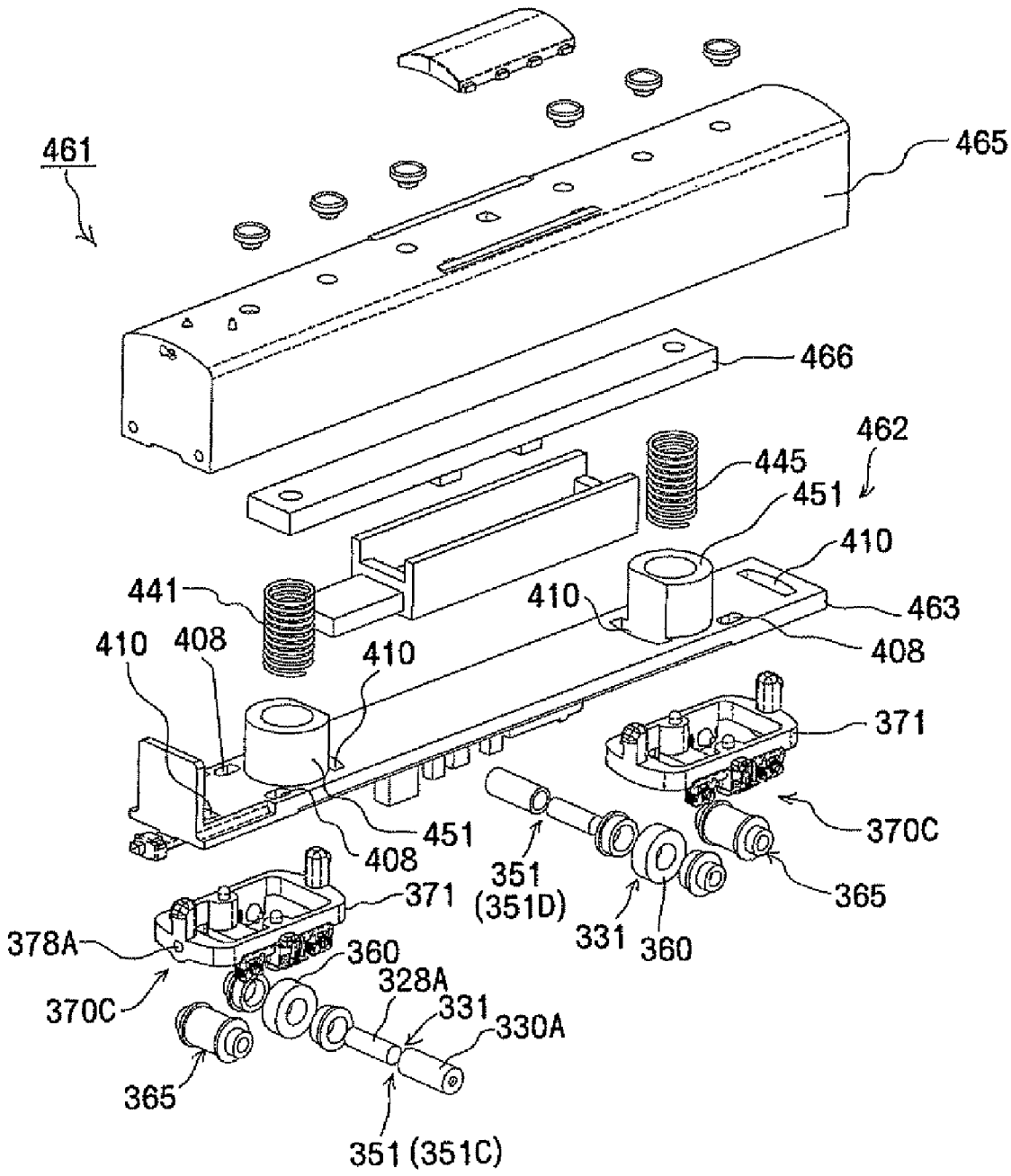
FIG. 28 is an exploded perspective view of other follower wheel devices for a toy vehicle according to the present invention mounted into a toy vehicle.
Figure 29:
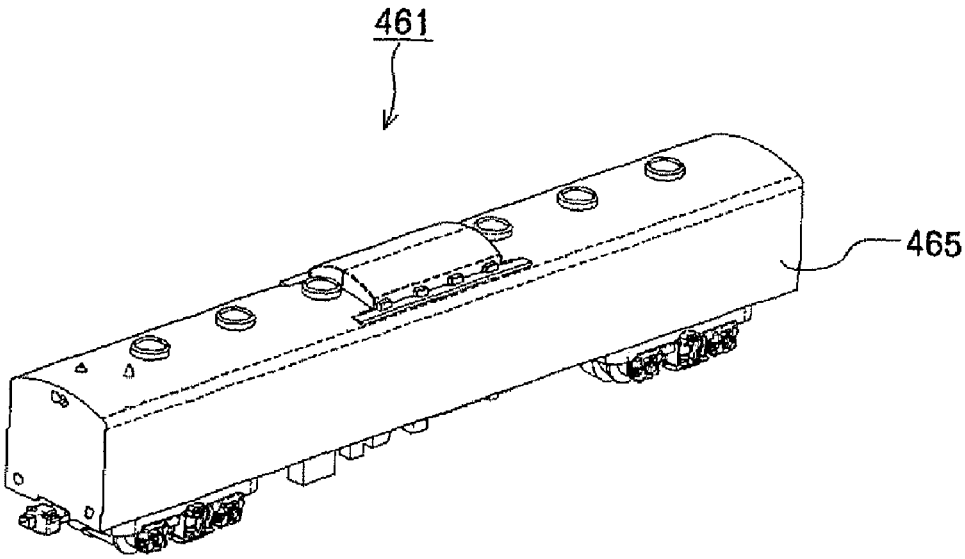
FIGS. 29(*a*) and 29(*b*) are assembly drawings of FIG. 28.
Figure 29:
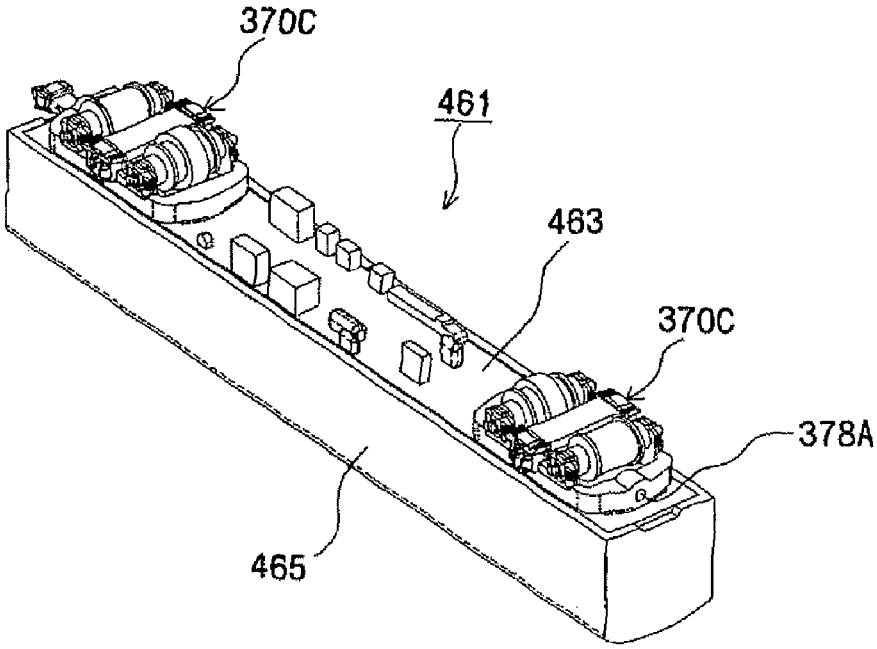
Figure 30:
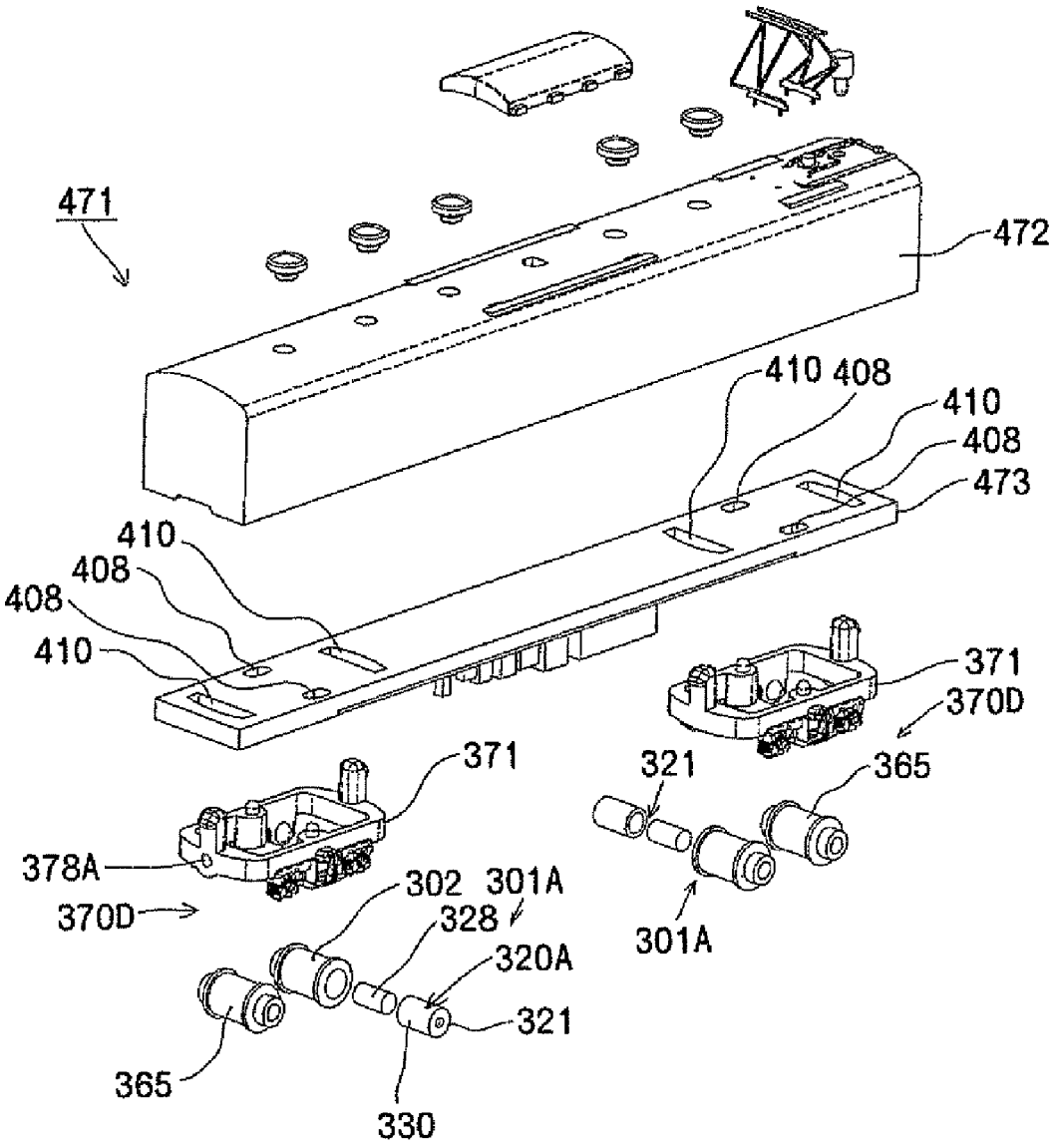
FIG. 30 is an exploded perspective view of other follower wheel devices for a toy vehicle according to the present invention mounted into a toy vehicle.
Figure 31:
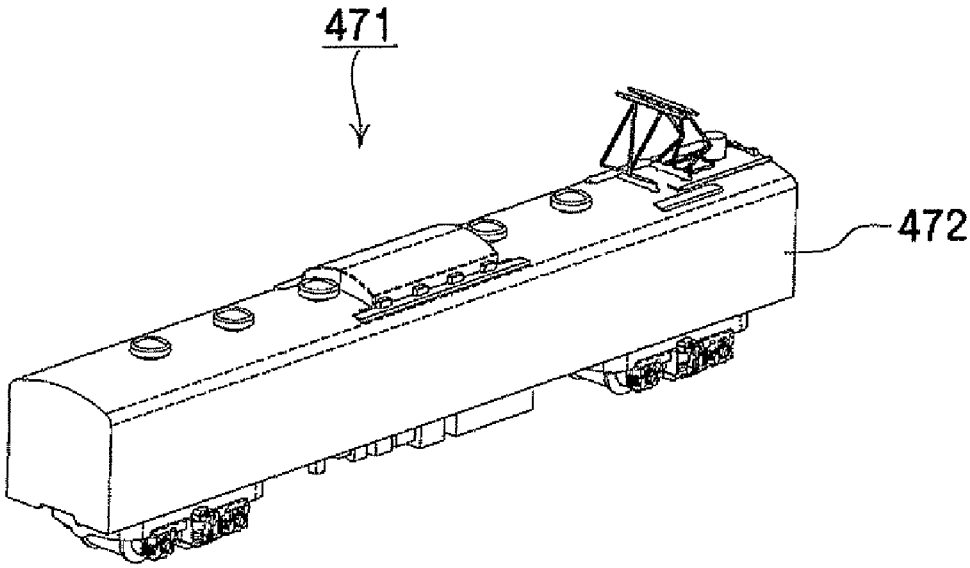
FIGS. 31(*a*) and 31(*b*) are assembly drawings of FIG. 30.
Figure 31:
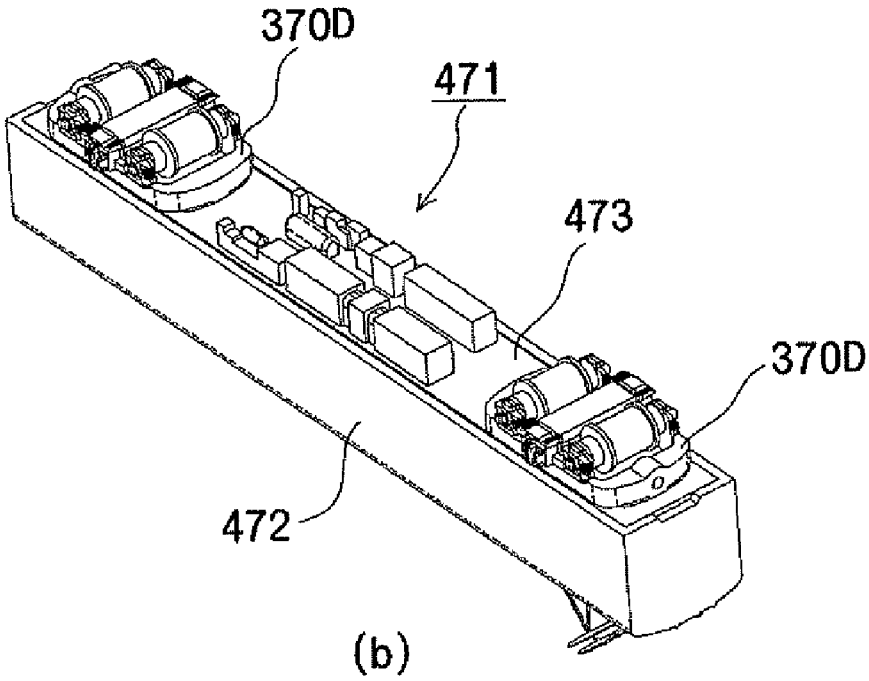
Figure 32:
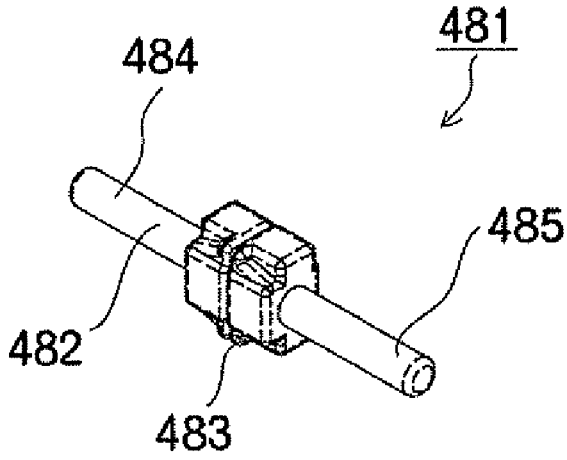
FIGS. 32(*a*) and 32(*b*) are perspective views of a coupler.
Figure 32:
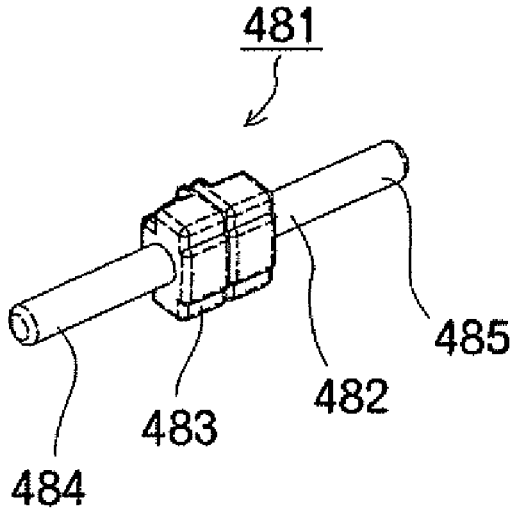
Figure 33:
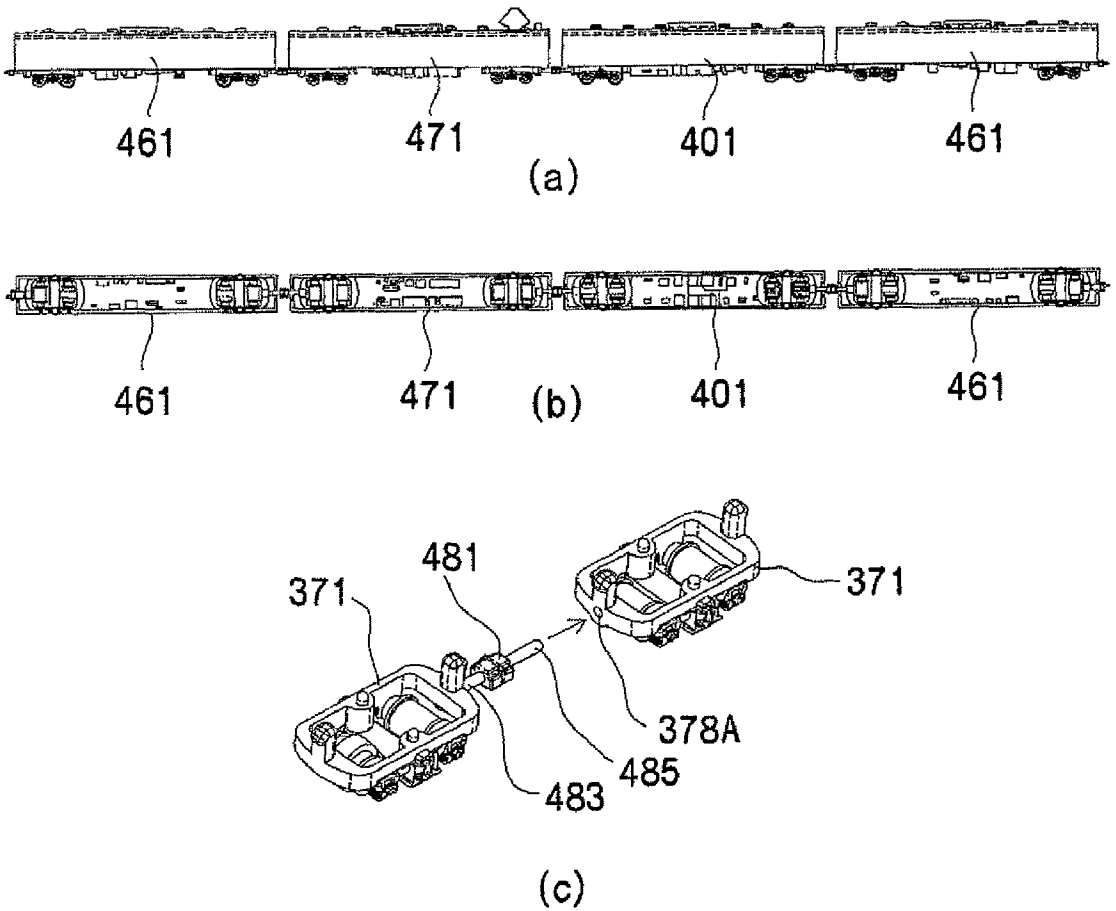
FIGS. 33(*a*) to 33(*c*) are explanatory views of toy vehicles coupled by the couplers.
Figure 34:
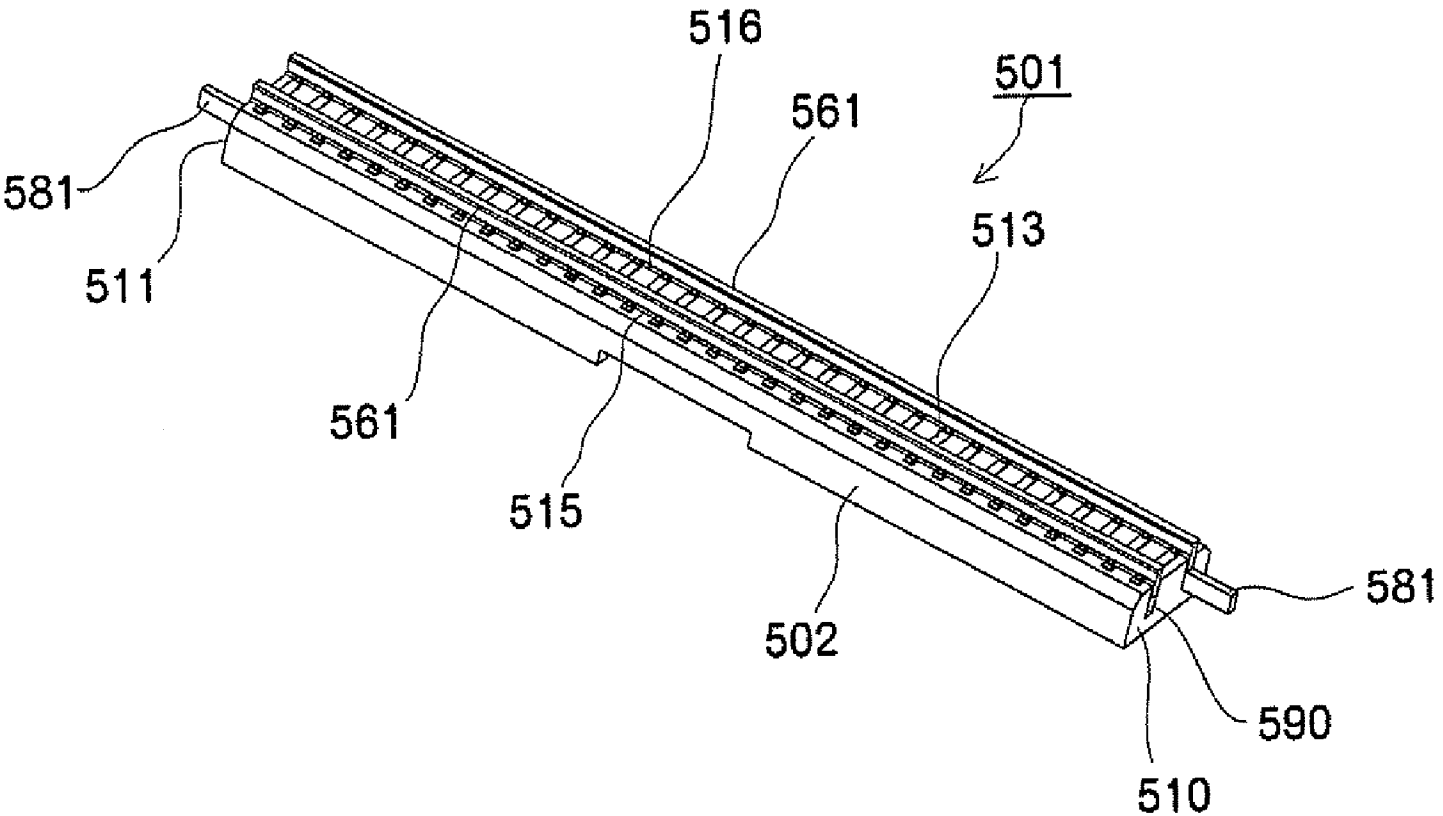
FIG. 34 is a perspective view of another embodiment of the rail track device according to the present invention.
Figure 35:
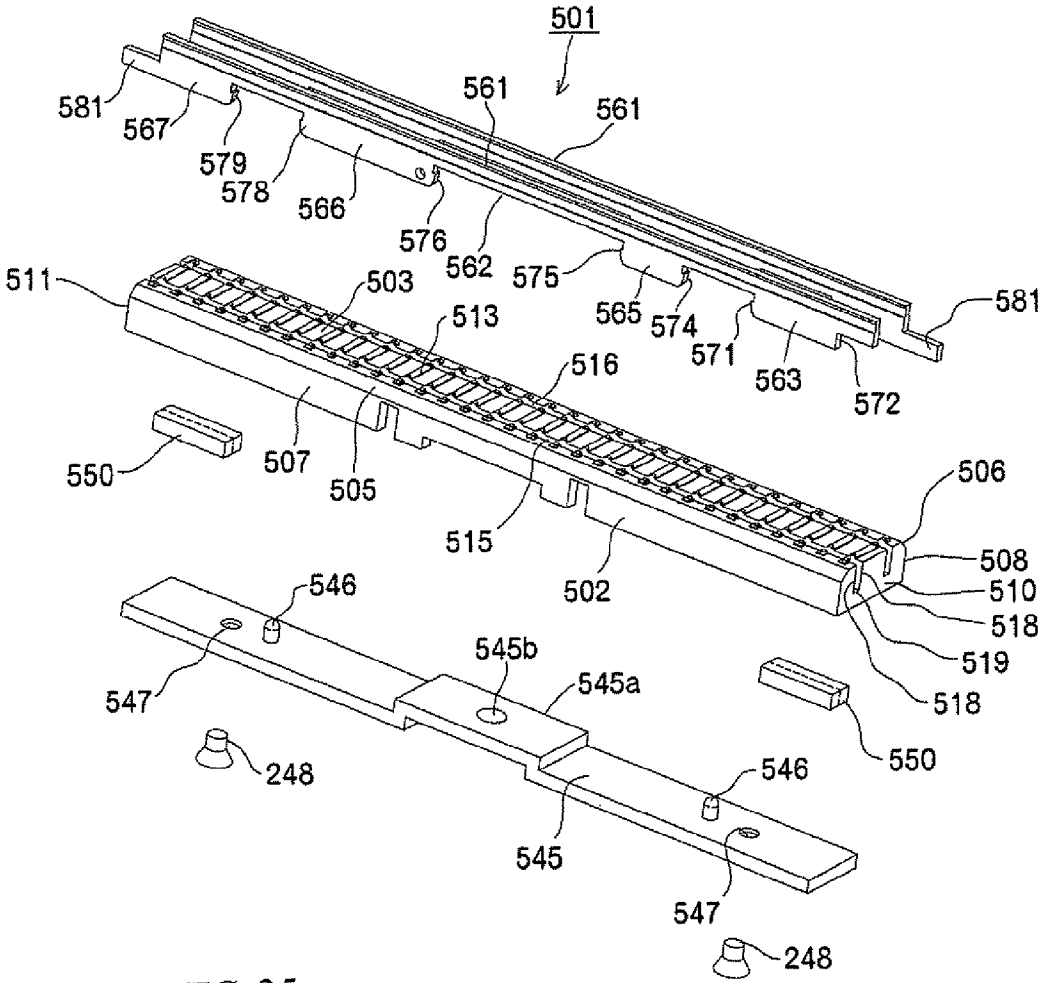
FIG. 35 is an exploded perspective view of FIG. 34.
Figure 36:
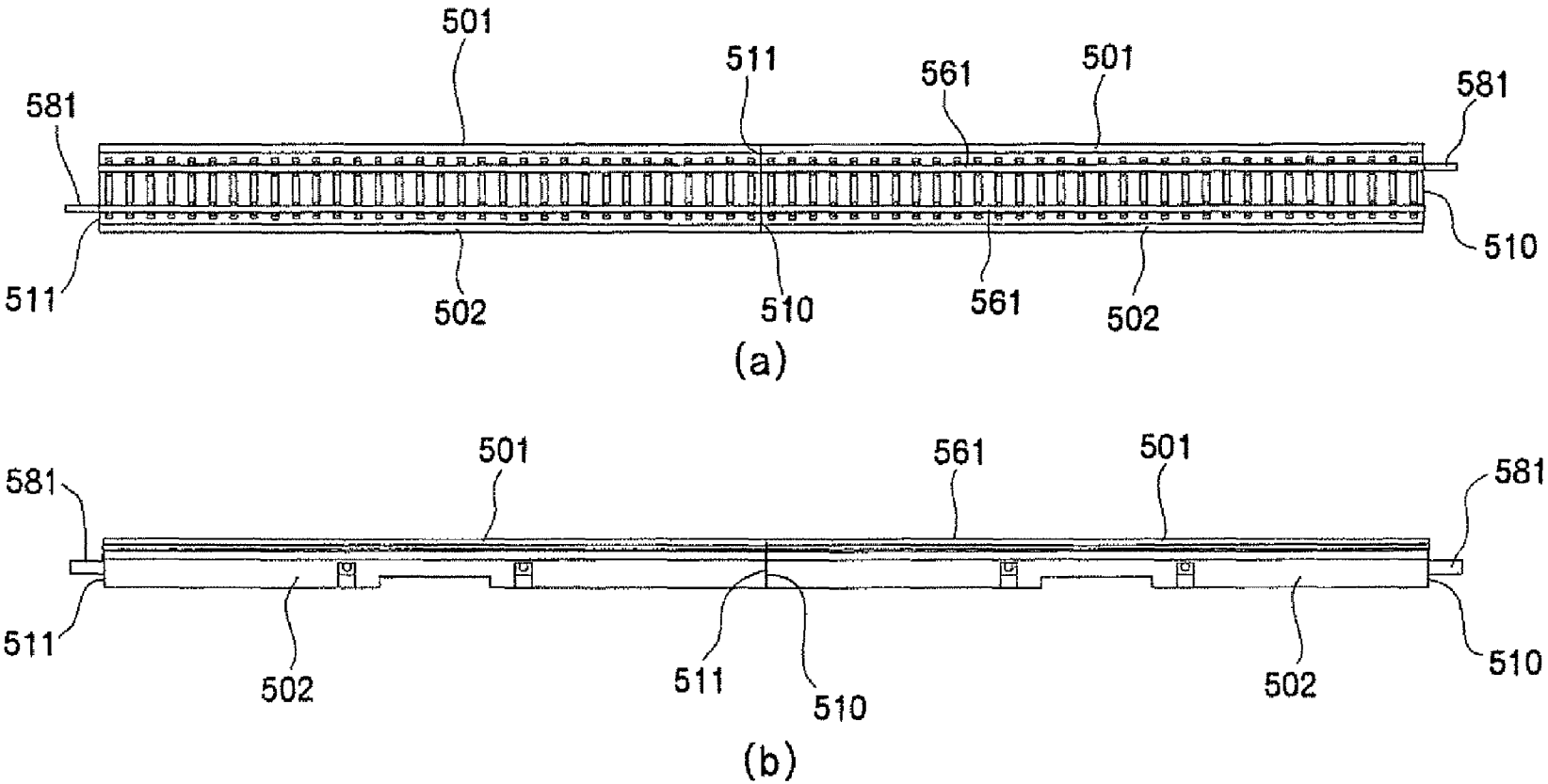
FIGS. 36(*a*) and 36(*b*) are explanatory views of the rail track device.
Figure 37:
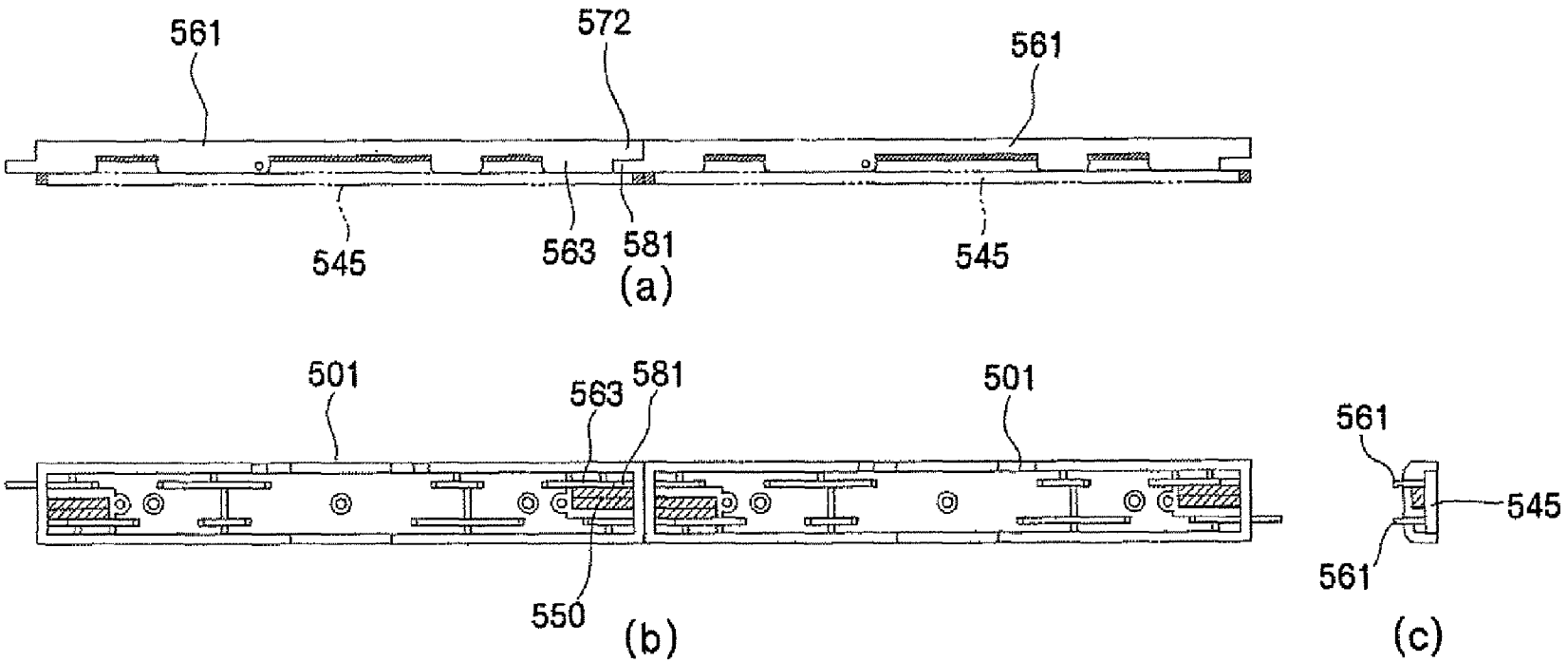
FIGS. 37(*a*) to 37(*c*) are explanatory views of the rail track device.
Figure 38:
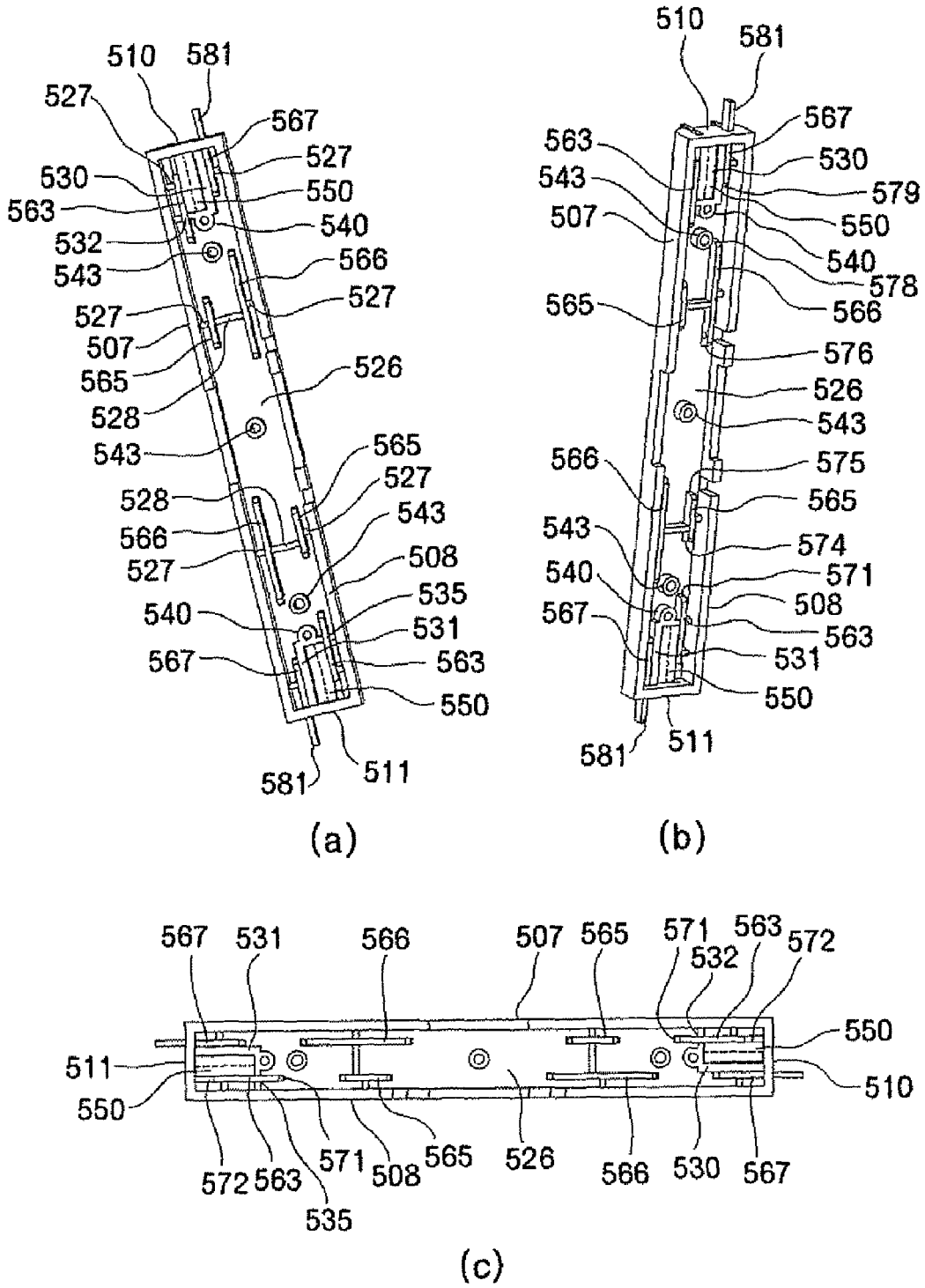
FIGS. 38(*a*) to 38(*c*) are explanatory views of the rail track device from which a bottom plate is detached and which is viewed from below.
Figure 39:
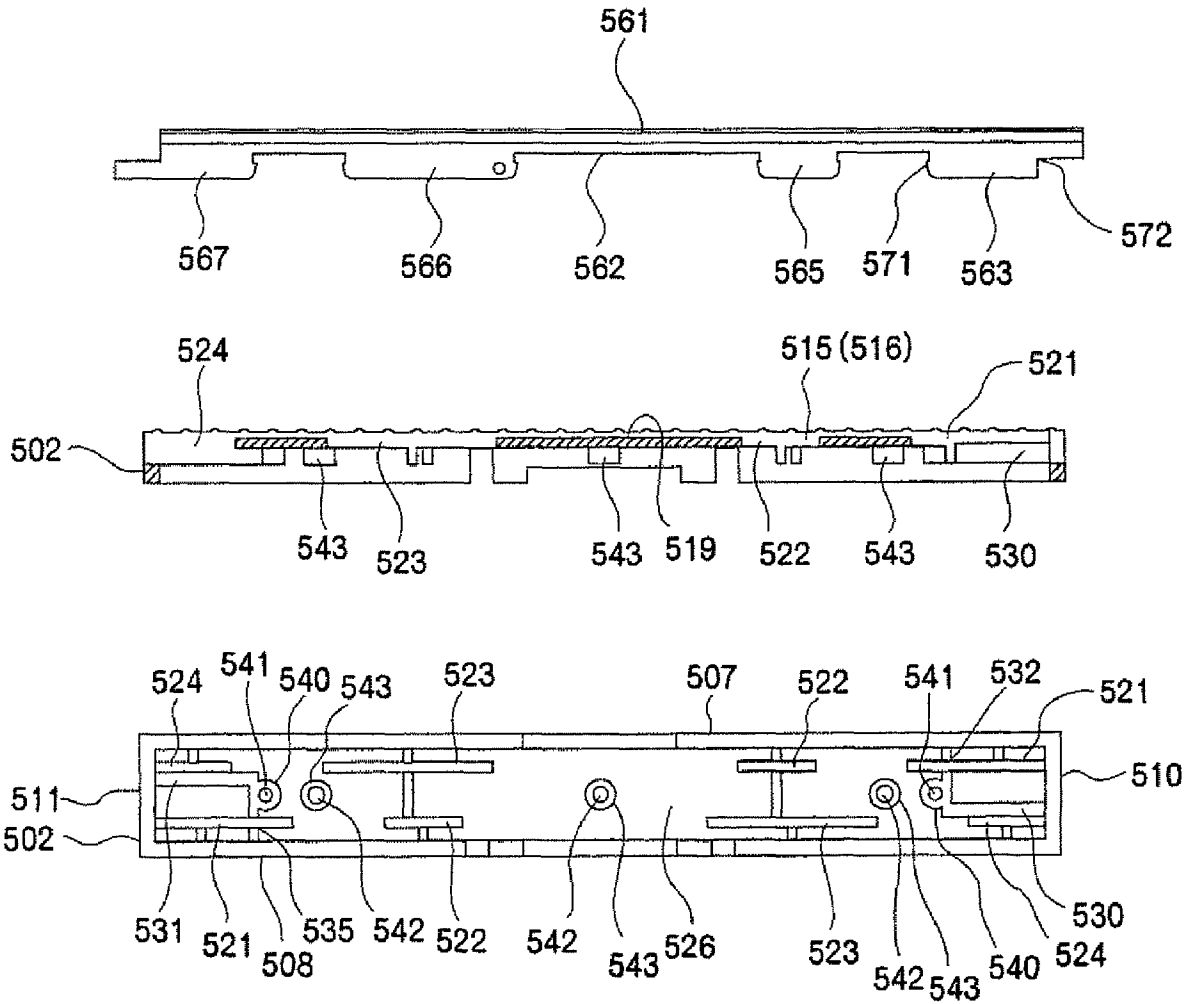
FIG. 39 is an explanatory view for explaining a relationship between a rail track belt and metal rails.
Figure 40:
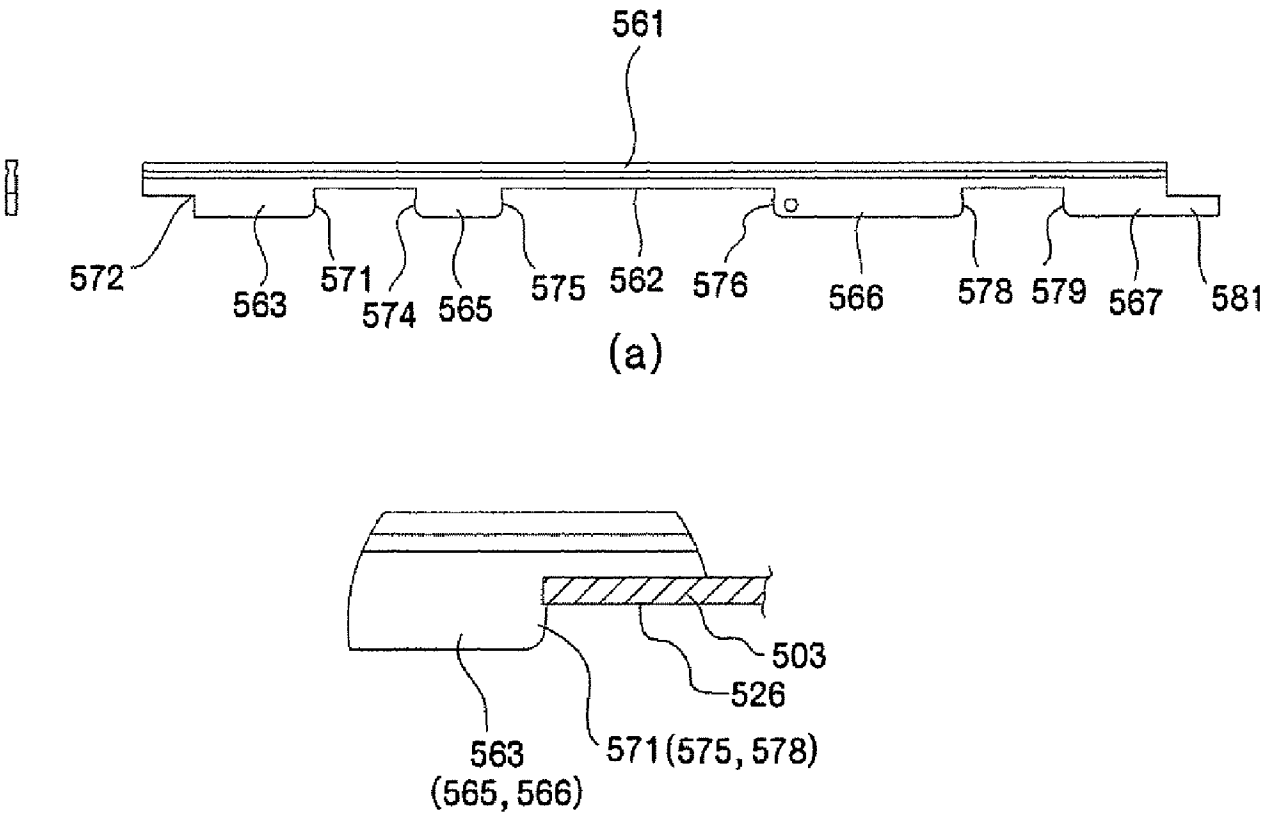
FIGS. 40(*a*) and 40(*b*) are explanatory views of the metal rail.
Figure 41:
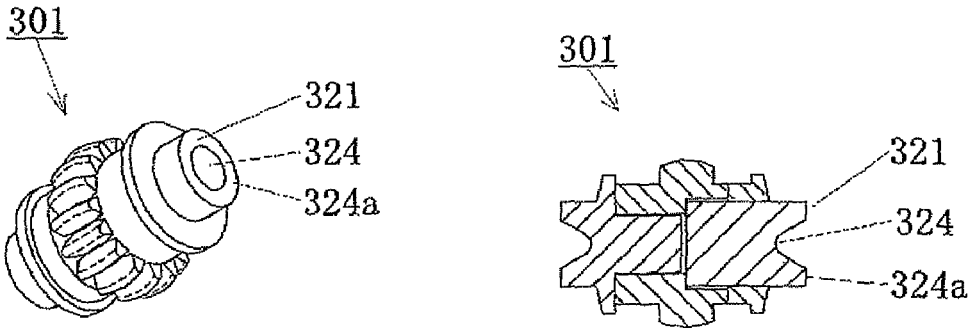
FIGS. 41(*a*) and 41(*b*) are general views of another embodiment of the drive wheel device for a toy vehicle according to the present invention.
Figure 42:
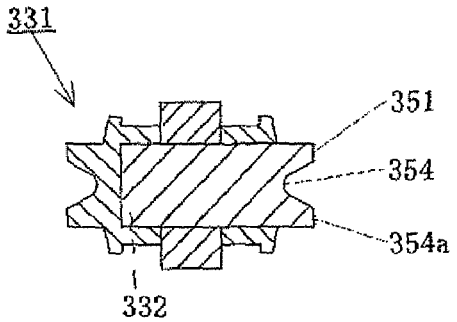
FIGS. 42(*a*) and 42(*b*) are general views of another embodiment of the follower wheel device for a toy vehicle according to the present invention.
Figure 42:
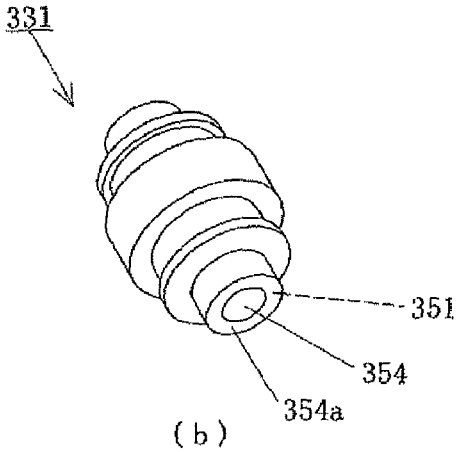
Figure 43:
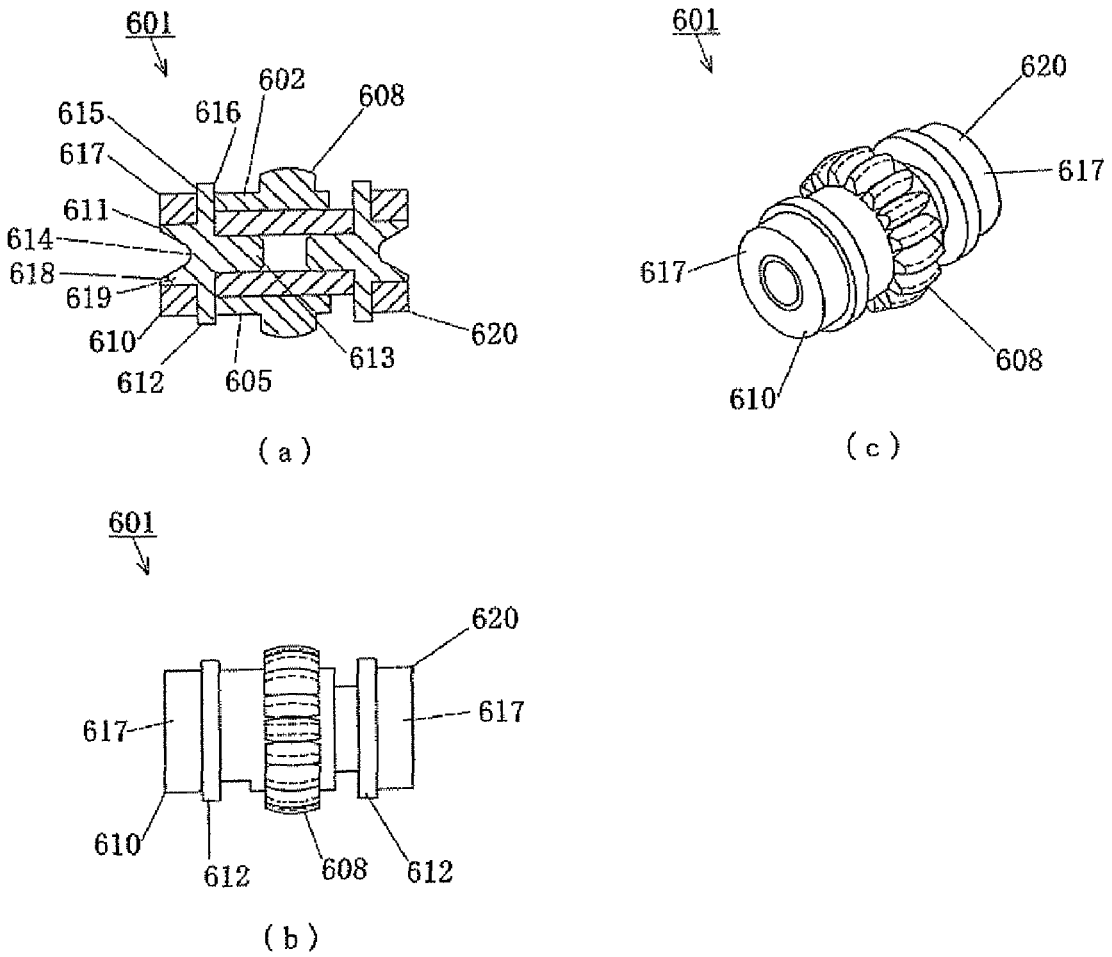
FIGS. 43(*a*) to 43(*c*) are general views of another embodiment of the drive wheel device for a toy vehicle according to the present invention.
Figure 44:
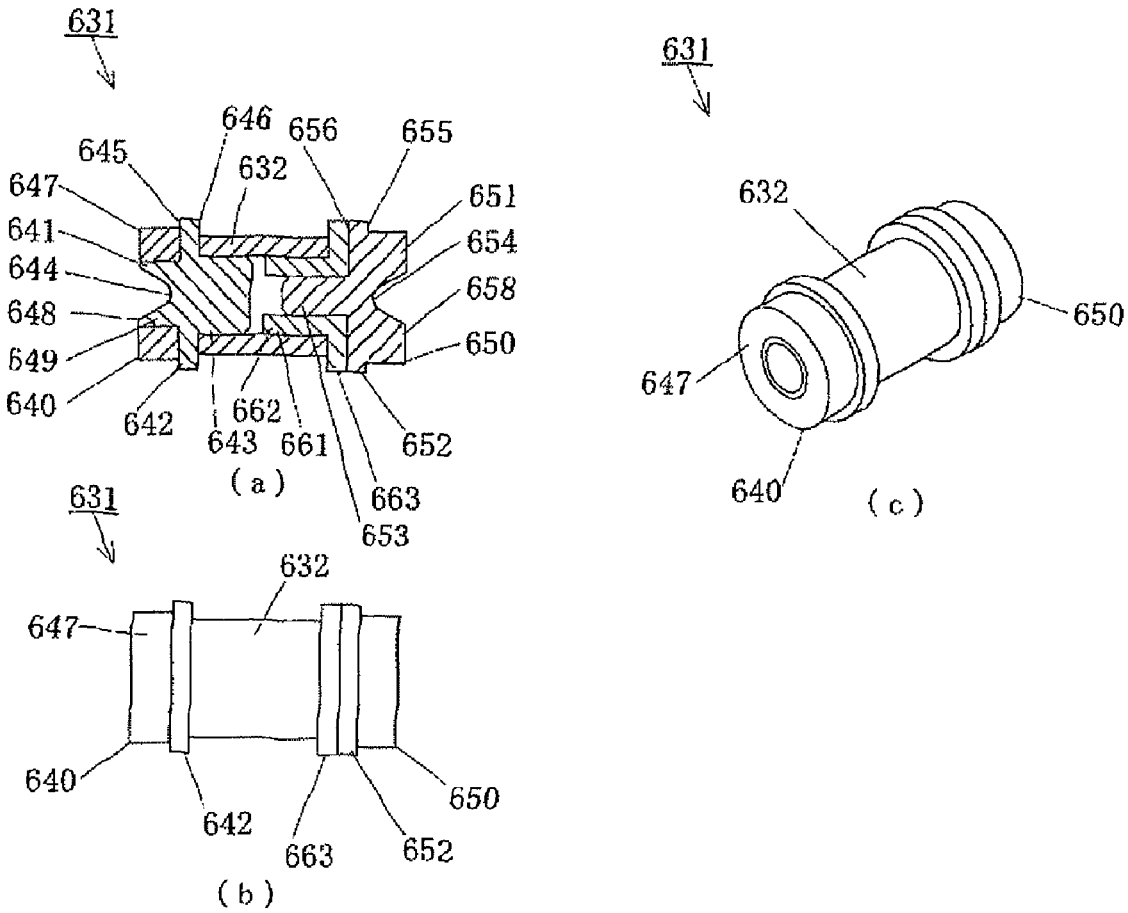
FIGS. 44(*a*) to 44(*c*) are general views of another embodiment of the follower wheel device for a toy vehicle according to the present invention.
Figure 45:
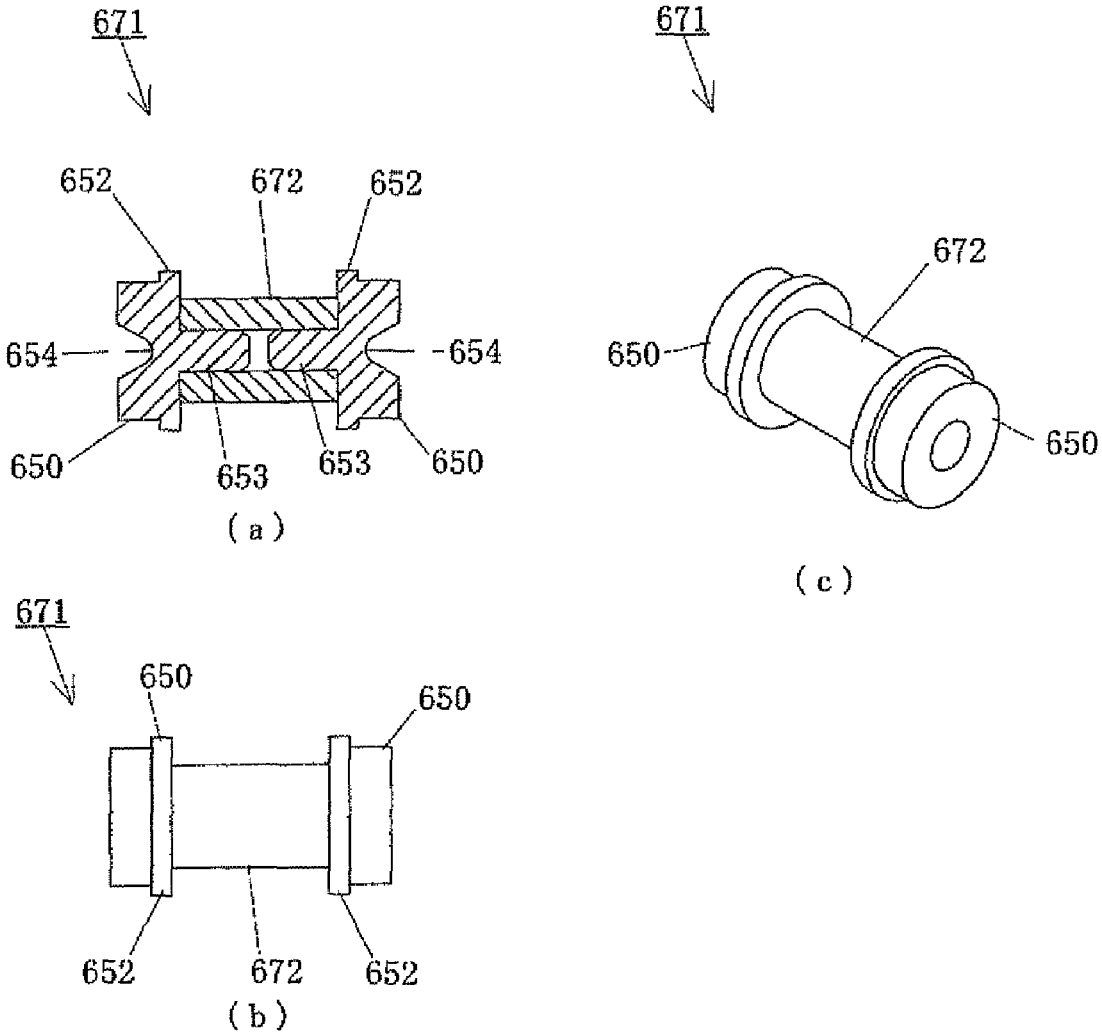
FIGS. 45(*a*) to 45(*c*) are general views of another embodiment of the follower wheel device for a toy vehicle according to the present invention.
Figure 46:
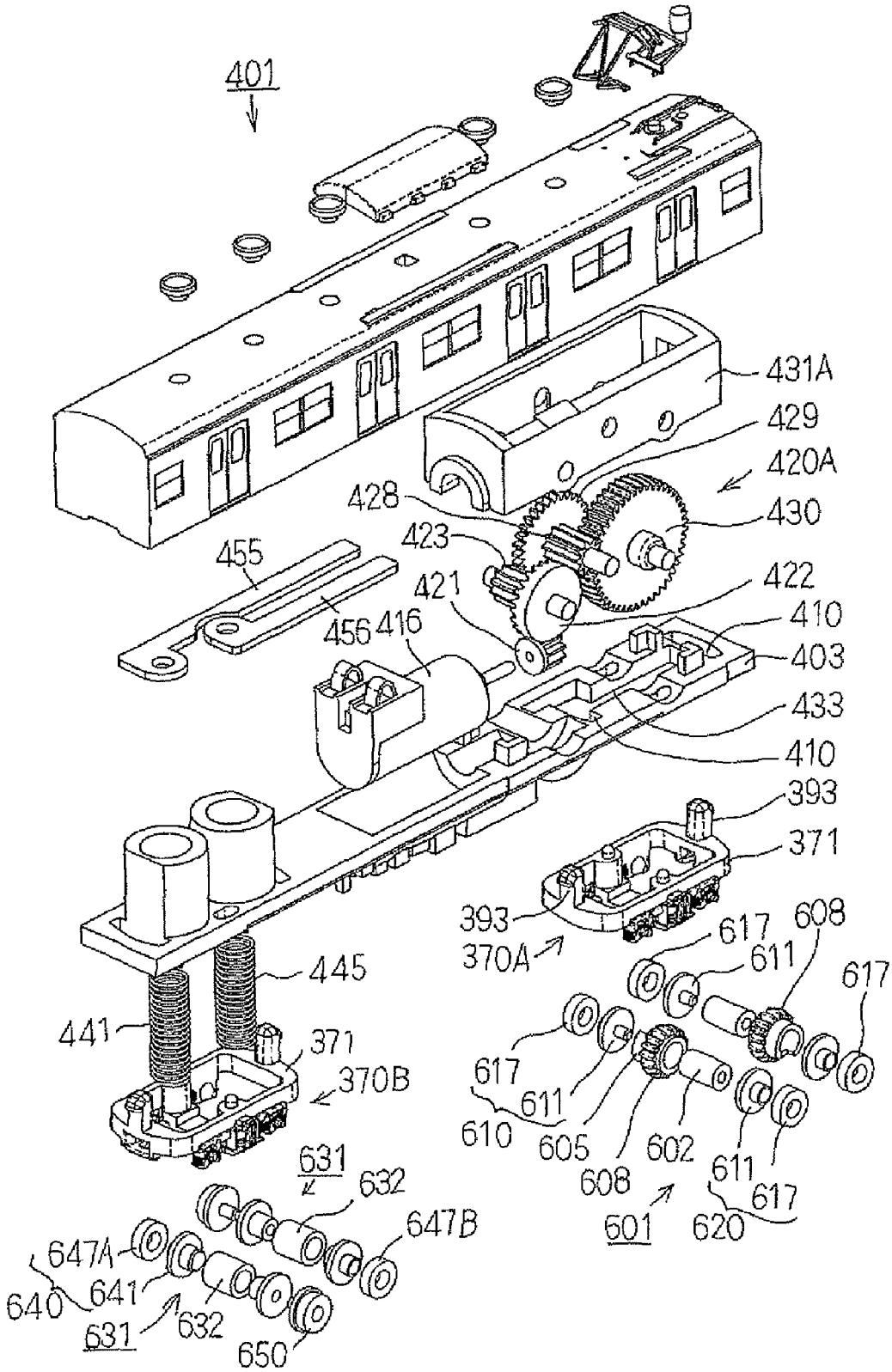
FIG. 46 is an exploded perspective view of the drive wheel devices and the follower wheel devices for a toy vehicle according to the present invention mounted into a toy vehicle.
Figure 47:
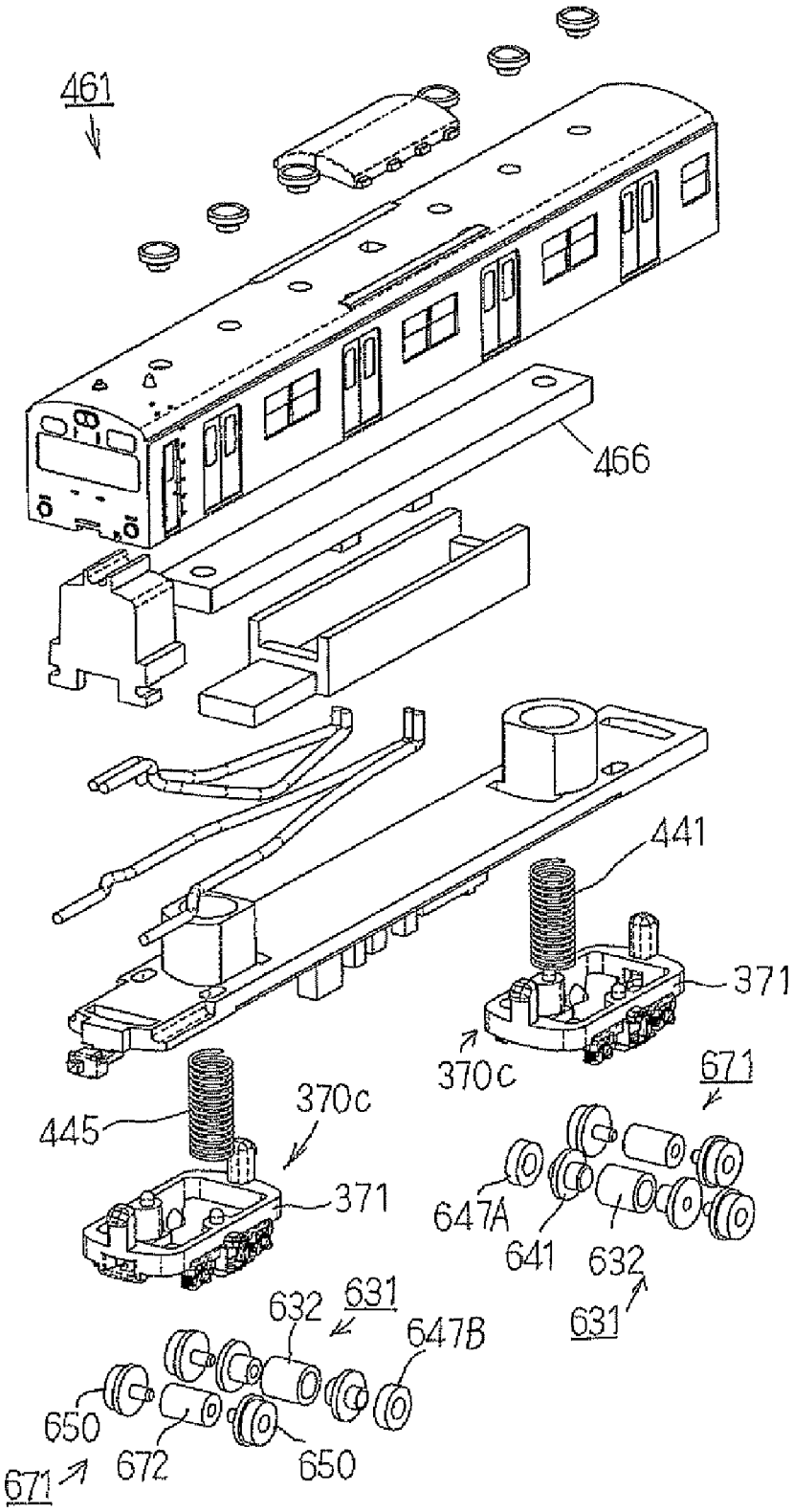
FIG. 47 is an exploded perspective view of the drive wheel devices and the follower wheel devices for a toy vehicle according to the present invention mounted into a toy vehicle.
Figure 48:
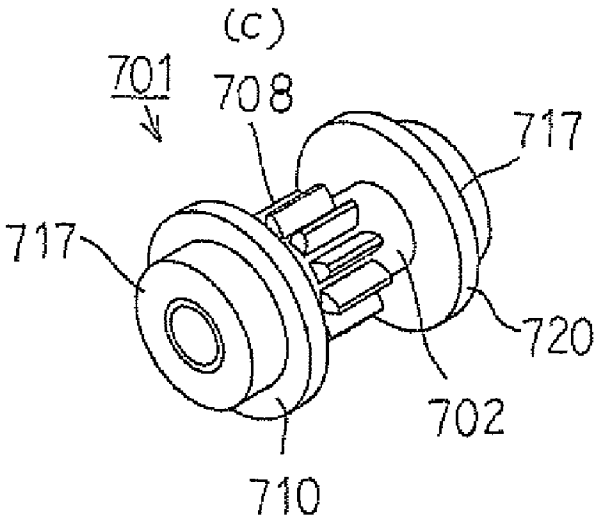
FIGS. 48(*a*) to 48(*c*) are general views of another embodiment of the drive wheel device for a toy vehicle according to the present invention.
Figure 48:
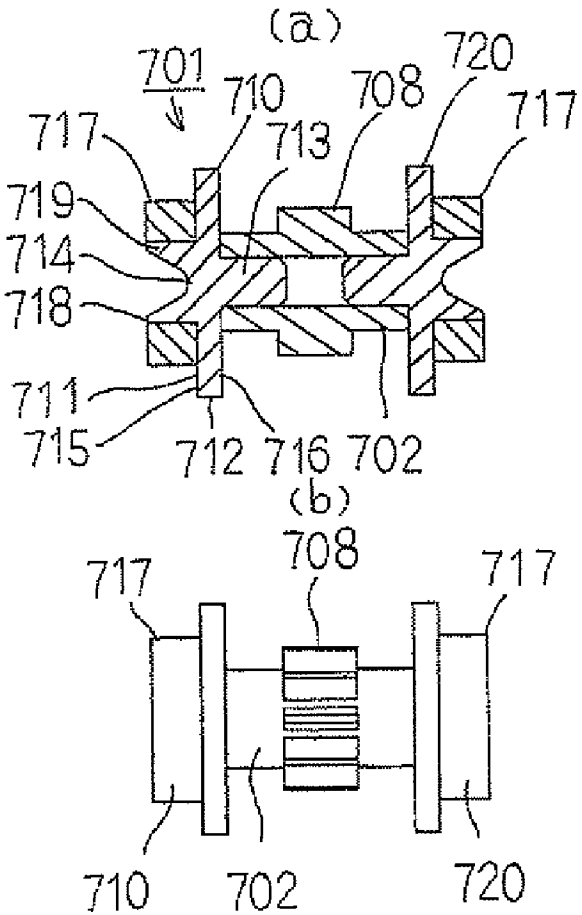
Figure 49:
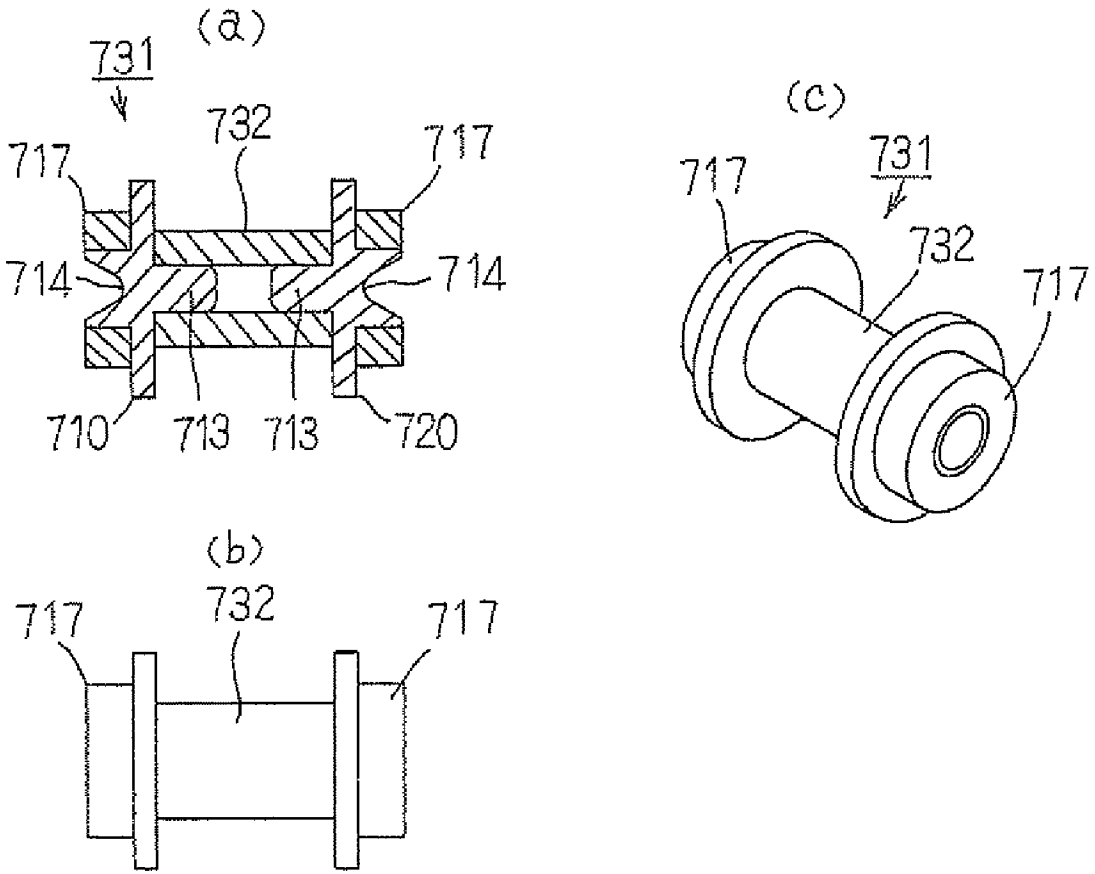
FIGS. 49(*a*) to 49(*c*) are general views of another embodiment of the follower wheel device for a toy vehicle according to the present invention.
Figure 50:
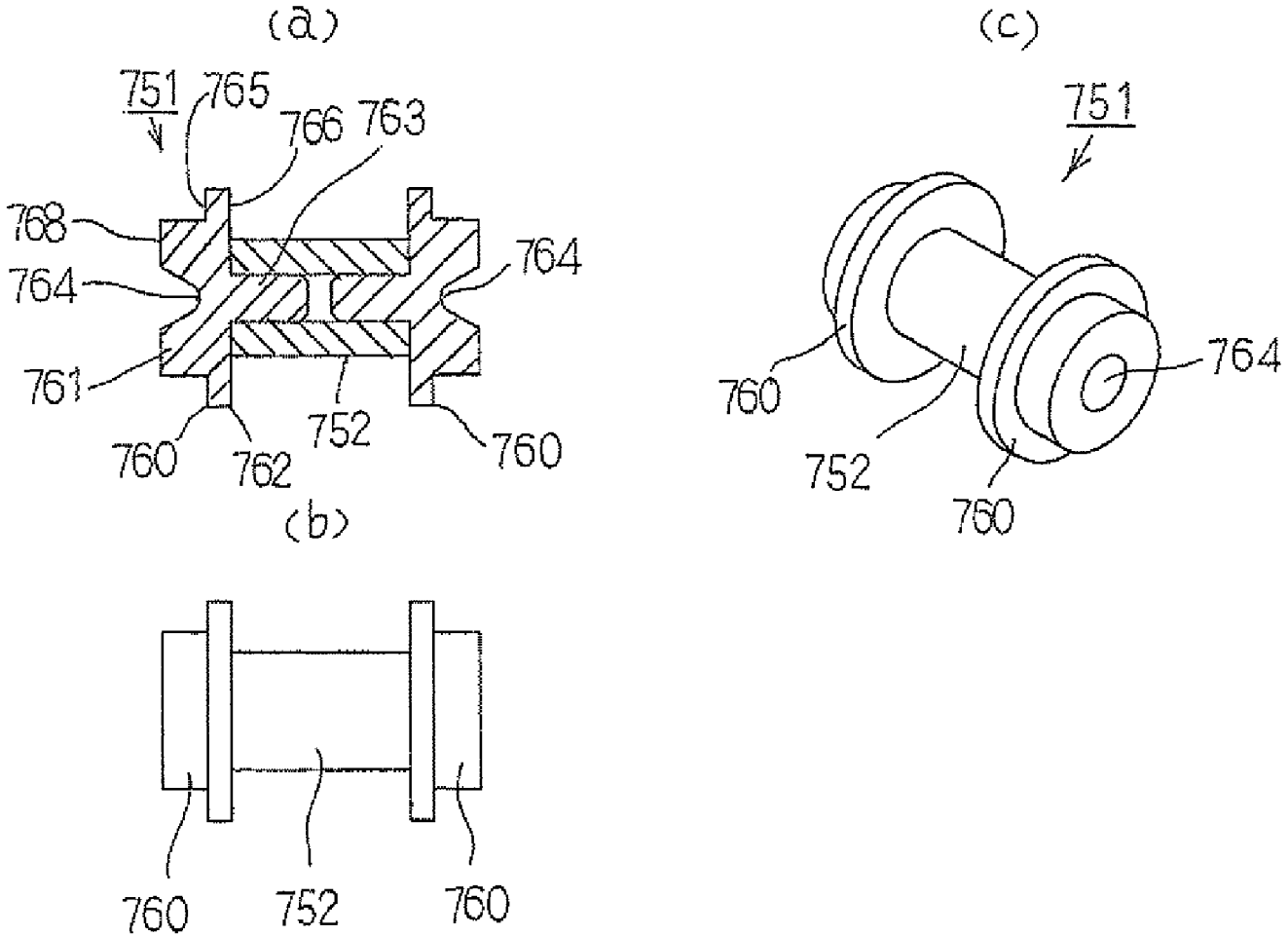
FIGS. 50(*a*) to 50(*c*) are general views of another embodiment of the follower wheel device for a toy vehicle according to the present invention.
Figure 51:
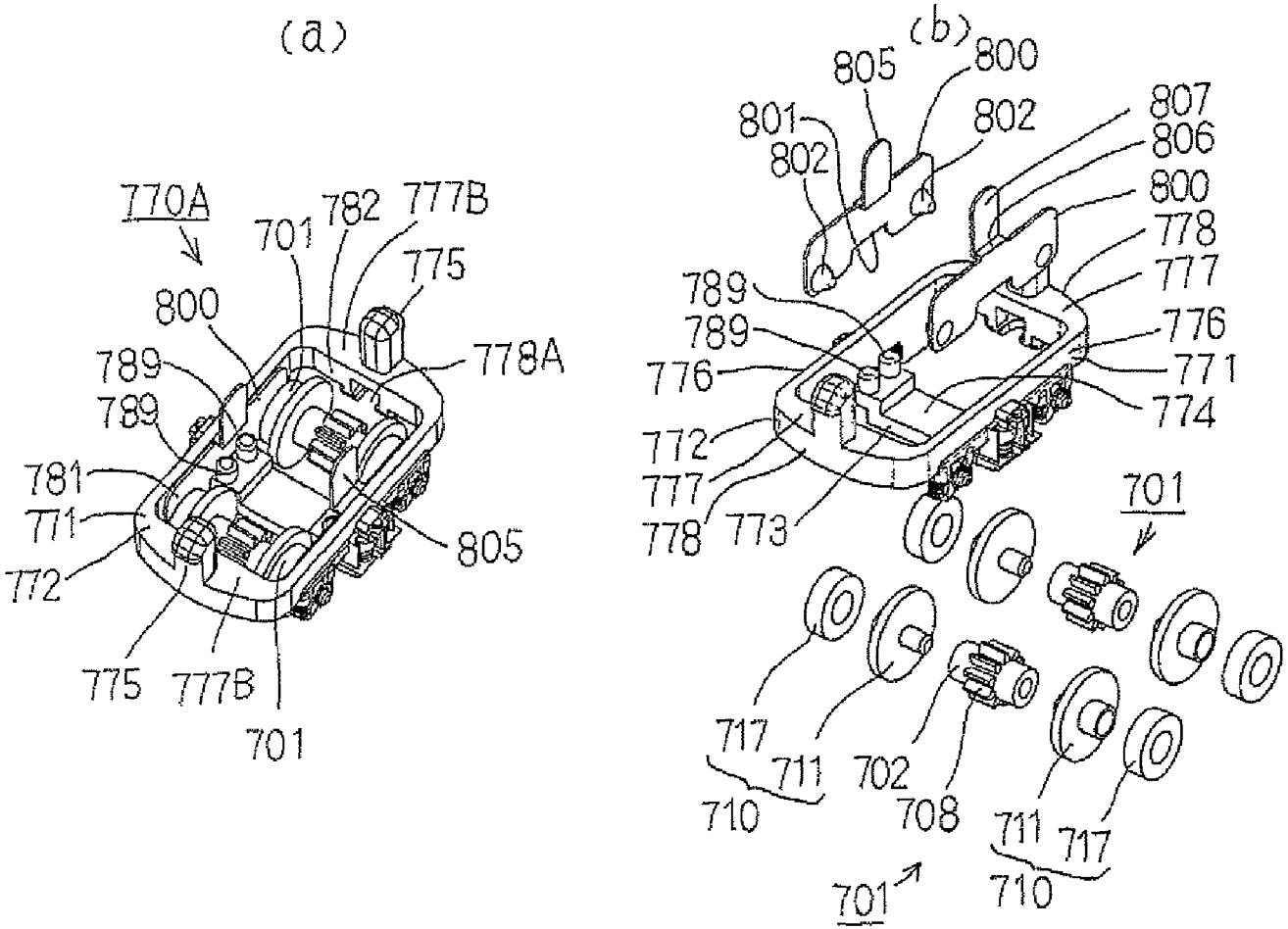
FIGS. 51(*a*) and 51(*b*) are exploded perspective views of the drive wheel devices for a toy vehicle according to the present invention mounted into a carriage.
Figure 52:
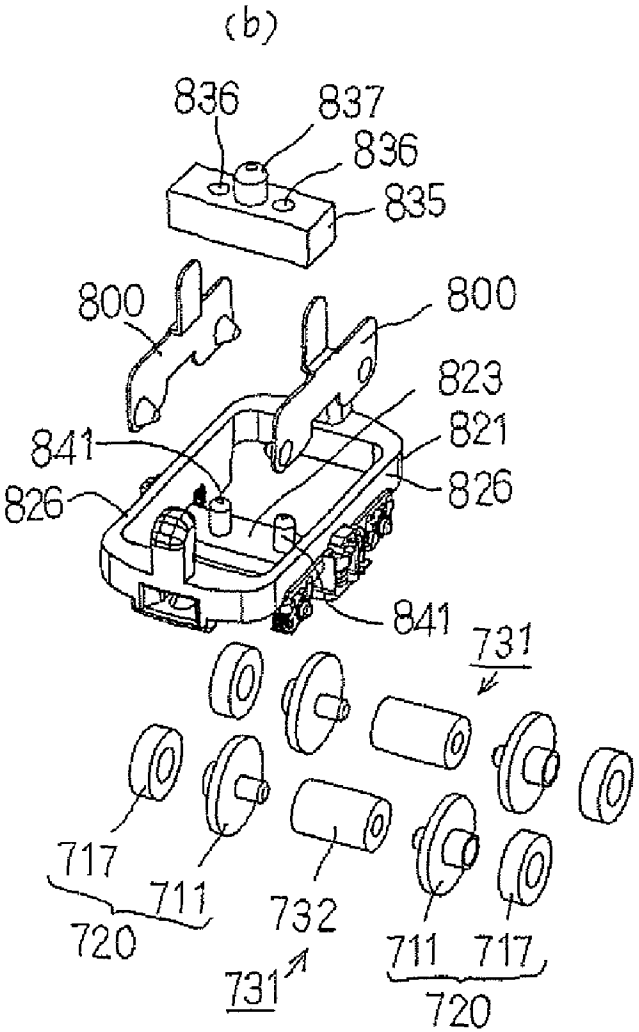
FIGS. 52(*a*) and 52(*b*) are exploded perspective views of the follower wheel devices for a toy vehicle according to the present invention mounted into a carriage.
Figure 52:
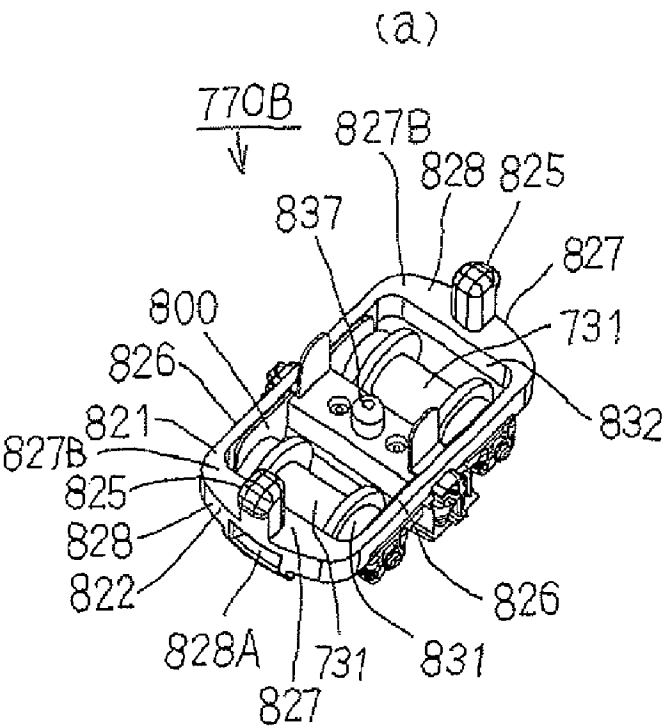
Figure 53:
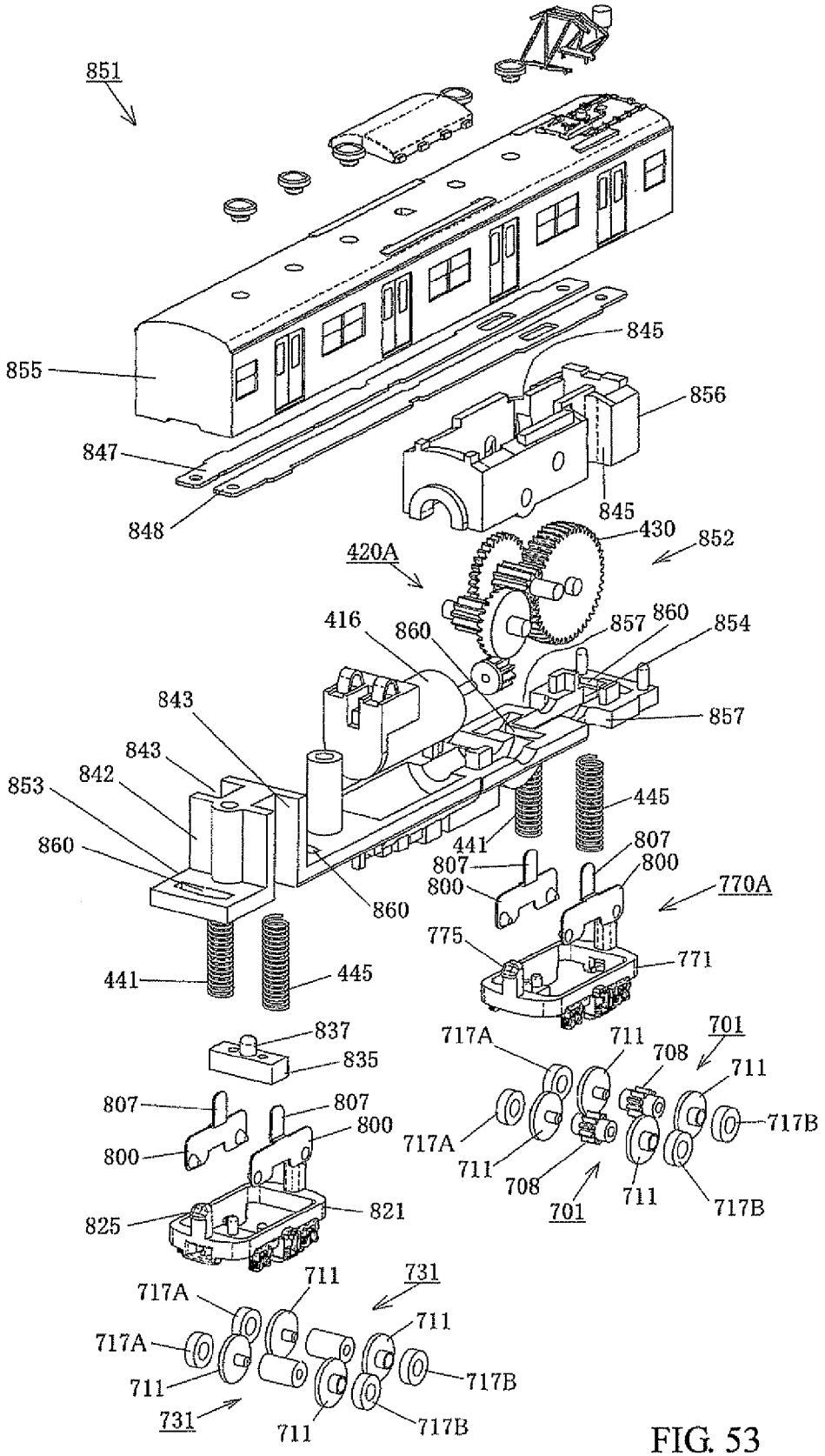
FIG. 53 is an exploded perspective view of the drive wheel devices and the follower wheel devices for a toy vehicle according to the present invention mounted into a toy vehicle.
Figure 54:
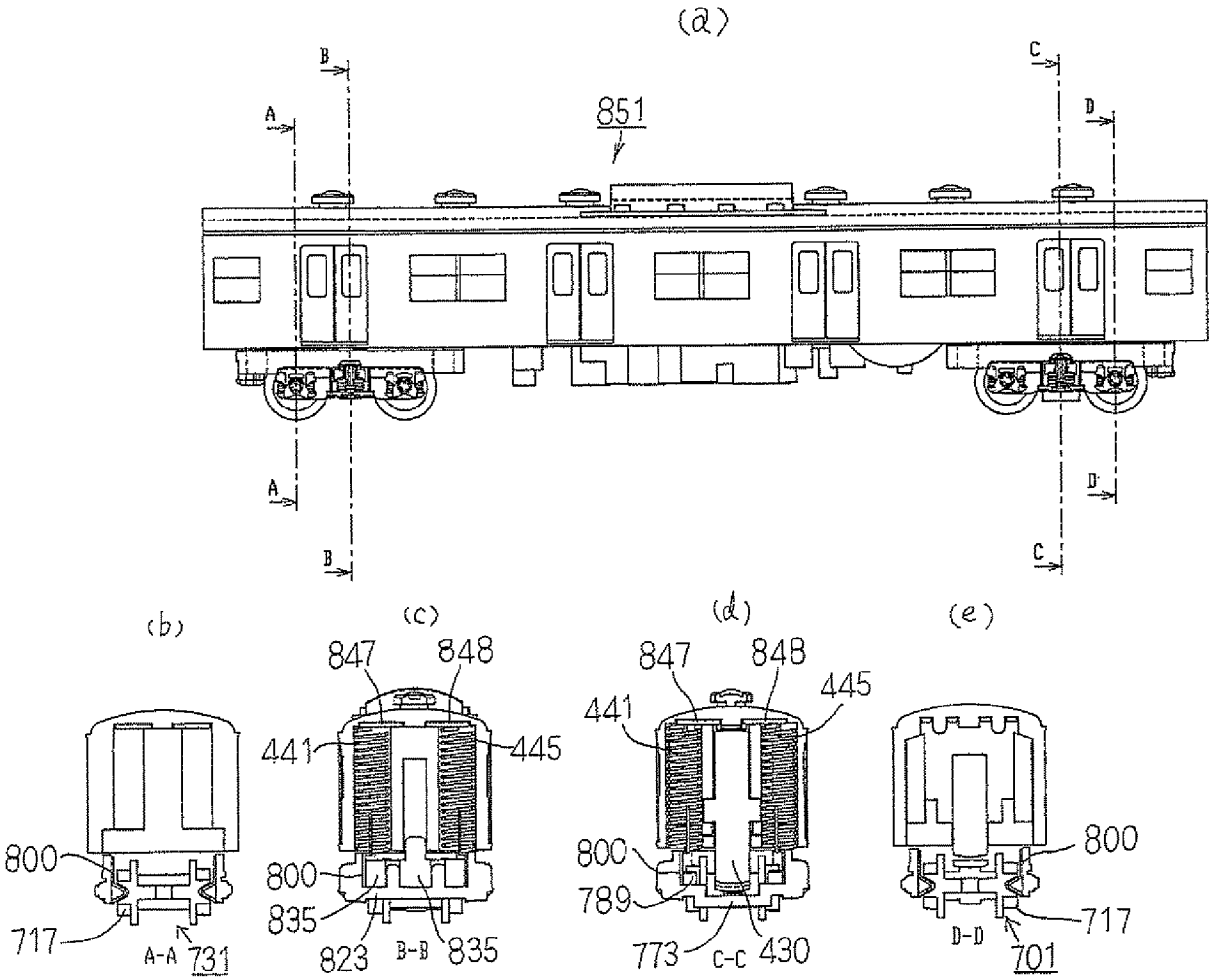
FIGS. 54(*a*) to 54(*e*) are sectional views of the wheel devices for a toy vehicle according to the present invention mounted into a toy vehicle.
Figure 55:
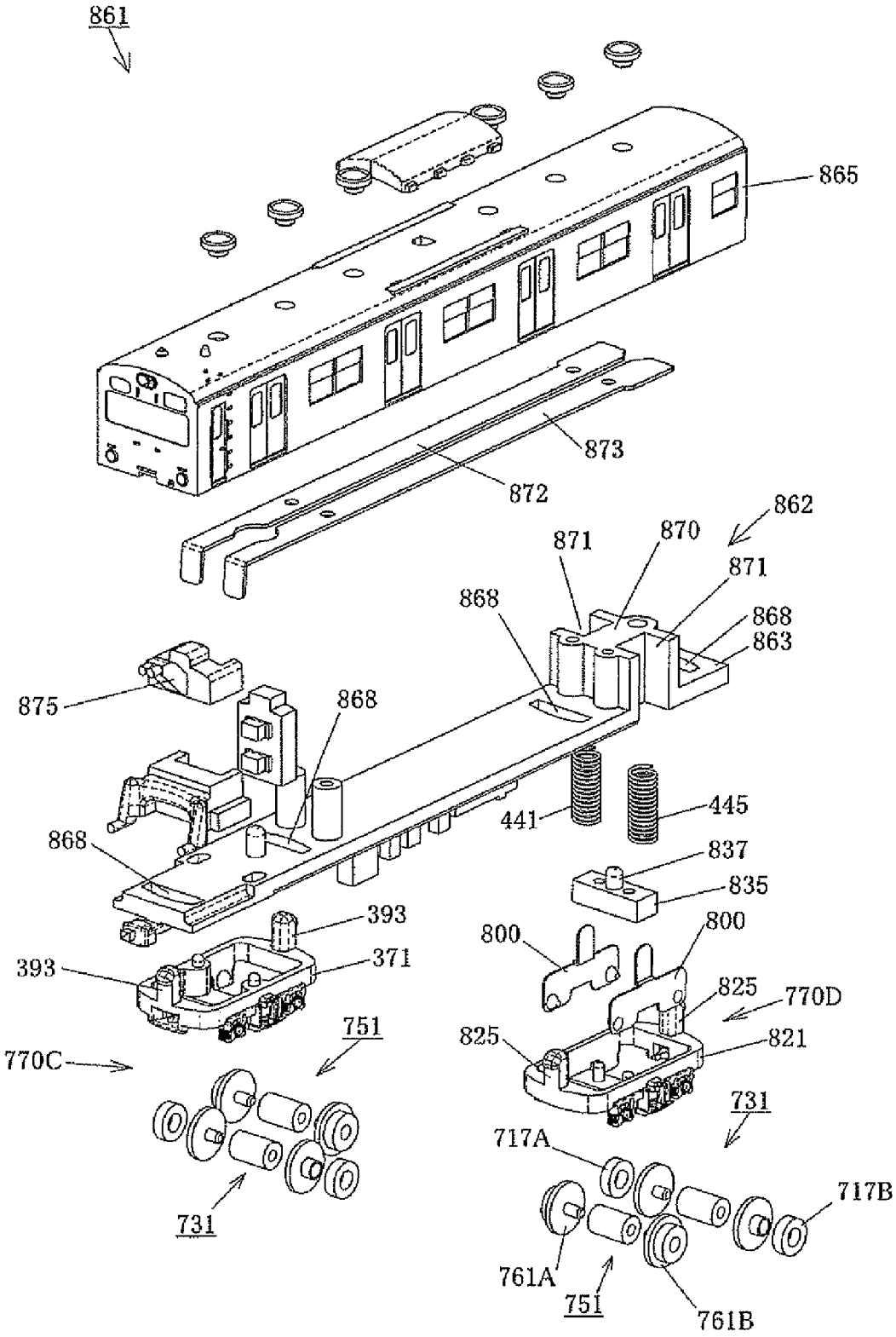
FIG. 55 is an exploded perspective view of other follower wheel devices for a toy vehicle according to the present invention mounted into a toy vehicle.

| | |
|---|---|
| 1 | drive wheel device |
| 1A | drive wheel device |
| 2 | first axle |
| 3 | one side face |
| 5 | first round shaft recessed portion |
| 6 | the other side face |
| 7 | second round shaft recessed portion |
| 8 | gear |
| 10 | first wheel |
| 11 | first wheel main body |
| 12 | first flange |
| 13 | fitting shaft |
| 15 | outer side face |
| 16 | inner side face |
| 20 | second wheel |
| 21 | second wheel main body |
| 22 | second flange |
| 23 | boss portion |
| 25 | outer side face |
| 26 | inner side face |
| 27 | through hole |
| 29 | protruding portion |
| 31 | follower wheel device |
| 32 | second axle |
| 39 | protruding portion |
| 40 | third wheel |
| 41 | third wheel main body |
| 42 | third flange |
| 43 | boss portion |
| 45 | outer side face |
| 46 | inner side face |
| 47 | fitting hole |
| 50 | fourth wheel |
| 51 | fourth wheel main body |
| 52 | fourth flange |
| 53 | boss portion |
| 55 | outer side face |
| 56 | inner side face |
| 57 | through hole |
| 60 | conductive ring |
| 65 | follower wheel device |
| 66 | axle |
| 67 | a pair of wheels |
| 68 | wheel main body |
| 69 | flange |
| 70 | carriage |
| 70A | carriage |
| 70B | carriage |
| 70C | carriage |
| 71 | carriage frame |
| 72 | main frame |
| 73 | middle member |
| 74 | inner face |
| 75 | bearing member |
| 76 | longitudinal member |
| 77 | lateral member |
| 77a | lower face |
| 78 | outer face |
| 79 | inner face |
| 81 | housing portion |
| 82 | housing portion |
| 85 | guide groove |
| 90 | shaft retaining member |
| 91 | guide protrusion |
| 92 | shaft retaining protrusion |
| 101 | powered toy vehicle |
| 102 | toy vehicle main body |
| 103 | chassis |
| 105 | vehicle body |
| 106 | lower face |
| 110 | locking member |

-continued

| | |
|---|---|
| 111 | sliding contact face |
| 113 | engaging protruding portions |
| 116 | drive motor |
| 120 | gear train |
| 121 | drive gear |
| 122 | crown gear |
| 123 | small gear |
| 125 | large gear |
| 126 | small gear |
| 127 | large gear |
| 128 | small gear |
| 129 | large gear |
| 130 | final gear |
| 131 | gear box |
| 133 | opening |
| 141 | first conductive contact |
| 142 | guide chip |
| 143 | spring receiving protruding chip |
| 145 | second conductive contact |
| 151 | guide member |
| 152 | guide groove |
| 155 | spring |
| 156 | spring retaining chip |
| 157 | guide protrusion |
| 158 | opening |
| 159 | protrusion |
| 161 | toy passenger vehicle |
| 162 | toy vehicle main body |
| 163 | chassis |
| 165 | vehicle body |
| 166 | lower face |
| 167 | protrusion |
| 168 | opening |
| 171 | toy passenger vehicle |
| 172 | toy vehicle main body |
| 201 | rail track device |
| 202 | rail track belt |
| 203 | upper face plate |
| 205 | right slope plate |
| 206 | left slope plate |
| 207 | right side plate |
| 208 | left side plate |
| 210 | front face plate |
| 211 | rear face plate |
| 213 | protrusion |
| 215 | groove |
| 216 | groove |
| 218 | side face |
| 219 | bottom face |
| 221 | insertion hole |
| 222 | insertion hole |
| 223 | insertion hole |
| 224 | insertion hole |
| 226 | back face |
| 230 | magnet housing frame (mounting portion) |
| 231 | magnet housing frame (mounting portion) |
| 232 | insertion groove |
| 233 | insertion groove |
| 235 | insertion groove |
| 236 | insertion groove |
| 240 | boss |
| 241 | internal thread portion |
| 242 | positioning hole |
| 243 | boss |
| 245 | bottom plate |
| 246 | fitting pin |
| 247 | through hole |
| 248 | screw |
| 250 | magnet |
| 261 | metal rail |
| 262 | contact face |
| 263 | front insertion chip |
| 265 | first middle insertion chip |
| 266 | second middle insertion chip |
| 267 | rear insertion chip |
| 271 | contact chip |
| 272 | insertion recessed portion |
| 273 | contact chip |
| 275 | locking lug |
| 276 | contact chip |

-continued

| | |
|---|---|
| 278 | locking lug |
| 279 | locking lug |
| 280 | contact chip |
| 281 | insertion protruding portion |
| 282 | locking lug |
| 290 | insertion hole |
| 301 | drive wheel device |
| 301A | wheel device (follower wheel device) |
| 302 | first axle |
| 303 | one side face |
| 305 | first round shaft recessed portion |
| 306 | the other side face |
| 307 | second round shaft recessed portion |
| 307A | round shaft recessed portion |
| 308 | gear |
| 310 | first wheel |
| 311 | first wheel main body |
| 312 | first flange |
| 313 | fitting shaft |
| 314 | support recessed portion |
| 315 | outer side face |
| 316 | inner side face |
| 318 | tip end face |
| 320 | second wheel |
| 320A | second wheel |
| 321 | second wheel main body |
| 322 | second flange |
| 323 | boss portion |
| 324 | support recessed portion |
| 324a | tip end face |
| 325 | outer side face |
| 326 | inner side face |
| 327 | through hole |
| 328 | magnet |
| 328A | magnet |
| 329 | protruding portion |
| 330 | rolling shaft |
| 330A | rolling shaft |
| 331 | follower wheel device |
| 332 | second axle |
| 333 | housing recessed portion |
| 333A | housing recessed portion |
| 334 | support hole |
| 334A | support hole |
| 335 | one end face |
| 335A | one end face |
| 336 | the other end face |
| 336A | the other end face |
| 337 | opening |
| 337A | opening |
| 340 | third wheel |
| 341 | third wheel main body |
| 342 | third flange |
| 343 | boss portion |
| 344 | support recessed portion |
| 345 | outer side face |
| 346 | inner side face |
| 347 | fitting hole |
| 348 | tip end face |
| 350 | fourth wheel |
| 351 | fourth wheel main body |
| 351A | fourth wheel main body |
| 351B | fourth wheel main body |
| 351C | fourth wheel main body |
| 351D | fourth wheel main body |
| 352 | fourth flange |
| 353 | boss portion |
| 354 | support recessed portion |
| 354a | tip end face |
| 355 | outer side face |
| 356 | inner side face |
| 357 | through hole |
| 360 | conductive ring |
| 364 | support recessed portion |
| 365 | follower wheel device |
| 366 | axle |
| 367 | wheel |
| 368 | wheel main body |
| 369 | flange |
| 370A | carriage |

-continued

| | |
|---|---|
| 370B | carriage |
| 370C | carriage |
| 370D | carriage |
| 371 | carriage frame |
| 372 | main frame |
| 373 | middle member |
| 376 | longitudinal member |
| 376A | lower face |
| 376B | upper face |
| 377 | lateral member |
| 377B | upper face |
| 378 | outer face |
| 378A | coupling hole |
| 381 | housing portion |
| 382 | housing portion |
| 385 | support shaft |
| 386 | support chip |
| 387 | support chip |
| 393 | locking lug |
| 395 | guide protrusion |
| 401 | powered toy vehicle |
| 402 | toy vehicle main body |
| 403 | chassis |
| 405 | vehicle body |
| 410 | locking groove |
| 408 | guide groove |
| 416 | drive motor (electric component) |
| 420 | gear train |
| 420A | gear train |
| 421 | drive gear |
| 422 | crown gear |
| 423 | small gear |
| 425 | large gear |
| 426 | small gear |
| 427 | large gear |
| 428 | small gear |
| 429 | large gear |
| 430 | final gear |
| 431 | gear box |
| 431A | gear box |
| 433 | opening |
| 441 | conductive contact |
| 445 | conductive contact |
| 451 | guide member |
| 454 | opening |
| 455 | contact terminal |
| 456 | contact terminal |
| 457 | through hole |
| 458 | through hole |
| 459 | protrusion |
| 461 | toy passenger vehicle |
| 462 | toy vehicle main body |
| 463 | chassis |
| 465 | vehicle body |
| 466 | electronic substrate (electric component) |
| 471 | toy passenger vehicle |
| 472 | toy vehicle main body |
| 473 | chassis |
| 481 | coupler |
| 482 | coupling shaft |
| 483 | design member |
| 484 | one |
| 485 | the other |
| 501 | rail track device |
| 502 | rail track belt |
| 503 | upper face plate |
| 505 | right slope plate |
| 506 | left slope plate |
| 507 | right side plate |
| 508 | left side plate |
| 510 | front face plate |
| 511 | rear face plate |
| 513 | protrusion |
| 515 | groove |
| 516 | groove |
| 518 | side face |
| 519 | bottom face |
| 521 | insertion hole |
| 522 | insertion hole |
| 523 | insertion hole |

-continued

| | |
|---|---|
| 524 | insertion hole |
| 526 | back face |
| 527 | guide protrusion |
| 528 | guide protrusion |
| 530 | magnet housing frame |
| 531 | magnet housing frame |
| 532 | insertion groove |
| 535 | insertion groove |
| 541 | internal thread portion |
| 540 | boss |
| 542 | positioning hole |
| 543 | boss |
| 545 | bottom plate |
| 545a | recessed step portion |
| 545b | fitting hole |
| 546 | fitting pin |
| 547 | through hole |
| 550 | magnet |
| 561 | metal rail |
| 562 | contact face |
| 563 | front insertion chip |
| 565 | first middle insertion chip |
| 566 | second middle insertion chip |
| 567 | rear insertion chip |
| 571 | locking lug |
| 572 | insertion recessed portion |
| 574 | locking lug |
| 575 | locking lug |
| 576 | locking lug |
| 578 | locking lug |
| 579 | locking lug |
| 581 | insertion protruding portion |
| 590 | insertion hole |
| 601 | drive wheel device |
| 602 | first axle |
| 605 | cylindrical member |
| 608 | gear |
| 610 | first wheel |
| 611 | first wheel main body |
| 612 | first flange |
| 613 | fitting shaft |
| 614 | support recessed portion |
| 615 | outer side face |
| 616 | inner side face |
| 617 | magnet ring |
| 618 | tip end face |
| 619 | mounting shaft |
| 620 | second wheel |
| 631 | follower wheel device |
| 632 | second axle |
| 640 | third wheel |
| 641 | third wheel main body |
| 642 | third flange |
| 643 | fitting shaft |
| 644 | support recessed portion |
| 645 | outer side face |
| 646 | inner side face |
| 647 | magnet ring |
| 648 | tip end face |
| 649 | mounting shaft |
| 650 | fourth wheel |
| 651 | fourth wheel main body |
| 652 | fourth flange |
| 653 | fitting shaft |
| 654 | support recessed portion |
| 655 | outer side face |
| 656 | inner side face |
| 658 | tip end face |
| 661 | auxiliary member |
| 662 | trunk portion |
| 663 | locking flange |
| 671 | follower wheel device |
| 672 | second axle |
| 701 | drive wheel device |
| 702 | first axle |
| 708 | gear |
| 710 | first wheel |
| 711 | first wheel main body |
| 712 | first flange |
| 713 | fitting shaft |

-continued

| | |
|---|---|
| 714 | support recessed portion |
| 715 | outer side face |
| 716 | inner side face |
| 717 | magnet ring |
| 718 | tip end face |
| 719 | mounting shaft |
| 720 | second wheel |
| 731 | follower wheel device |
| 732 | second axle |
| 751 | follower wheel device |
| 752 | second axle |
| 760 | fourth wheel |
| 761 | fourth wheel main body |
| 762 | fourth flange |
| 763 | fitting shaft |
| 764 | support recessed portion |
| 765 | outer side face |
| 766 | inner side face |
| 768 | tip end face |
| 770A | carriage |
| 770B | carriage |
| 770C | carriage |
| 770D | carriage |
| 771 | carriage frame |
| 772 | main frame |
| 773 | middle member |
| 774 | recessed step portion |
| 775 | locking lug |
| 776 | longitudinal member |
| 777 | lateral member |
| 778 | outer face |
| 778A | coupling hole |
| 781 | housing portion |
| 782 | housing portion |
| 789 | locking protrusion |
| 800 | bearing plate |
| 801 | fitting recessed portion |
| 802 | support protruding portion |
| 805 | protruding chip |
| 806 | spring receiving portion |
| 807 | spring insertion portion |
| 821 | carriage frame |
| 822 | main frame |
| 823 | middle member |
| 825 | locking lug |
| 826 | longitudinal member |
| 827 | lateral member |
| 827B | upper face |
| 828 | outer face |
| 828A | coupling hole |
| 831 | housing portion |
| 832 | housing portion |
| 835 | fixing member |
| 836 | fitting hole |
| 837 | center shaft |
| 841 | fitting protrusion |
| 842 | guide member |
| 843 | guide groove |
| 845 | guide groove |
| 847 | conductive contact plate |
| 848 | conductive contact plate |
| 851 | powered toy vehicle |
| 852 | toy vehicle main body |
| 853 | chassis |
| 854 | opening |
| 855 | vehicle body |
| 856 | gear box |
| 857 | guide recessed portion |
| 860 | locking groove |
| 861 | toy passenger vehicle |
| 862 | toy vehicle main body |
| 863 | chassis |
| 865 | vehicle body |
| 868 | locking groove |
| 870 | guide member |
| 871 | guide groove |
| 872 | conductive contact plate |
| 873 | conductive contact plate |
| 875 | electric component |

The invention claimed is:

1. A toy vehicle, wherein (a) a toy vehicle main body includes a chassis and carriage frames mounted to a front and a rear of the chassis, (b) the carriage frame mounted to one of the front and rear portions is provided with a pair of first wheel devices for a toy vehicle, wherein:

(i) the first wheel device is adapted to be placed on a pair of rails and comprises a first axle and first and second wheels provided on opposite sides of the first axle, (ii) the first wheel comprises a first wheel main body rolling on one of the rails and a first flange guided by the one rail and the first wheel main body and the first flange are made of a synthetic resin, and (iii) the second wheel comprises a second wheel main body rolling on the other of the rails and a second flange guided by the other rail and at least the second wheel main body is formed of a member attracting with a magnetic force, and wherein the first axle is formed with a gear, (c) the carriage frame mounted to the other of the front and rear portions is provided with a pair of second wheel devices for a toy vehicle, wherein (d) the second wheel device is adapted to be placed on a pair of rails and comprises a second axle and third and fourth wheels provided on opposite sides of the second axle, (e) the third wheel comprises a third wheel main body rolling on one of the rails and a third flange guided by the one rail and the third wheel main body and the third flange are made of a synthetic resin, (f) the fourth wheel comprises a fourth wheel main body rolling on the other of the rails and a fourth flange guided by the other rail, and (g) the fourth wheel main body comprises the second axle and formed of a member attracting with a magnetic force, wherein (h) the second axle is provided with a conductive ring electrically conductive ring electrically conductive with the second axle between the third wheel and the fourth wheel; wherein (i) the chassis is provided with a drive motor and a gear train for transmitting rotation of the drive motor to the gears of the pair of first wheel devices for a toy vehicle, (j) the chassis is provided with a first conductive contact coming in sliding contact with one of the conductive rings of the pair of second wheel devices and a second conductive contact coming in sliding contact with the other conductive ring, the first conductive contact being electrically connected to one of a positive terminal and a negative terminal of the drive motor and the second conductive contact being electrically connected to the other of the positive terminal and the negative terminal of the drive motor.

2. The wheel device for a toy vehicle according to claim 1, wherein the fourth wheel main body is formed of a magnet.

3. The wheel device for a toy vehicle according to claim 1, wherein the fourth wheel main body is formed of a magnet and a rolling shaft having the magnet therein and made of ferromagnetic material in the shape of a round shaft.

4. The wheel device for a toy vehicle according to claim 1, wherein the third wheel main body, the third flange, and the fourth flange are made of a synthetic resin.

5. The toy vehicle according to claim 1, wherein the second wheel main bodies of the pair of first wheel devices are formed of the members attracting with the magnetic forces and the fourth wheel main bodies of the pair of second wheel devices are formed of the members attracting with the magnetic forces are arranged so as to alternately come in contact with the different rails.

6. A wheel device for a toy vehicle adapted to be placed on a pair of rails, comprising:

(a) a second axle and third and fourth wheels provided on opposite sides of the second axle, (b) the third wheel comprises a third wheel main body having a mounting shaft and a third flange, and a magnet ring mounted to the mounting shaft, the magnet ring rolling on one of the rails and the third flange being guided by the one rail, (c) the fourth wheel comprises a fourth wheel main body rolling on the other rail and a fourth flange guided by the other rail, (d) the second axle, the third wheel main body, and the fourth wheel are made of ferromagnetic material, (e) the third wheel main body is directly mounted on one side of the second axle to be electrically conductive with the second axle, and (f) the fourth wheel is mounted on the other side of the second axle with an auxiliary member made of a synthetic resin interposed therebetween not to be electrically conductive with the second axle.

7. The wheel device for a toy vehicle according to claim 6, wherein the third wheel main body is formed with a support recessed portion in which the axle is rotatably supported.

8. A toy vehicle, wherein (a) a toy vehicle main body includes a chassis and carriage frames mounted to a front portion and a rear portion of the chassis, (b) the carriage frame mounted to one of the front and rear portions is provided with a pair of first wheel devices for a toy vehicle, wherein (i) the first wheel device is adapted to be placed on a pair of rails and comprises an axle and a pair of wheels provided on opposite sides of the axle and (ii) each of the wheels comprises a wheel main body having a mounting shaft and a flange, and a magnet ring mounted on the mounting shaft, the magnet ring rolling on the rail and the flange being guided by the rail, and wherein the axle is provided with a gear, (c) the carriage frame mounted to the other of the front and rear portions is provided with a pair of second wheel devices for a toy vehicle wherein, the second wheel device is adapted to be placed on the pair of rails and comprises a second axle and third and fourth wheels provided on opposite sides of the second axle, (d) the third wheel comprises a third wheel main body having a mounting shaft and a third flange, and a magnet ring mounted to the mounting shaft, the magnet ring rolling on one of the rails and the third flange being guided by the one rail, (e) the fourth wheel comprises a fourth wheel main body rolling on the other rail and a fourth flange guided by the other rail, (f) the second axle, the third wheel main body, and the fourth wheel are made of ferromagnetic material, (g) the third wheel main body is directly mounted on one side of the second axle to be electrically conductive with the second axle, and (h) the fourth wheel is mounted on the other side of the second axle with an auxiliary member made of a synthetic resin interposed therebetween not to be electrically conductive with the second axle, (i) the chassis is provided with a drive motor and a gear train for transmitting rotation of the drive motor to the gears of the pair of first wheel devices, and (j) the chassis is provided with a first conductive contact coming in sliding contact with one of the second axles of the pair of second wheel devices and a second conductive contact coming in sliding contact with the other second axle, the first conductive contact being electrically connected to one of a positive terminal and a negative terminal of the drive motor and the second conductive contact being electrically connected to the other of the positive terminal and the negative terminal of the drive motor.

9. A carriage frame for a toy vehicle, comprising:

a wheel device adapted to be placed on a pair of rails, the wheel device including, (a) a second axle and third and fourth wheels provided on opposite sides of the second axle, (b) the third wheel comprises a third wheel main body having a mounting shaft and a third flange, and a magnet ring mounted to the mounting shaft, the magnet ring rolling on one of the rails and the third flange being guided by the one rail, (c) the fourth wheel comprises a fourth wheel main body rolling on the other rail and a fourth flange guided by the other rail, (d) the second axle, the third wheel main body, and the fourth wheel are made of ferromagnetic material, (e) the third wheel main body is directly mounted on one side of the second axle to be electrically conductive with the second axle, (f) the fourth wheel is mounted on the other side of the second axle with an auxiliary member made of a synthetic resin interposed therebetween not to be electrically conductive with the second axle, wherein (g) the third wheel main body is formed with a support recessed portion in which the axle is rotatably supported; and (h) a main frame and a pair of bearing plates mounted to the main frame so that the plates face each other, (i) the bearing plates are made of ferromagnetic material and provided with a pair of support protruding portions and a protruding chip, and (j) the support recessed portions of the wheel device are rotatably supported on the opposed support protruding portions of the pair of bearing plates.

10. A carriage frame for a toy vehicle, comprising:

(a) a main frame and a pair of bearing plates mounted to the main frame so that the plates face each other, (b) each of the bearing plates is made of ferromagnetic material and provided with a pair of support protruding portions and a protruding chip, (c) a wheel device is rotatably supported on opposed support protruding portions of the pair of bearing plates, (d) the wheel device is adapted to be placed on a pair of rails and comprises an axle and a pair of wheels provided on opposite sides of the axle, (e) the wheels comprise a wheel main body for rolling on the rail and a flange guided by the rail, (f) the axle is made of a synthetic resin and the wheels are made of ferromagnetic material, and (g) the wheel main body is formed with a support recessed portion to be rotatably supported on the support protruding portion of the bearing plate.

11. A toy vehicle, comprising:

(a) a toy vehicle main body includes a chassis and a carriage frame for a toy vehicle mounted to a front portion or a rear portion of the chassis, the carriage frame comprising:

(b) a main frame and a pair of bearing plates mounted to the main frame so that the plates face each other;

(c) each of the bearing plates is made of ferromagnetic material and provided with a pair of support protruding portions and a protruding chip;

(d) a wheel device is rotatably supported on opposed support protruding portions of the pair of bearing plates;

(e) the wheel device is adapted to be placed on a pair of rails and comprises an axle and a pair of wheels provided on opposite sides of the axle;

(f) the wheels comprise a wheel main body for rolling on the rail and a flange guided by the rail;

(g) the axle is made of a synthetic resin and the wheels are made of ferromagnetic material; and (h) the wheel main body is formed with a support recessed portion to be rotatably supported on the support protruding portion of the bearing plate; wherein (i) the chassis is provided with an electric component, and (j) the chassis is provided with a third conductive contact coming in contact with one of the protruding chips and a fourth conductive contact coming in contact with the other protruding chip of the carriage frame, the third conductive contact being electrically connected to one of a positive terminal and a negative terminal of the electric component and the fourth conductive contact being electrically connected to the other of the positive terminal and the negative terminal of the electric component.

* * * * *